US009494380B1

(12) United States Patent
Yehle

(10) Patent No.: US 9,494,380 B1
(45) Date of Patent: Nov. 15, 2016

(54) STRING CONTROL SYSTEM FOR A CROSSBOW

(71) Applicant: Ravin Crossbows, LLC, Superior, WI (US)

(72) Inventor: Craig Thomas Yehle, Holmen, WI (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 15/098,557

(22) Filed: Apr. 14, 2016

Related U.S. Application Data

(60) Provisional application No. 62/244,932, filed on Oct. 22, 2015.

(51) Int. Cl.
*F41B 5/12* (2006.01)

(52) U.S. Cl.
CPC ..... *F41B 5/12* (2013.01)

(58) Field of Classification Search
CPC ..... F41B 5/12; F41B 5/123; F41B 5/1469
See application file for complete search history.

(56) References Cited

U.S. PATENT DOCUMENTS

| | | | |
|---|---|---|---|
| 4,030,473 | A | 6/1977 | Puryear |
| 4,192,281 | A | 3/1980 | King |
| 4,479,480 | A | 10/1984 | Holt |
| 4,693,228 | A | 9/1987 | Simonds et al. |
| 4,877,008 | A | 10/1989 | Troubridge |
| 5,085,200 | A | 2/1992 | Horton-Corcoran et al. |
| 5,596,976 | A | 1/1997 | Waiser |
| 5,598,829 | A | 2/1997 | Bednar |
| 5,649,520 | A | 7/1997 | Bednar |
| 5,884,614 | A | 3/1999 | Darlington et al. |
| 6,205,990 | B1 | 3/2001 | Adkins |
| 6,425,386 | B1 | 7/2002 | Adkins |
| 6,736,123 | B1 | 5/2004 | Summers et al. |
| 7,174,884 | B2 | 2/2007 | Kempf et al. |
| 7,770,567 | B1 | 8/2010 | Yehle |
| 7,784,453 | B1 | 8/2010 | Yehle |
| 7,810,480 | B2 | 10/2010 | Shepley et al. |
| 7,997,258 | B2 | 8/2011 | Shepley et al. |
| 8,020,543 | B2 | 9/2011 | Maleski et al. |
| 8,091,540 | B2 | 1/2012 | Matasic et al. |
| 2009/0194086 | A1 | 8/2009 | Kempf |
| 2010/0170488 | A1 | 7/2010 | Rasor et al. |
| 2011/0253118 | A1 | 10/2011 | Kempf |

OTHER PUBLICATIONS

U.S. Appl. No. 13/799,518, filed Mar. 13, 2013, for Energy Storage Device for a Bow.*
U.S. Appl. No. 61/820,792, filed May 8, 2013, for Cocking Mechanism for a Bow.*

(Continued)

*Primary Examiner* — John Ricci

(57) ABSTRACT

A string control assembly for a crossbow having a catch, a sear, a dry fire lockout and a trigger assembly. Engaging the draw string with the catch when in the open position after firing the crossbow generates a force that pushes the catch from the open position to the closed position and automatically (i) couples the sear with the catch at the interface to retain the catch in the closed position, and (ii) moves the dry fire lockout to the lockout position to block the sear from moving to the de-cocked position. In one embodiment, engaging the draw string with the catch automatically moves the safety to the safe position coupled with the sear to retain the sear in the cocked position.

16 Claims, 50 Drawing Sheets

(56) References Cited

OTHER PUBLICATIONS

U.S. Appl. No. 14/071,723, filed Nov. 5, 2013, for De-Cocking Mechanism for a Bow.*
U.S. Appl. No. 15/171,391, filed Jun. 2, 2016, for Cocking Mechanism for a Crossbow.*
U.S. Appl. No. 14/107,058, filed Dec. 16, 2013, for String Guide System for a Bow.*
U.S. Appl. No. 62/244,932, filed Oct. 22, 2015, for String Guide for a Bow.*
U.S. Appl. No. 15/098,537, filed Apr. 14, 2016, for Crossbow.*
U.S. Appl. No. 15/098,557, filed Apr. 14, 2016, for String Control System for a Crossbow.*
U.S. Appl. No. 15/098,568, filed Apr. 14, 2016, for Reduced Friction Trigger for a Crossbow.*
U.S. Appl. No. 15/098,577, filed Apr. 14, 2016, for Anti Dry-Fire System for a Crossbow.*

* cited by examiner

STRING CONTROL SYSTEM FOR A CROSSBOW

REFERENCE TO RELATED APPLICATIONS

The present application claims the benefit of U.S. Prov. Application Ser. No. 62/244,932, filed Oct. 22, 2015, the entire disclosure of which is hereby incorporated by reference.

FIELD OF THE INVENTION

The present disclosure is directed to a string control assembly for a crossbow.

BACKGROUND OF THE INVENTION

Bows have been used for many years as a weapon for hunting and target shooting. More advanced bows include cams that increase the mechanical advantage associated with the draw of the bowstring. The cams are configured to yield a decrease in draw force near full draw. Such cams preferably use power cables that load the bow limbs. Power cables can also be used to synchronize rotation of the cams, such as disclosed in U.S. Pat. No. 7,305,979 (Yehle).

With conventional bows and crossbows the draw string is typically pulled away from the generally concave area between the limbs and away from the riser and limbs. This design limits the power stroke for bows and crossbows.

In order to increase the power stroke, the draw string can be positioned on the down-range side of the string guides so that the draw string unrolls between the string guides toward the user as the bow is drawn, such as illustrated in U.S. Pat. No. 7,836,871 (Kempf) and U.S. Pat. No. 7,328,693 (Kempf). One drawback of this configuration is that the power cables can limit the rotation of the cams to about 270 degrees. In order to increase the length of the power stroke, the diameter of the pulleys needs to be increased. Increasing the size of the pulleys results in a larger and less usable bow.

FIGS. 1-3 illustrate a string guide system for a bow that includes power cables 20A, 20B ("20") attached to respective string guides 22A, 22B ("22") at first attachment points 24A, 24B ("24"). The second ends 26A, 26B ("26") of the power cables 20 are attached to the axles 28A, 28B ("28") of the opposite string guides 22. Draw string 30 engages down-range edges 46A, 46B of string guides 22 and is attached at draw string attachment points 44A, 44B ("44")

As the draw string 30 is moved from released configuration 32 of FIG. 1 to drawn configuration 34 of FIGS. 2 and 3, the string guides 22 counter-rotate toward each other about 270 degrees. The draw string 30 unwinds between the string guides 22 from opposing cam journals 48A, 48B ("48") in what is referred to as a reverse draw configuration. As the first attachment points 24 rotate in direction 36, the power cables 20 are wrapped around respective power cable take-up journal of the string guides 22, which in turn bends the limbs toward each other to store the energy needed for the bow to fire the arrow.

Further rotation of the string guides 22 in the direction 36 causes the power cables 20 to contact the power cable take-up journal, stopping rotation of the cam. The first attachment points 24 may also contact the power cables 20 at the locations 38A, 38B ("38"), preventing further rotation in the direction 36. As a result, rotation of the string guides 22 is limited to about 270 degrees, reducing the length 40 of the power stroke.

Various trigger systems are used to retain the draw string 30 in the drawn configuration, such as disclosed in U.S. Pat. No. 7,174,884 (Kempf); U.S. Pat. No. 7,770,567 (Yehle); and U.S. Pat. No. 8,240,299 (Kronengold). Due to the high forces generated by a crossbow, firm engagement is required between the seer and the trigger assembly. These high pressures combined with the solid engagement of the seer with the trigger assembly often results in an undesirably hard and rough trigger pull. Crossbows also require a system to prevent inadvertent dry firing. It is therefore desirable to provide a string control system for a crossbow that provides for a lighter, smoother trigger pull in combination with an anti-dry fire mechanism.

BRIEF SUMMARY OF THE INVENTION

The present disclosure is directed to a string control assembly for a crossbow having a draw string for launching arrows. The string control system includes a catch, a sear, a dry fire lockout and a trigger assembly. The catch is moveable between a closed position that retains the draw string in a drawn configuration and an open position that releases the draw string to a released configuration such that after firing the crossbow the catch is biased to the open position. A sear is moveable between a de-cocked position and a cocked position coupled with the catch at an interface to retain the catch in the closed position such that after firing the crossbow the sear is retained in the de-cocked position by the catch, the sear being biased to the cocked position. A dry fire lockout is moveable between a disengaged position and a lockout position that blocks the sear from moving to the de-cocked position, such that after firing the crossbow the dry fire lockout is retained in the disengaged position by the sear while being biased to the lockout position. The trigger assembly is located at a proximal end of the crossbow having a trigger positioned to move the sear from the cocked position to the de-cocked position to fire the crossbow. Engaging the draw string with the catch when in the open position after firing the crossbow generates a force that pushes the catch from the open position to the closed position and automatically (i) couples the sear with the catch at the interface to retain the catch in the closed position, and (ii) moves the dry fire lockout to the lockout position to block the sear from moving to the de-cocked position.

The present string control system preferably includes a safety moveable between a free position and a safe position coupled with the sear to retain the sear in the cocked position such that after firing the crossbow the safety is retained in the free position by the sear while being biased to the safe position. Engaging the draw string with the catch while in the open position automatically moves the safety to the safe position coupled with the sear to retain the sear in the cocked position.

In one embodiment, the catch, the sear, the safety, and the dry fire lockout are contained in a string carrier that slides along a center rail between a distal end to engage with the draw string and a proximal end to engage with the trigger assembly. The string carrier is preferably connected to a spool rotatably mounted near the proximal end of the crossbow by a flexible tension member. A cocking handle configured to engage with the spool is provided. A clutch is provided to limit tension that can be applied to the flexible tension member by the cocking handle.

In another embodiment, a pair of spool gears are located on opposite sides of the spool. A drive shaft with a pair of drive gears mesh with each of the spool gears to equalize torque applied to the spool by the drive gears during cocking. In one embodiment, a pair of pawls are engaged with the spool gears that selectively prevent rotation of the spool in a direction to release the flexible tension member. The pawls are preferably offset about ½ gear tooth spacing on the spool gears so that at least one pawl tooth is always engaged with a spool gear at all times.

In one embodiment, the catch includes a curved protrusion that engages with a corresponding recess in the sear at the interface when the sear is in the cocked position. In another embodiment, a low friction device is located at the interface of the catch with the sear when the sear is in the cocked position. The low friction device at the interface can be a roller pin supported by ball bearings that engages with a recess in the sear at the interface when the sear is in the cocked position.

The present string control system optionally includes an arrow capture located proximate the catch, the arrow capture comprising an elongated arrow capture recess extending along a direction of travel of the arrow launched from the crossbow. In one embodiment, the arrow capture is located proximate the catch. The arrow capture includes a rotating member with an axis of rotation generally perpendicular to a direction of travel of the arrow launched from the crossbow. In another embodiment, the arrow capture includes a rotating member that can be displaced within a slot in a direction generally perpendicular to the arrow, while being biased into engagement with the arrow. In yet another embodiment, the arrow capture includes upper surfaces that prevent the arrow from rising upward when the crossbow is fired, and angled lower surfaces that permit the arrow to slide downward relative to the catch unless a clip-on nock on the arrow is fully engaged with the draw string. When the crossbow is cocked and loaded the arrow is suspended between the clip-on nock and an arrow rest located at the front of the crossbow.

In one embodiment, the portion of the dry fire lockout that engages with the arrow to move the dry fire lockout to the disengaged position is located behind the draw string. In the preferred embodiment, the arrow nock extends past the draw string to move the dry tire lockout to the disengaged position.

DETAILED DESCRIPTION OF THE INVENTION

Figure 1:
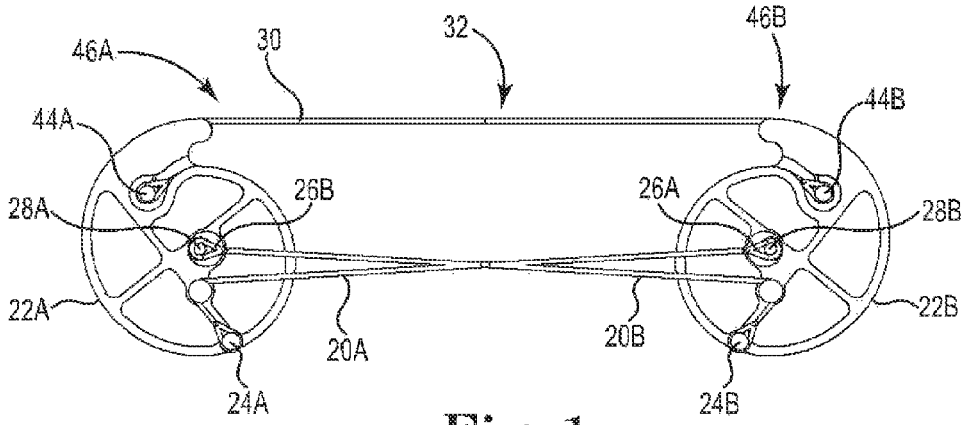
FIG. 1 is a bottom view of a prior art string guide system for a bow in a released configuration.
Figure 2:
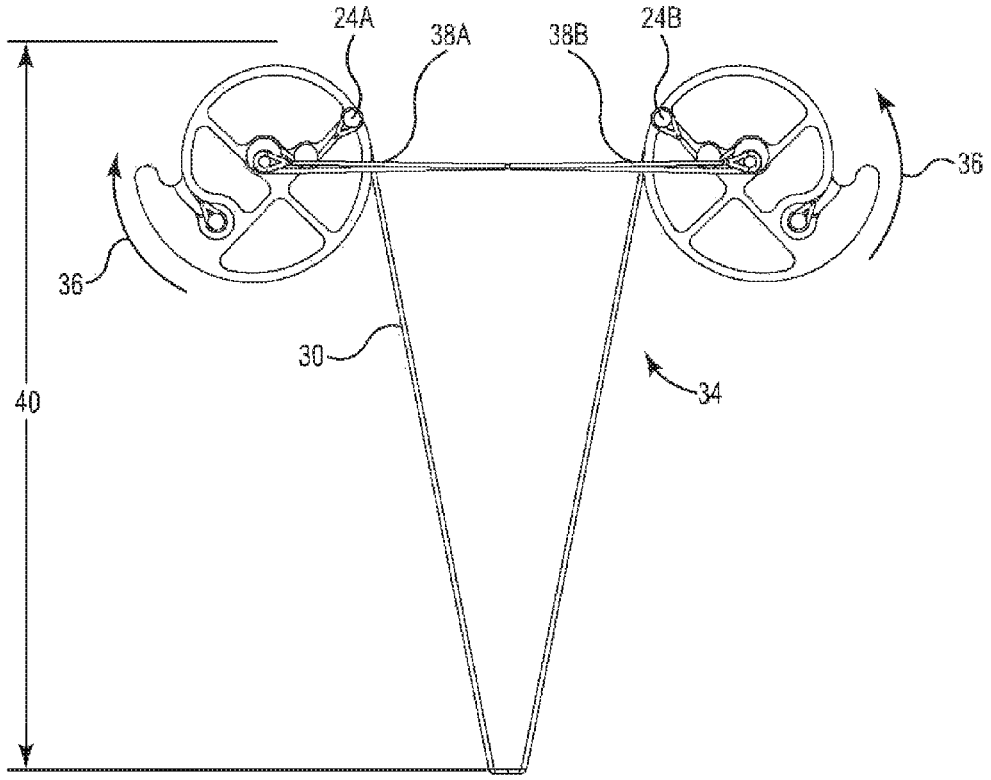
FIG. 2 is a bottom view of the string guide system of FIG. 1 in a drawn configuration.
Figure 3:
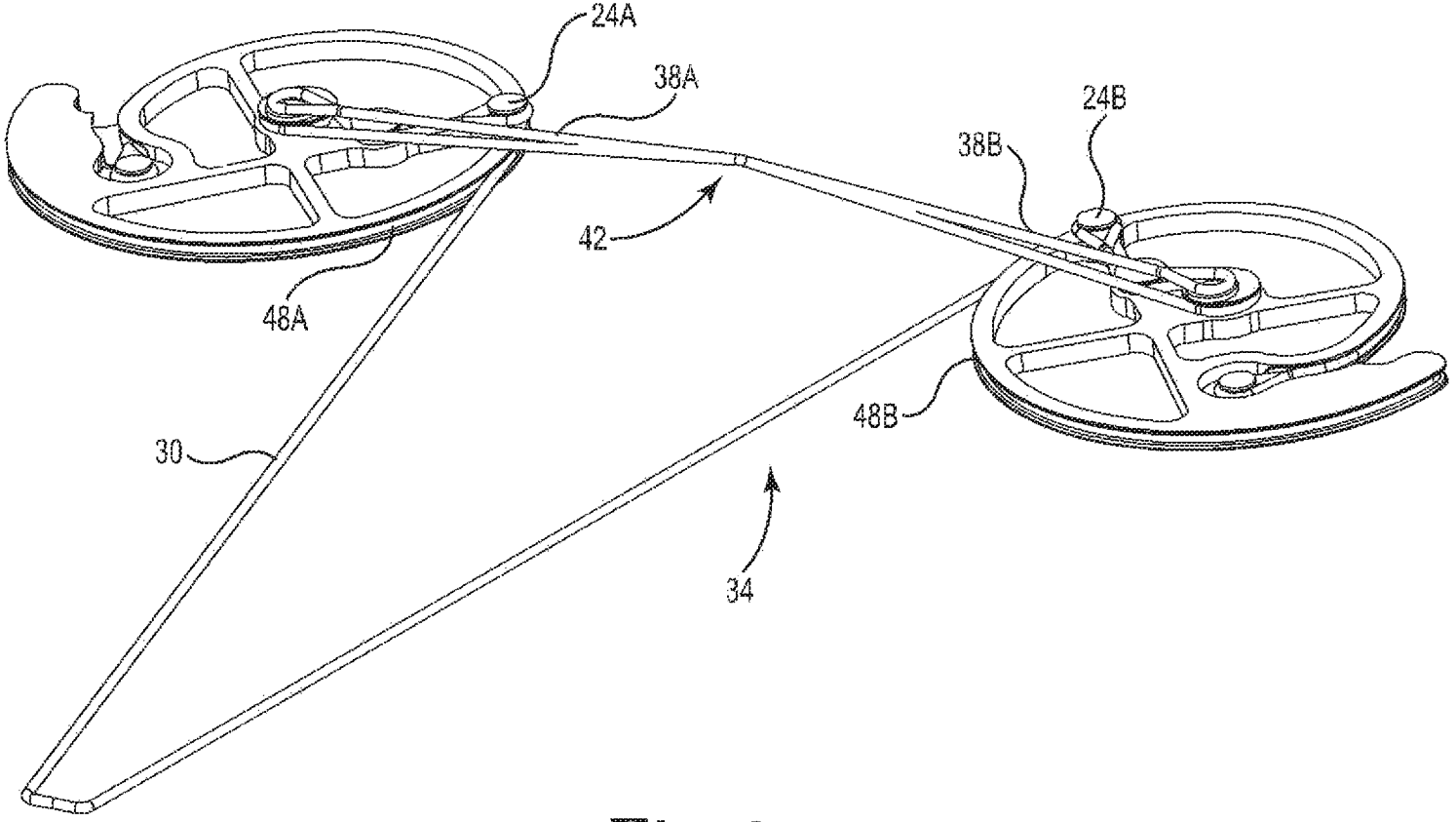
FIG. 3 is a perspective view of the string guide system of FIG. 1 in a drawn configuration.
Figure 4:
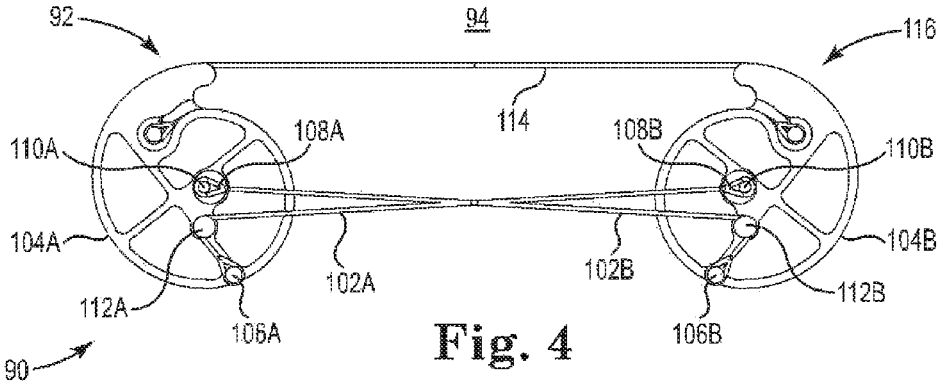
FIG. 4 is a bottom view of a string guide system for a bow with a helical take-up journal in accordance with an embodiment of the present disclosure.

FIG. 4 illustrates a string guide system 90 for a bow with a reverse draw configuration 92 in accordance with an embodiment of the present disclosure. Power cables 102A, 102B ("102") are attached to respective string guides 104A, 104B ("104") at first attachment points 106A, 106B ("106"). Second ends 108A, 108B ("108") of the power cables 102 are attached to axles 110A, 110B ("110") of the opposite string guides 104. In the illustrated embodiment, the power cables 102 wrap around power cable take-ups 112A, 112B ("112") located on the respective cam assembles 104 when in the released configuration 116 of FIG. 4.

In the reverse draw configuration 92 the draw string 114 is located adjacent down-range side 94 of the string guide system 70 when in the released configuration 116. In the released configuration 116 of FIG. 4, the distance between the axles 110 may be in the range of less than about 16 inches to less than about 10 inches. In the drawn configuration 118, the distance between the axles 110 may be in the range of about 6 inches to about 8 inches.

Figure 5:
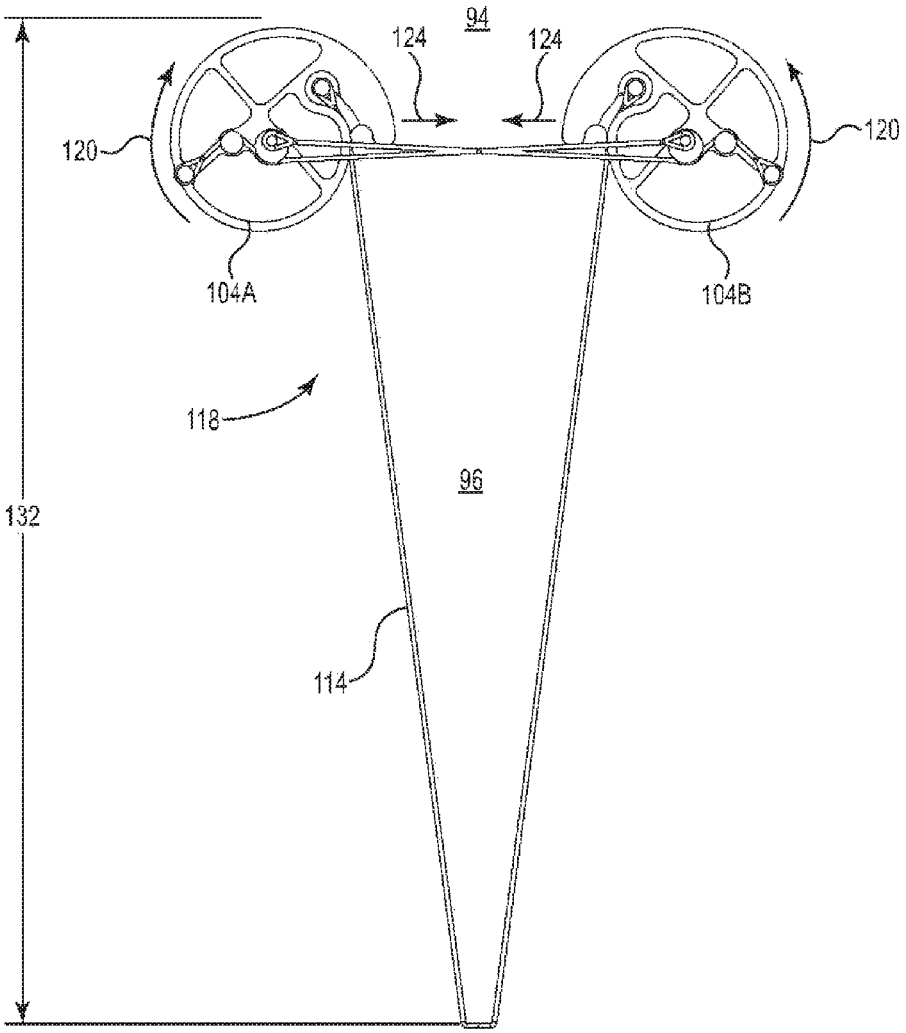
FIG. 5 is a bottom view of the string guide system of FIG. 4 in a drawn configuration.
Figure 6:
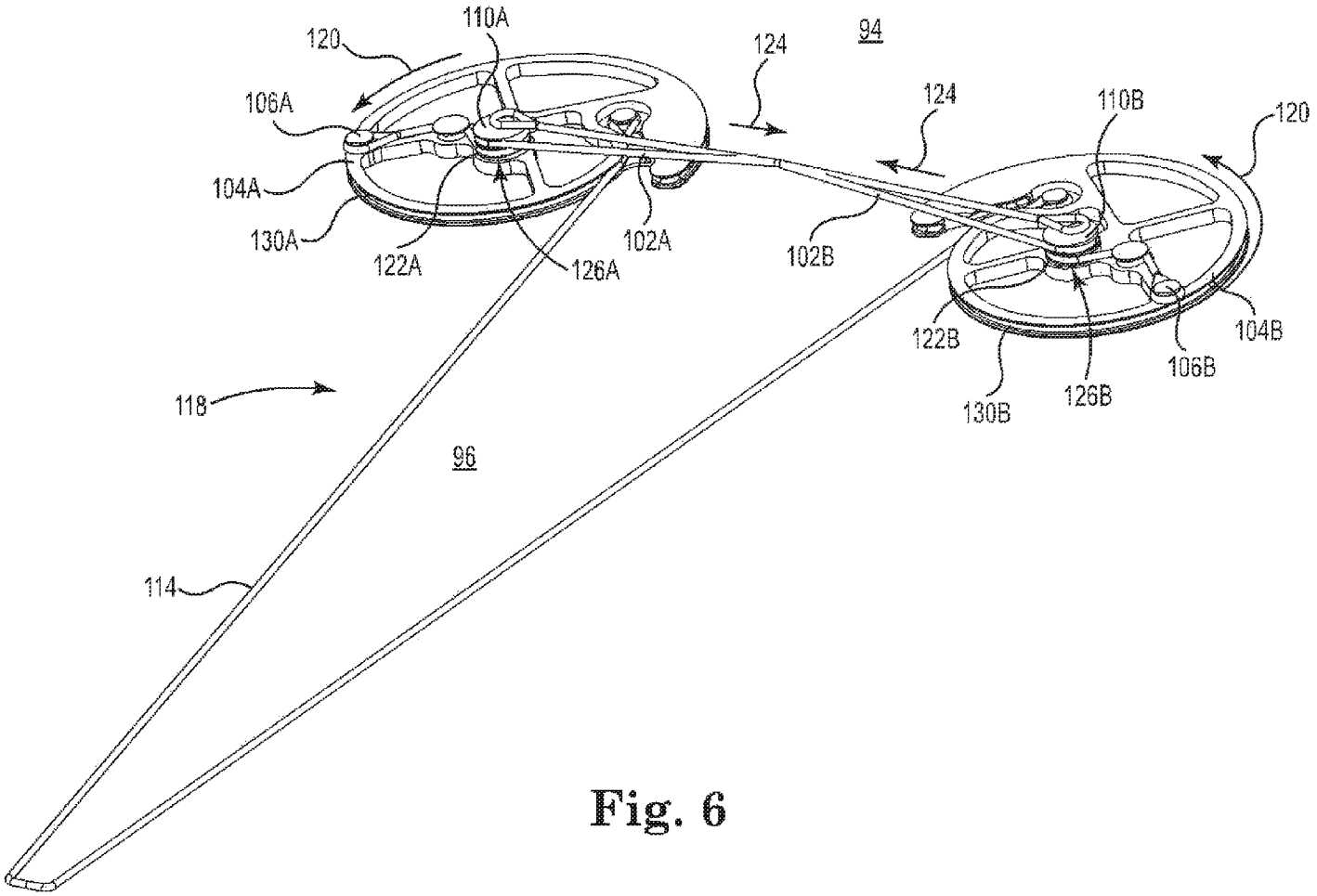
FIG. 6 is a perspective view of the string guide system of FIG. 4 in a drawn configuration.

As illustrated in FIGS. 5 and 6, the draw string 114 translates from the down-range side 94 toward the up-range side 96 and unwinds between the first and second string guides 104 in a drawn configuration 118. In the illustrated embodiment, the string guides 104 counter-rotate toward each other in directions 120 more than 360 degrees as the draw string 114 unwinds between the string guides 104 from opposing cam journals 130A, 130B ("130").

The string guides 104 each include one or more grooves, channels or journals located between two flanges around at least a portion of its circumference that guides a flexible member, such as a rope, string, belt, chain, and the like. The string guides can be cams or pulleys with a variety of round and non-round shapes. The axis of rotation can be located concentrically or eccentrically relative to the string guides. The power cables and draw strings can be any elongated flexible member, such as woven and non-woven filaments of synthetic or natural materials, cables, belts, chains, and the like.

As the first attachment points 106 rotate in direction 120, the power cables 102 are wrapped onto cams 126A, 126B ("126") with helical journals 122A, 122B ("122"), preferably located at the respective axles 110. The helical journals 122 take up excess slack in the power cables 102 resulting from the string guides 104 moving toward each other in direction 124 as the axles 110 move toward each other.

Figure 7:
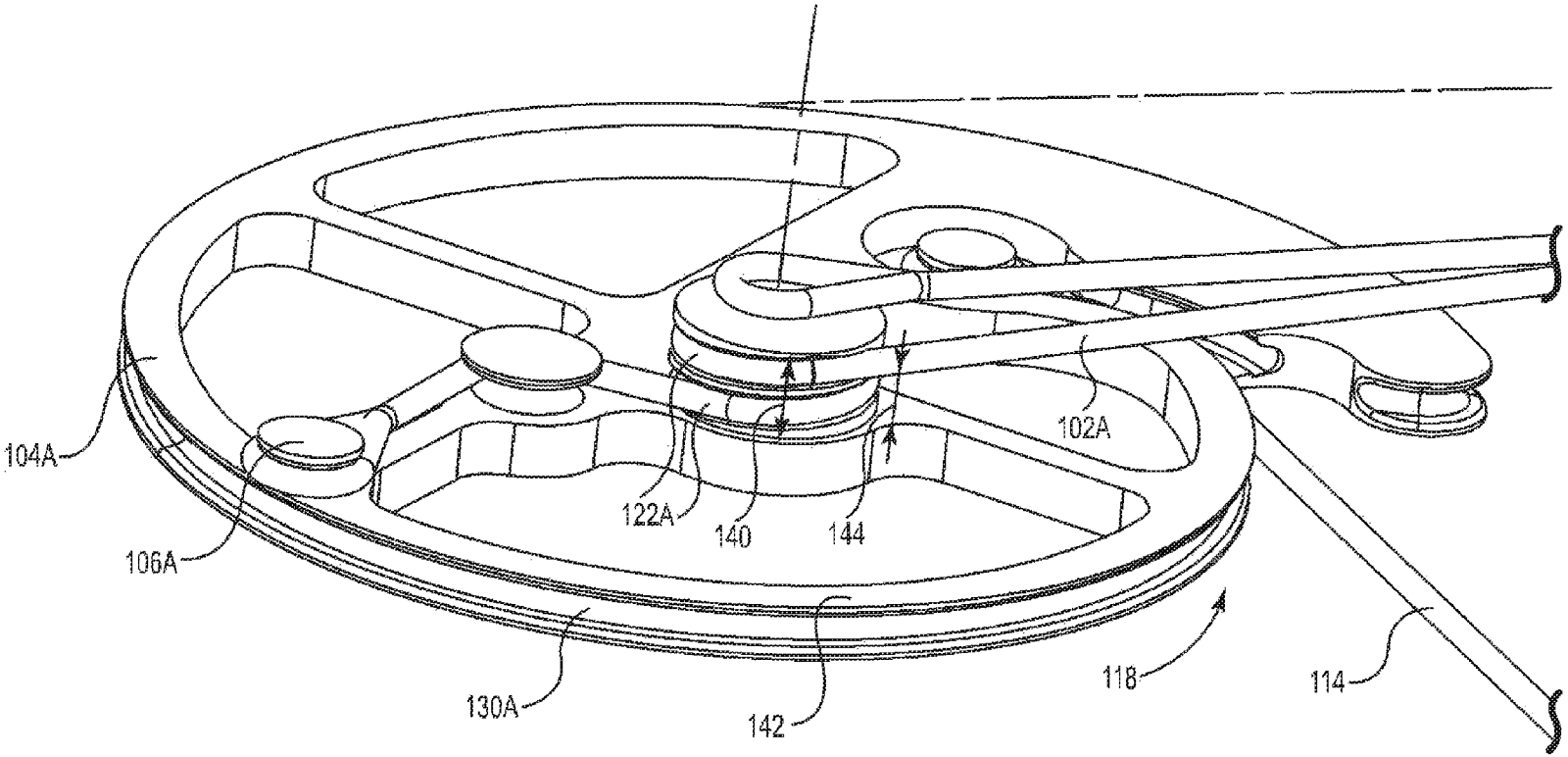
FIG. 7 is an enlarged view of the left string guide of the string guide system of FIG. 4.
Figure 8:
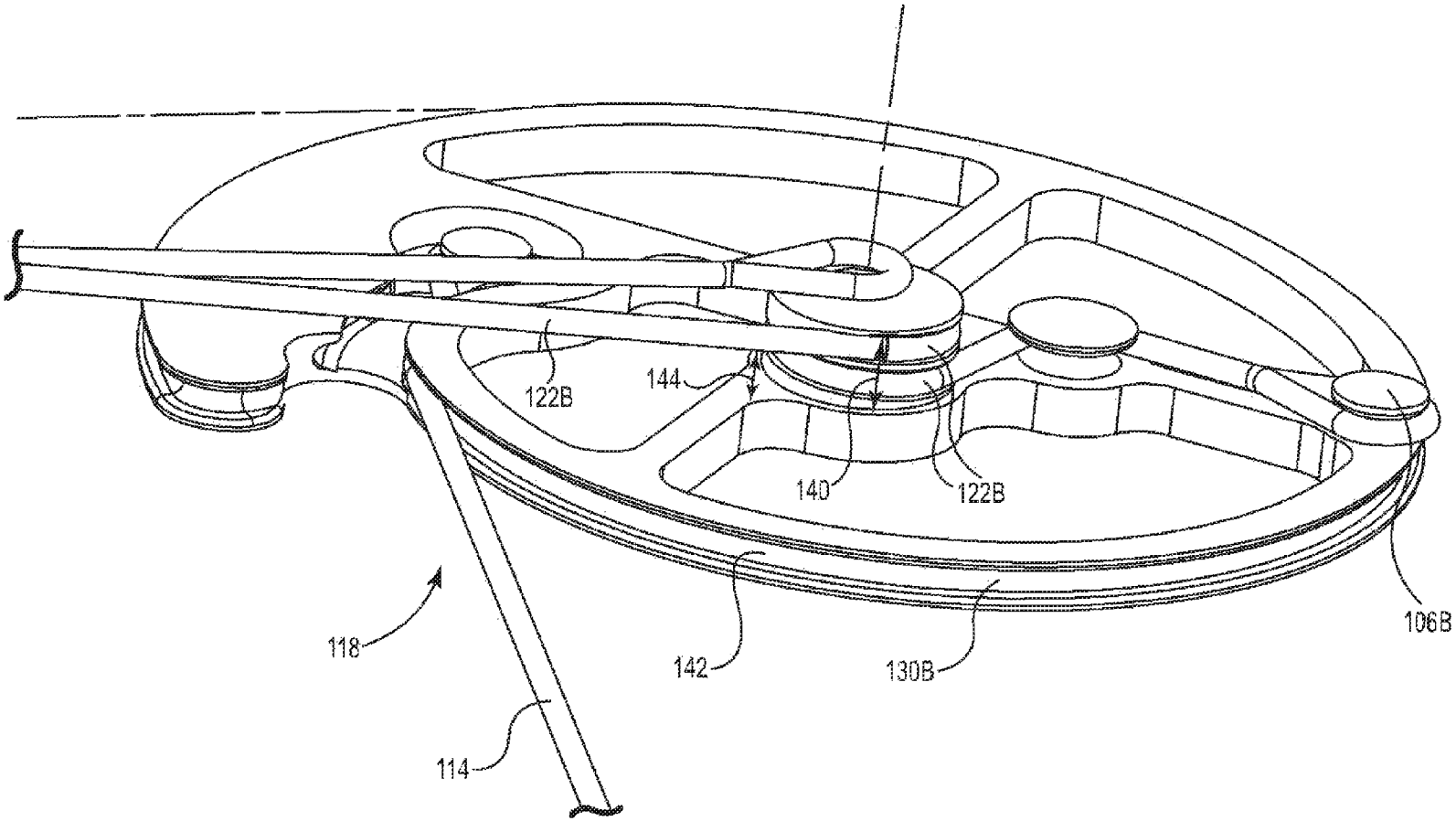
FIG. 8 is an enlarged view of the right string guide of the string guide system of FIG. 4.

The helical journals 122 serve to displace the power cables 102 away from the string guides 104, so the first attachment points 106 do not contact the power cables 102 while the bow is being drawn (see FIGS. 7 and 8). As a result, rotation of the string guides 104 is limited only by the length of the draw string journals 130A, 103B ("130"). For example, the draw string journals 130 can also be helically in nature, wrapping around the axles 110 more than 360 degrees.

As a result, the power stroke 132 is extended. In the illustrated embodiment, the power stroke 132 can be increased by at least 25%, and preferably by 40% or more, without changing the diameter of the string guides 104.

In some embodiments, the geometric profiles of the draw string journals 130 and the helical journals 122 contribute to let-off at full draw. A more detailed discussion of cams suitable for use in bows is provided in U.S. Pat. No. 7,305,979 (Yehle), which is hereby incorporated by reference.

FIGS. 7 and 8 are enlarged views of the string guides 104A, 104B, respectively, with the draw string 114 in the drawn configuration 118. The helical journals 122 have a length corresponding generally to one full wrap of the power cables 102. The axes of rotation 146A, 146B ("146") of the first and second helical journals 122 preferably extend generally perpendicular to a plane of rotation of the first and second string guides 104. The helical journals 122 displace the power cables 102 away from the draw string 114 as the bow is drawn from the released configuration 116 to the drawn configuration 118. Height 140 of the helical journals 122 raises the power cables 102 above top surface 142 of the string guides 104. The resulting gap 144 permits the first attachment points 106 and the power cable take-ups 112 to pass freely under the power cables 102. The length of the helical journals 122 can be increased or decreased to optimize draw force versus draw distance for the bow and let-off. The axes of rotation 146 of the helical journals 122 are preferably co-linear with axes 110 of rotation for the string guides 104.

Figure 9A:
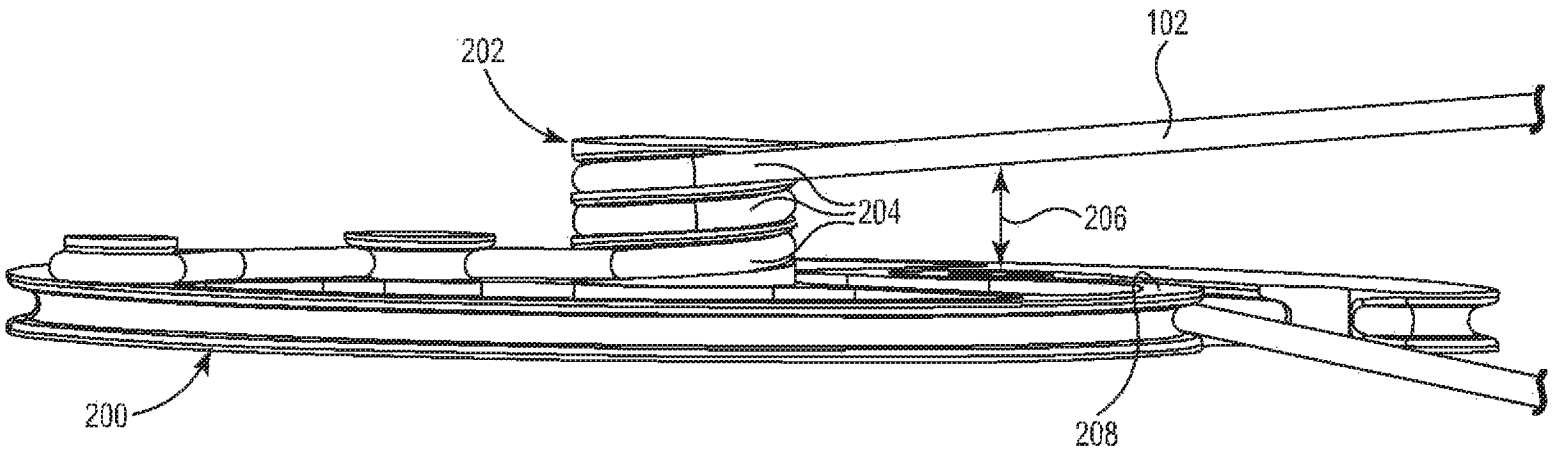
FIG. 9A is an enlarged view of a power cable take-up journal sized to receive two full wraps of the power cable in accordance with an embodiment of the present disclosure.

FIG. 9A illustrates an alternate string guide 200 in accordance with an embodiment of the present disclosure. Power cable take-ups 202 have helical journals 204 that permit the power cables 102 to wrap around about two full turns or about 720 degrees. The extended power cable take-up 202 increases the gap 206 between the power cables 102 and top surface 208 of the string guide 200 and provides excess capacity to accommodate more than 360 degrees of rotation of the string guides 200.

Figure 9B:
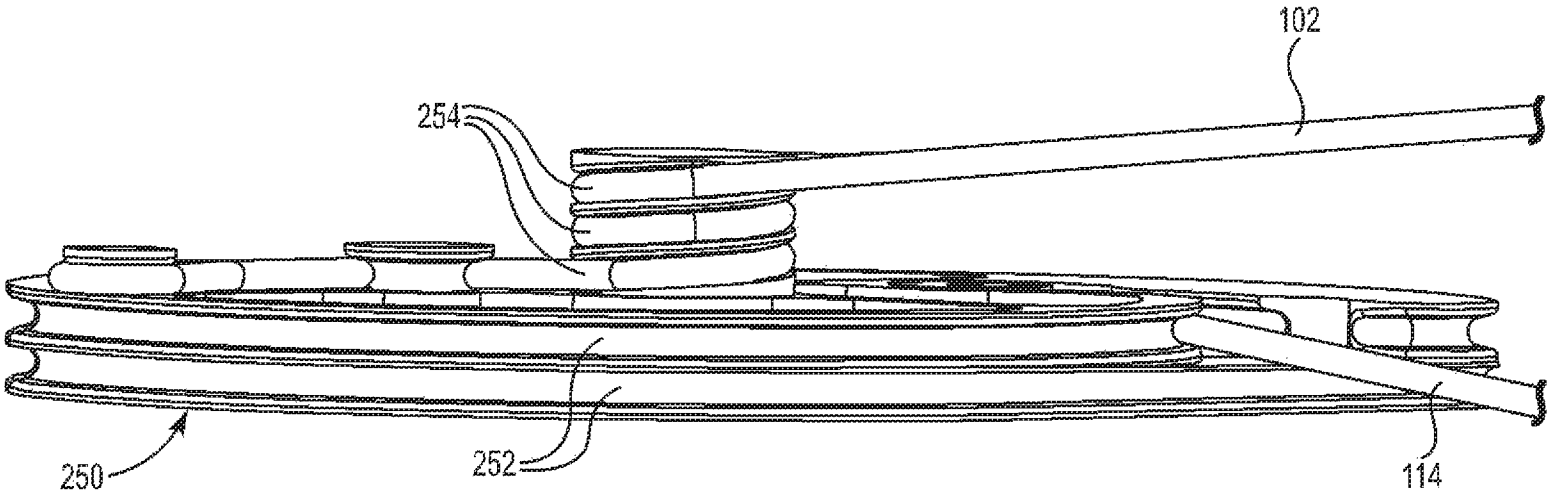
FIG. 9B is an enlarged view of a power cable take-up journal and draw string journal sized to receive two full wraps of the power cable and draw string in accordance with an embodiment of the present disclosure.

FIG. 9B illustrates an alternate string guide 250 in accordance with an embodiment of the present disclosure. The draw string journals 252 and the power cable journals 254 are both helical structures designed so that the draw string 114 and the power cables 102 can wrap two full turns around the string guide 250.

Figure 9C:
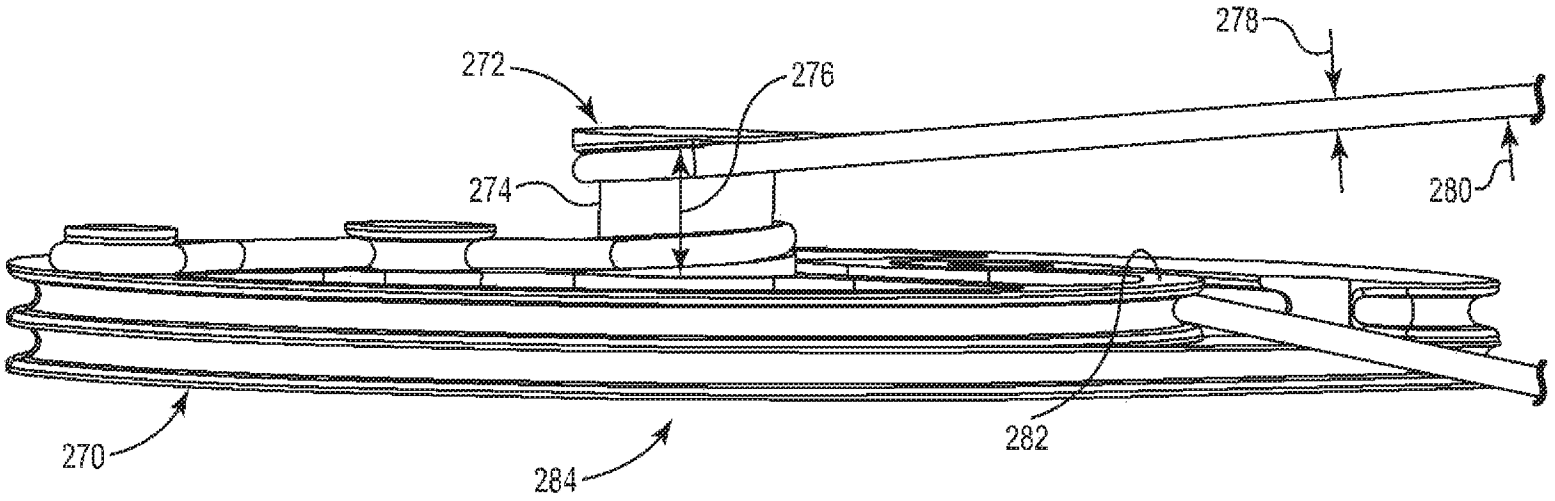
FIG. 9C is an enlarged view of an elongated power cable take-up journal in accordance with an embodiment of the present disclosure.

FIG. 9C illustrates an alternate string guide 270 with a smooth power cable take-up 272 in accordance with an embodiment of the present disclosure. The power cable take-up 272 has a surface 274 with a height 276 at least twice a diameter 278 of the power cable 102. In another embodiment, the surface 274 has a height 276 at least three times the diameter 278 of the power cable 102. Biasing force 280, such as from a cable guard located on the bow shifts the power cables 102 along the surface 274 away from top surface 282 of the string guide 270 when in the drawn configuration 284.

Figure 10:
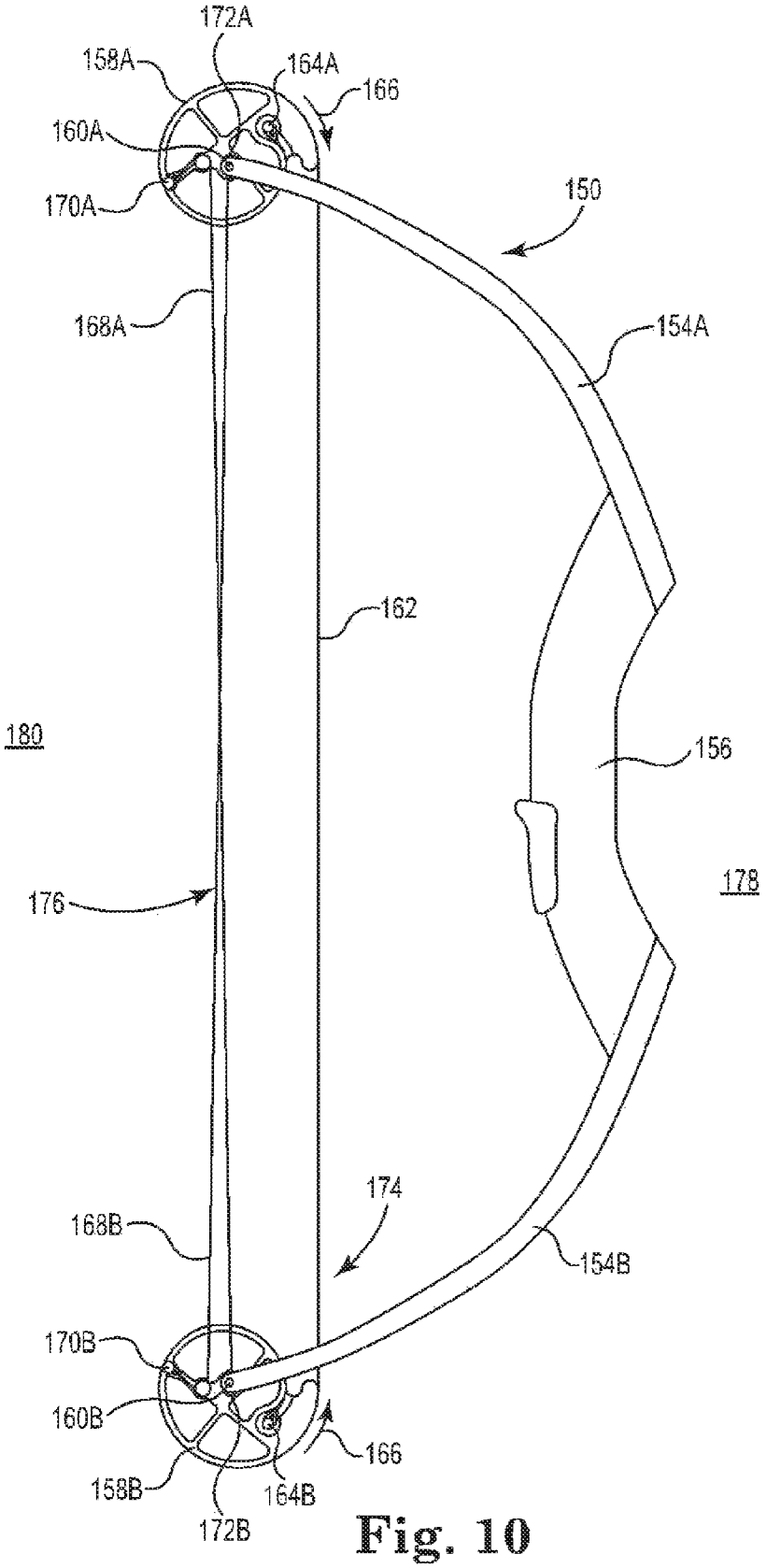
FIG. 10 is a schematic illustration of a bow with a string guide system in accordance with an embodiment of the present disclosure.

FIG. 10 is a schematic illustration of bow 150 with a string guide system 152 in accordance with an embodiment of the present disclosure. Bow limbs 154A, 154B ("154") extend oppositely from handle 156. String guides 158A, 158B ("158") are rotatably mounted, typically eccentrically, on respective limbs 154A, 154B on respective axles 160A, 160B ("160") in a reverse draw configuration 174.

Draw string 162 is received in respective draw string journals (see e.g., FIGS. 7 and 8) and secured at each end to the string guides 158 at locations 164A, 164B. When the bow is in the released configuration 176 illustrated in FIG. 10, the draw string 162 is located adjacent the down-range side 178 of the bow 150. When the bow 150 is drawn, the draw string 162 unwinds from the draw string journals toward the up-range side 180 of the bow 150, thereby rotating the string guides 158 in direction 166.

First power cable 168A is secured to the first string guide 158A at first attachment point 170A and engages with a power cable take-up with a helical journal 172A (see FIGS. 7 and 8) as the bow 150 is drawn. As the string guide 158A rotates in the direction 166, the power cable 168A is taken up by the cam 172A. The other end of the first power cable 168A is secured to the axle 160B.

Second power cable 168B is secured to the second string guide 158B at first attachment point 170B and engages with a power cable take-up with a helical journal 172B (see FIGS. 7 and 8) as the bow 150 is drawn. As the string guide 158B rotates, the power cable 168B is taken up by the cam 172B. The other end of the second power cable 168B is secured to the axle 160A. The power cable take-ups 172 are arranged so that as the bow 150 is drawn, the bow limbs 154 are drawn toward one another.

Figure 11:
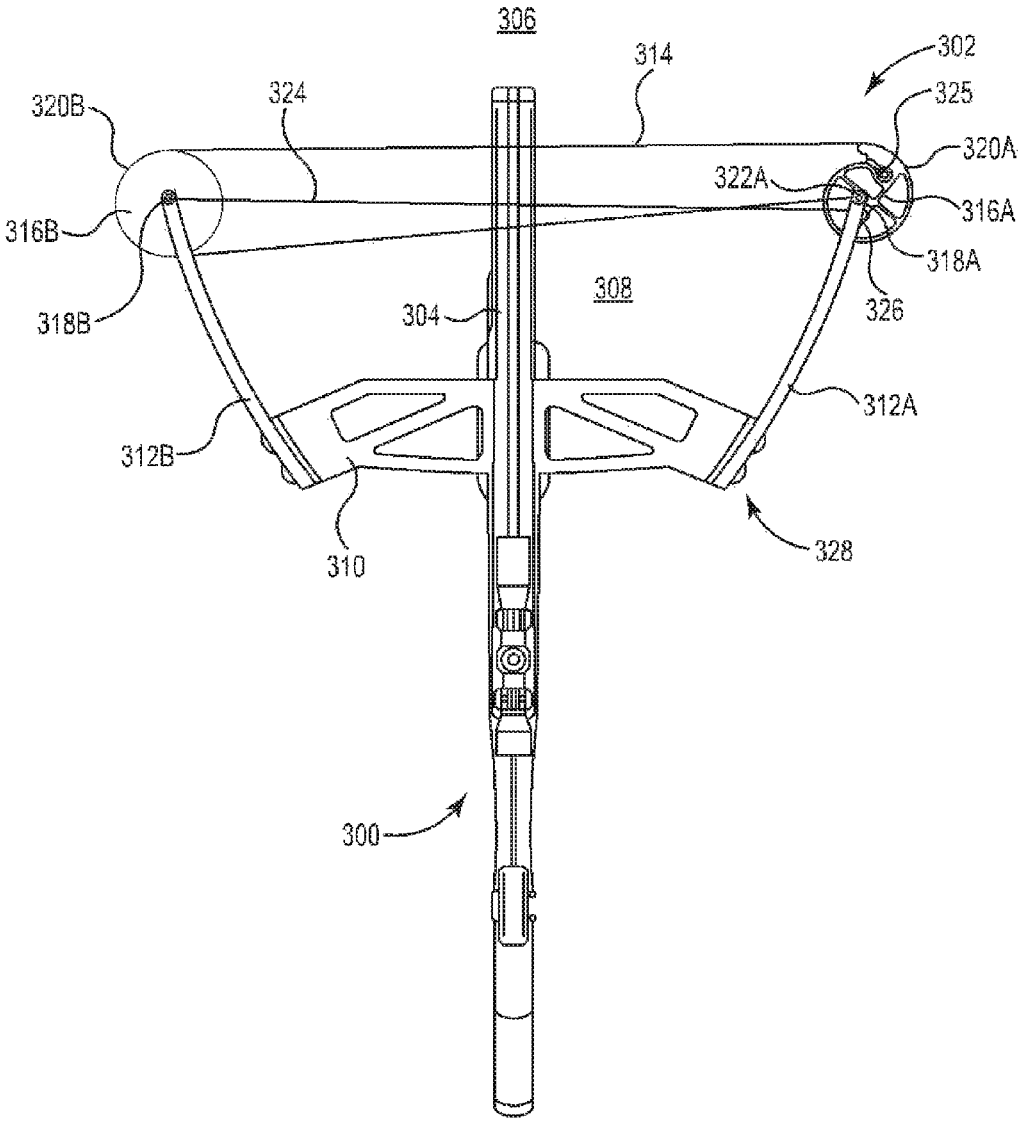
FIG. 11 is a schematic illustration of an alternate bow with a string guide system in accordance with an embodiment of the present disclosure.

FIG. 11 is a schematic illustration of a crossbow 300 with a reverse draw configuration 302 in accordance with an embodiment of the present disclosure. The crossbow 300 includes a center portion 304 with down-range side 306 and up-range side 308. In the illustrated embodiment, the center portion 304 includes riser 310. First and second flexible limbs 312A. 312B ("312") are attached to the riser 310 and extend from opposite sides of the center portion 304.

Draw string 314 extends between first and second string guides 316A, 316B ("316"). In the illustrated embodiment, the string guide 316A is substantially as shown in FIGS. 4-8, while the string guide 316B is a conventional pulley.

The first string guide 316A is mounted to the first bow limb 312A and is rotatable around a first axis 318A. The first string guide 316A includes a first draw string journal 320A and a first power cable take-up journal 322A, both of which are oriented generally perpendicular to the first axis 318A (See e.g., FIG. 8). The first power cable take-up journal 322A includes a width measured along the first axis 318A that is at least twice a width of power cable 324.

The second string guide 316B is mounted to the second bow limb 312A and rotatable around a second axis 318B. The second string guide 316B includes a second draw string journal 320B oriented generally perpendicular to the second axis 318B.

The draw string 314 is received in the first and second draw string journals 320A, 320B and is secured to the first string guide 316A at first attachment point 324. The draw string extends adjacent to the down-range side 306 to the second string guide 316B, wraps around the second string guide 316B, and is attached at the first axis 318A.

Power cable 324 is attached to the string guide 316A at attachment point 326. See FIG. 4. Opposite end of the power cable 324 is attached to the axis 318B. In the illustrated embodiment, power cable wraps 324 onto the first power cable take-up journal 322A and translates along the first power cable take-up journal 322A away from the first draw string journal 320A as the bow 300 is drawn from the released configuration 328 to the drawn configuration (see FIGS. 5-8).

Figure 12:
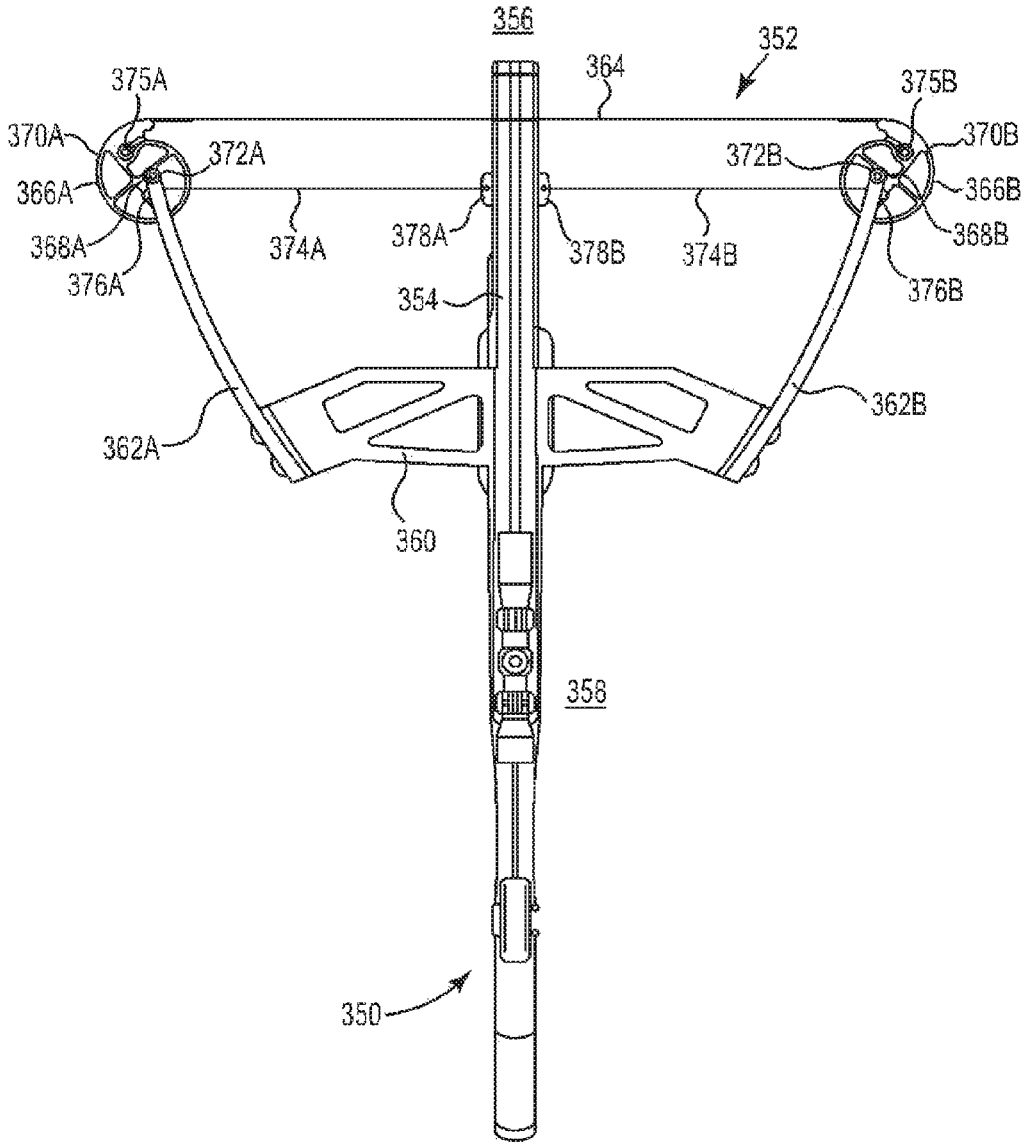
FIG. 12 is a schematic illustration of an alternate dual-cam bow with a string guide system in accordance with an embodiment of the present disclosure.

FIG. 12 is a schematic illustration of a dual-cam crossbow 350 with a reverse draw configuration 352 in accordance with an embodiment of the present disclosure. The crossbow 350 includes a center portion 354 with down-range side 356 and up-range side 358. First and second flexible limbs 362A, 362B ("362") are attached to riser 360 and extend from opposite sides of the center portion 354. Draw string 364 extends between first and second string guides 366A, 366B ("366"). In the illustrated embodiment, the string guides 366 are substantially as shown in FIGS. 4-8.

The string guides 366 are mounted to the bow limb 362 and are rotatable around first and second axis 368A, 368B ("368"), respectively. The string guides 366 include first and second draw string journals 370A, 370B ("370") and first and second power cable take-up journals 372A, 372B ("372"), both of which are oriented generally perpendicular to the axes 368, respectively. (See e.g., FIG. 8). The power cable take-up journals 372 include widths measured along the axes 368 that is at least twice a width of power cables 374A, 374B ("374").

The draw string 364 is received in the draw string journals 370 and is secured to the string guides 316 at first and second attachment points 375A, 375B ("325").

Power cables 374 are attached to the string guides 316 at attachment points 376A, 376B ("376"). See FIG. 4. Opposite ends 380A, 380B ("380") of the power cables 374 are attached to anchors 378A, 378B ("378") on the center portion 354. The power cables 374 preferably do not cross over the center support 354.

In the illustrated embodiment, power cables wrap 374 onto the power cable take-up journal 372 and translates along the power cable take-up journals 372 away from the draw string journals 370 as the bow 350 is drawn from the released configuration 378 to the drawn configuration (see FIGS. 5-8).

The string guides disclosed herein can be used with a variety of bows and crossbows, including those disclosed in commonly assigned U.S. patent application Ser. No. 13/799,518, entitled Energy Storage Device for a Bow, filed Mar. 13, 2013 and Ser. No. 14/071,723, entitled DeCocking Mechanism for a Bow, filed Nov. 5, 2013, both of which are hereby incorporated by reference.

Figure 13A:
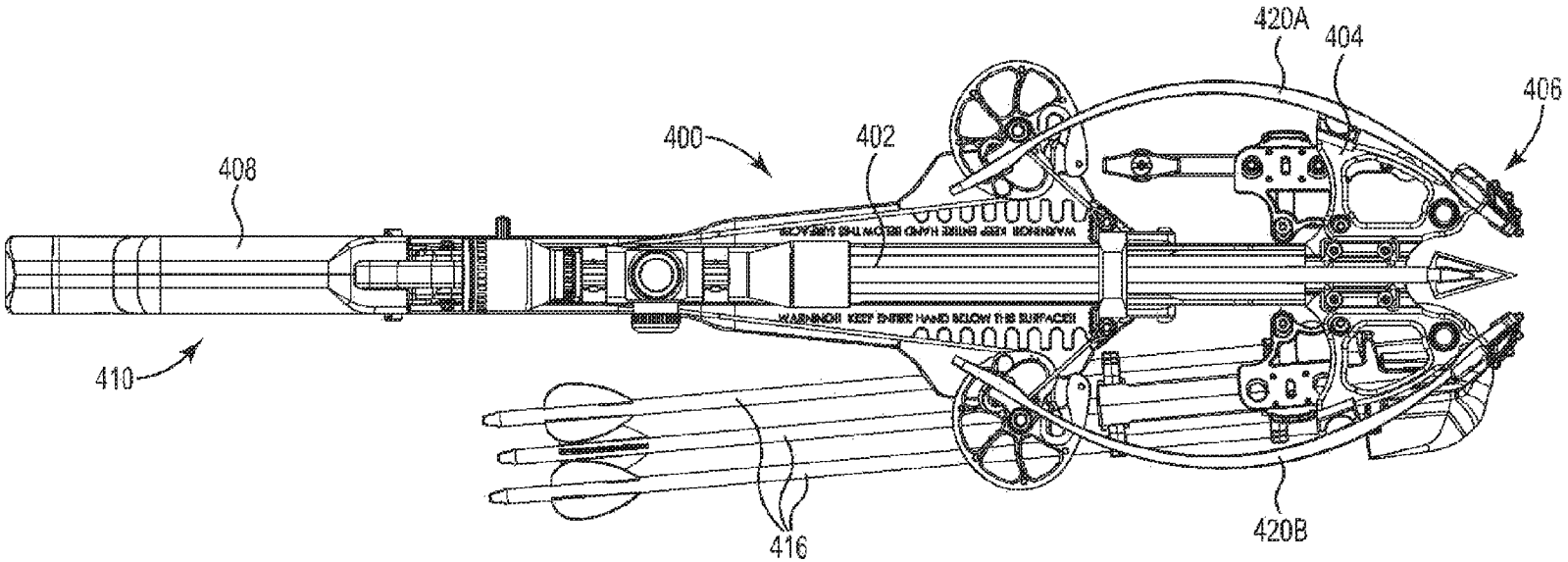
FIGS. 13A and 13B are top and side views of a crossbow with helical power cable journals in accordance with an embodiment of the present disclosure.
Figure 13B:
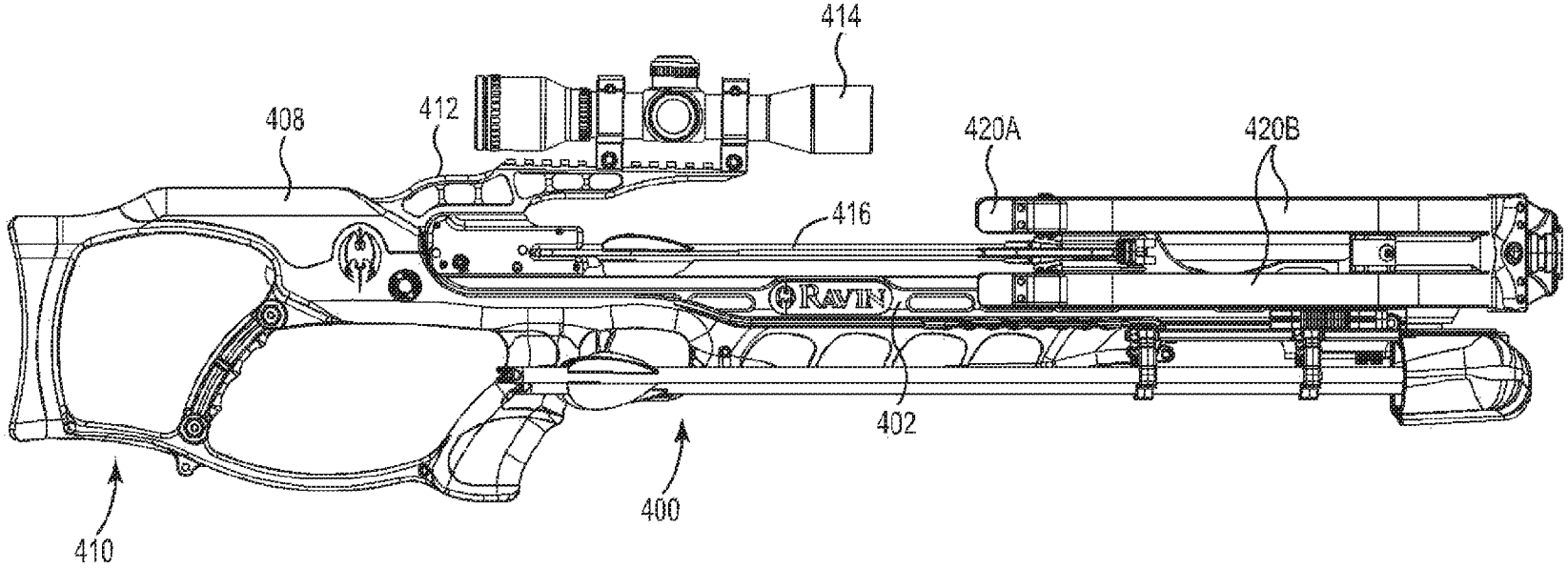

FIGS. 13A and 13B illustrate an alternate crossbow 400 in accordance with an embodiment of the present disclosure. The crossbow 400 includes a center rail 402 with a riser 404 mounted at the distal end 406 and a stock 408 located at the proximal end 410. The arrow 416 is suspended above the rail 402 before firing. In one embodiment, the central rail 402 and the riser 404 may be a unitary structure, such as, for example, a molded carbon fiber component. In the illustrated embodiment, the stock 408 includes a scope mount 412 with a tactical, picatinny, or weaver mounting rail. Scope 414 preferably includes a reticle with gradations corresponding to the ballistic drop of bolts 416 of particular weight. The riser 404 includes a pair of limbs 420A, 420B ("420") extending rearward toward the proximal end 410. In the illustrate embodiment, the limbs 420 have a generally concave shape directed toward the center rail 402. The terms "bolt" and "arrow" are both used for the projectiles launch by crossbows and are used interchangeable herein.

Figure 14A:
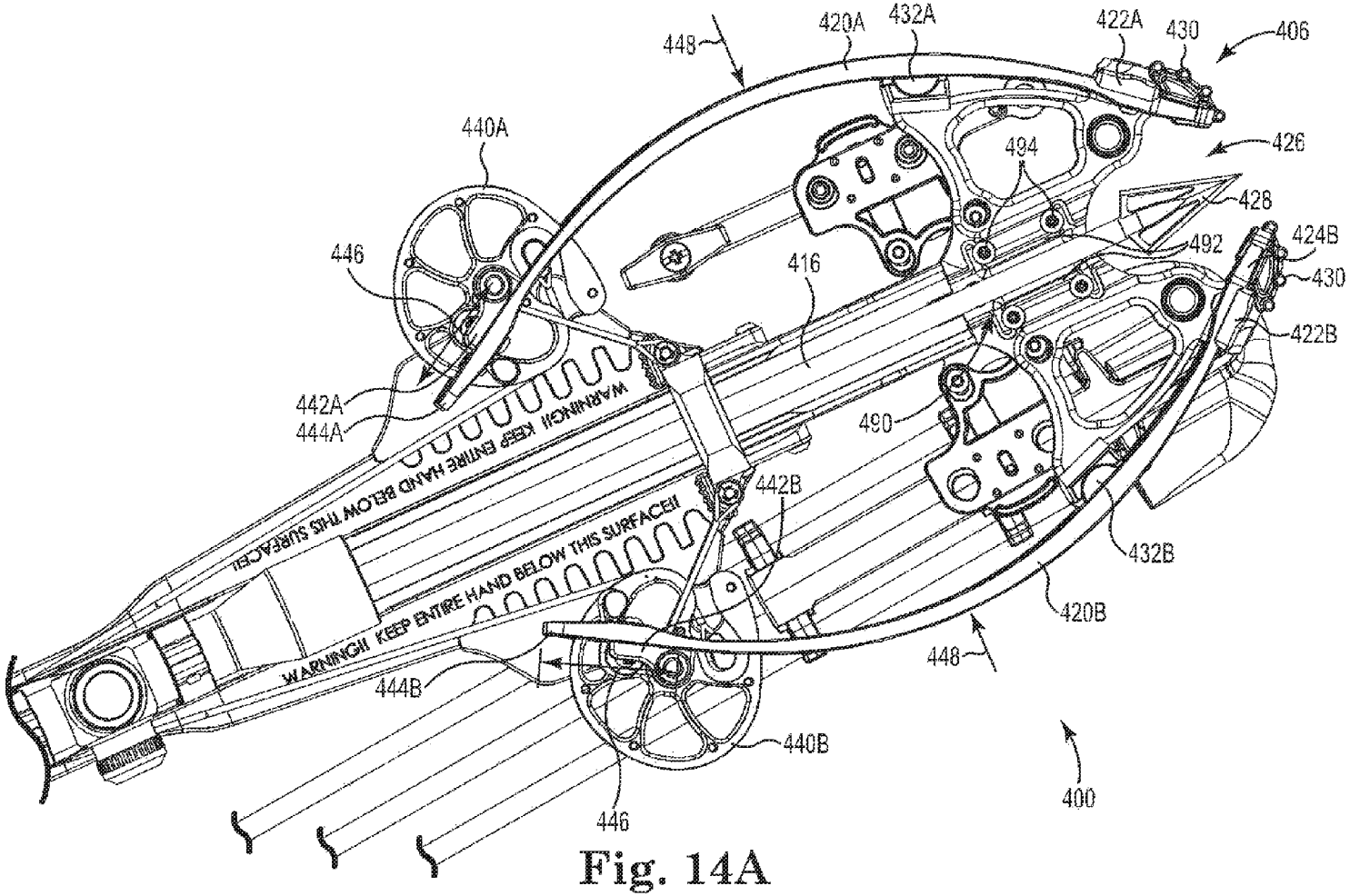
FIG. 14A is an enlarged top view of the crossbow of FIG. 13A.
Figure 14B:
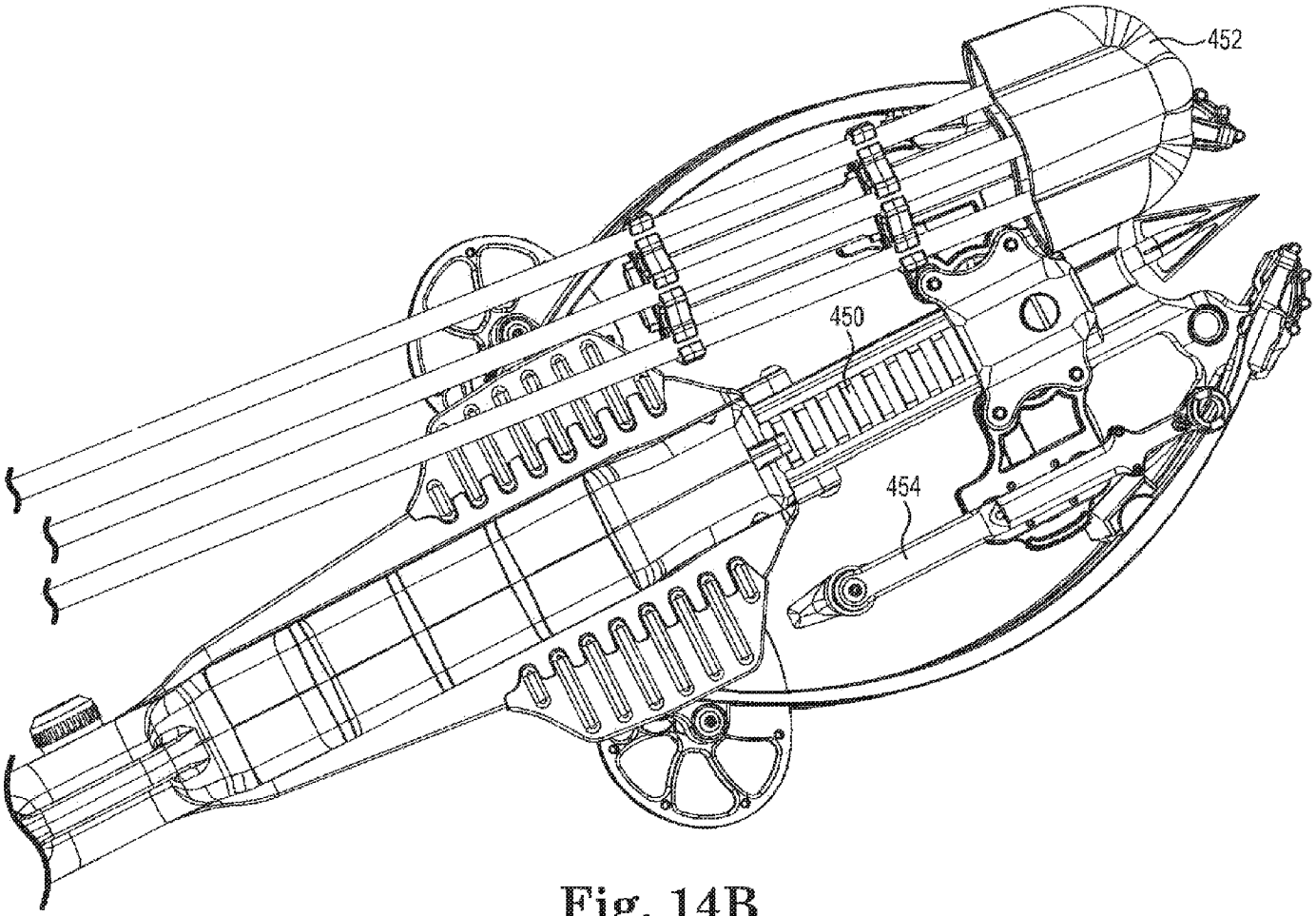
FIG. 14B is an enlarged bottom view of the crossbow of FIG. 13A.

FIGS. 14A and 14B are top and bottom views of the riser 404. Limbs 420 are attached to the riser 404 near the distal end 406 by mounting brackets 422A, 422B ("422"). In the illustrated embodiment, distal ends 424A, 424B ("424") of the limbs 420 extend past the mounting brackets 422 to create pocket 426 that contains arrowhead 428. Bumpers 430 are preferably attached to the distal ends 424 of the limbs 420. The tip of the arrowhead 428 is preferably completely contained within the pocket 426.

Pivots 432A, 432B ("432") attached to the riser 404 engage with the limbs 420 proximally from the mounting brackets 422. The pivots 432 provide a flexure point for the limbs 420 when the crossbow 400 is in the drawn configuration.

Cams 440A, 440B ("440") are attached to the limbs 420 by axle mounts 442A, 442B ("442"). In the illustrated embodiment, the axle mounts 442 are attached to the limbs 420 offset a distance 446 from the proximal ends 444A, 444B ("444") of the limbs 420. Due to their concave shape, greatest width 448 of the limbs 420 (in both the drawn configuration and the release configuration) preferably occurs at a location between the axle mounts 442 and the pivots 432, not at the proximal ends 444.

The offset 446 of the axle mounts 442 maximizes the speed of the limbs 420, minimizes limb vibration, and maximizes energy transfer to the bolts 416. In particular, the offset 446 is similar to hitting a baseball with a baseball bat at a location offset from the tip of the bat, commonly referred to as the "sweet spot". The size of the offset 446 is determined empirically for each type of limb. In the illustrated embodiment, the offset 446 is about 1.5 to about 4 inches, and more preferably about 2 to about 3 inches.

Figure 14C:
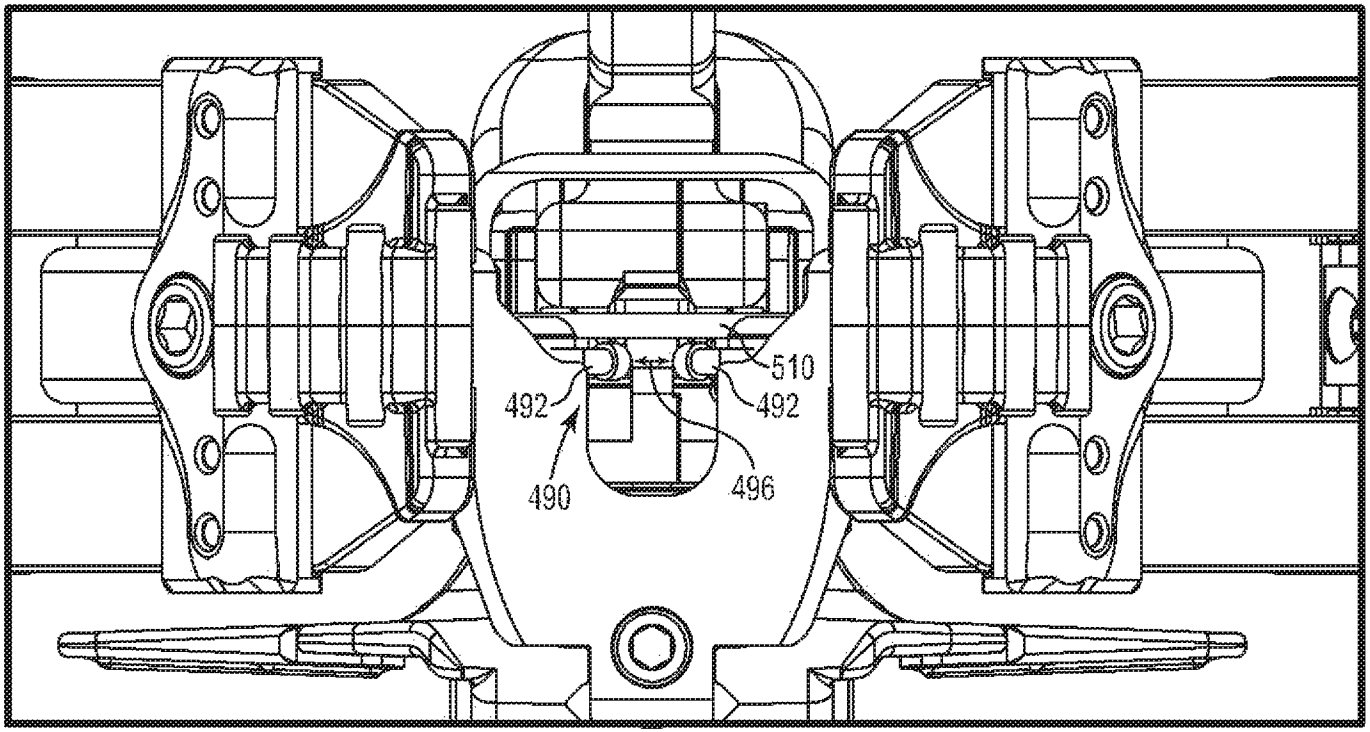
FIG. 14C illustrates an arrow rest in accordance with an embodiment of the present disclosure.

Tunable arrow rest 490 is positioned just behind the pocket 426. A pair of supports 492 are secured near opposite sides of the bolt 416 by fasteners 494. The supports 492 preferably slide in the plane of the limbs 420. As best illustrated in FIG. 14C, the separation 496 between the supports 492 can be adjusted to raise or lower front end of the bolt 416 relative to the draw string 501. In particular, by increasing the separation 496 between the supports 492 the curved profile of the front end of the bolt 416 is lowered relative to the string carrier 480 (see FIG. 17A). Alternatively, by decreasing the separation 496 the curved profile of the bolt 416 is raised.

FIG. 14B illustrates the bottom of the riser 404. Rail 450 on the riser 404 is used as the attachment point for accessories, such as quiver 452 for holding bolts 416 and cocking handle 454 that engages with pins 570 to rotate the driver shaft 564 (see FIG. 18A).

Figure 14D:
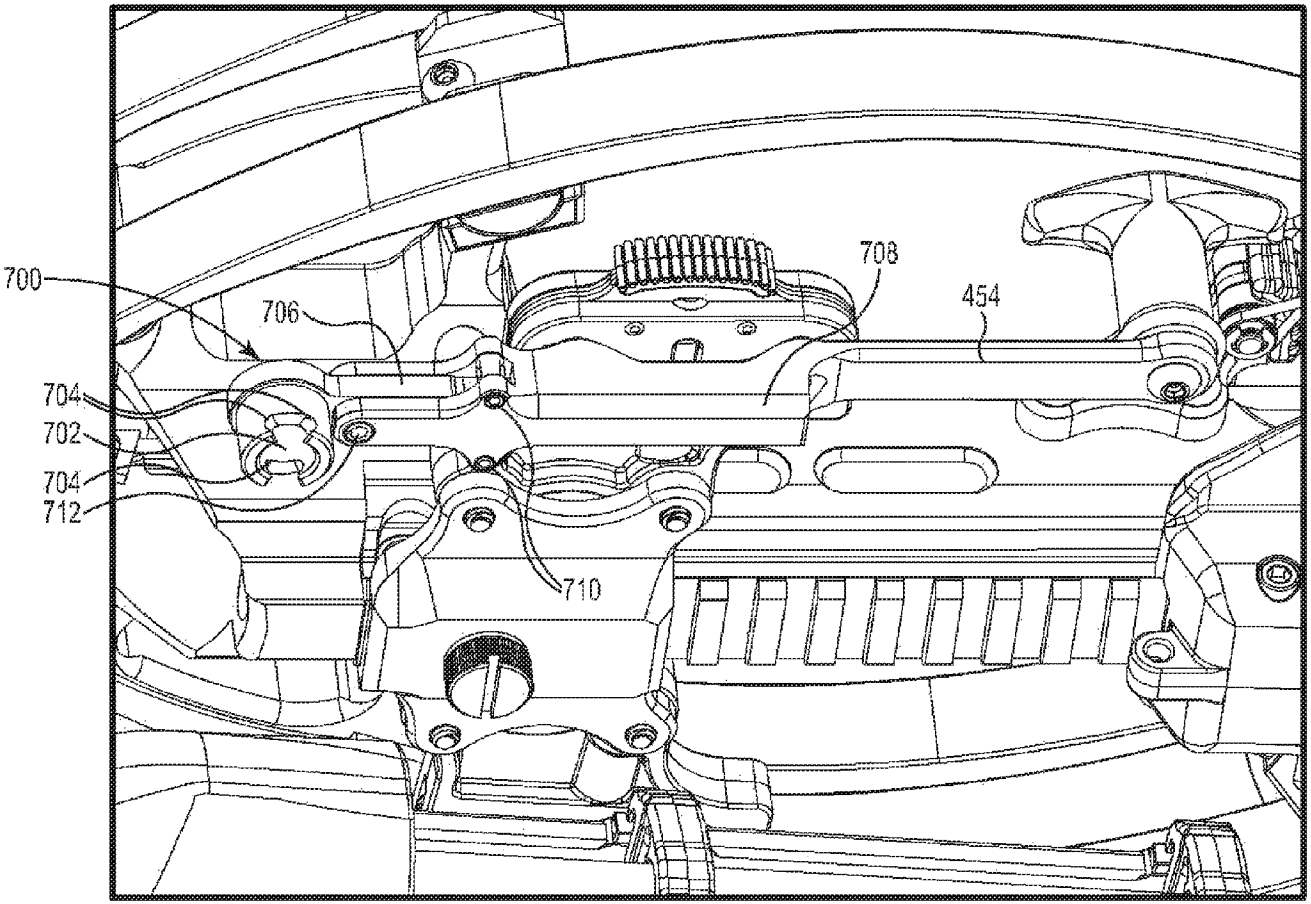
FIGS. 14D and 14E illustrate the cocking handle for the crossbow of FIG. 13A.

FIG. 14D illustrates the cocking handle 454 in greater detail. Distal end 700 is configured to engage with drive shaft 564 and pins 570 illustrated in FIG. 18A. Center recess 702 receives the drive shaft 564 and the undercuts 704 engage with the pins 570 when the system is under tension. Consequently, when cocking or uncocking the crossbow 400 the tension in the system locks the pins 570 into the undercuts 704. When tension in the system is removed, the cocking handle 454 can be rotated a few degrees and disengaged from the drive shaft 564.

Figure 14E:
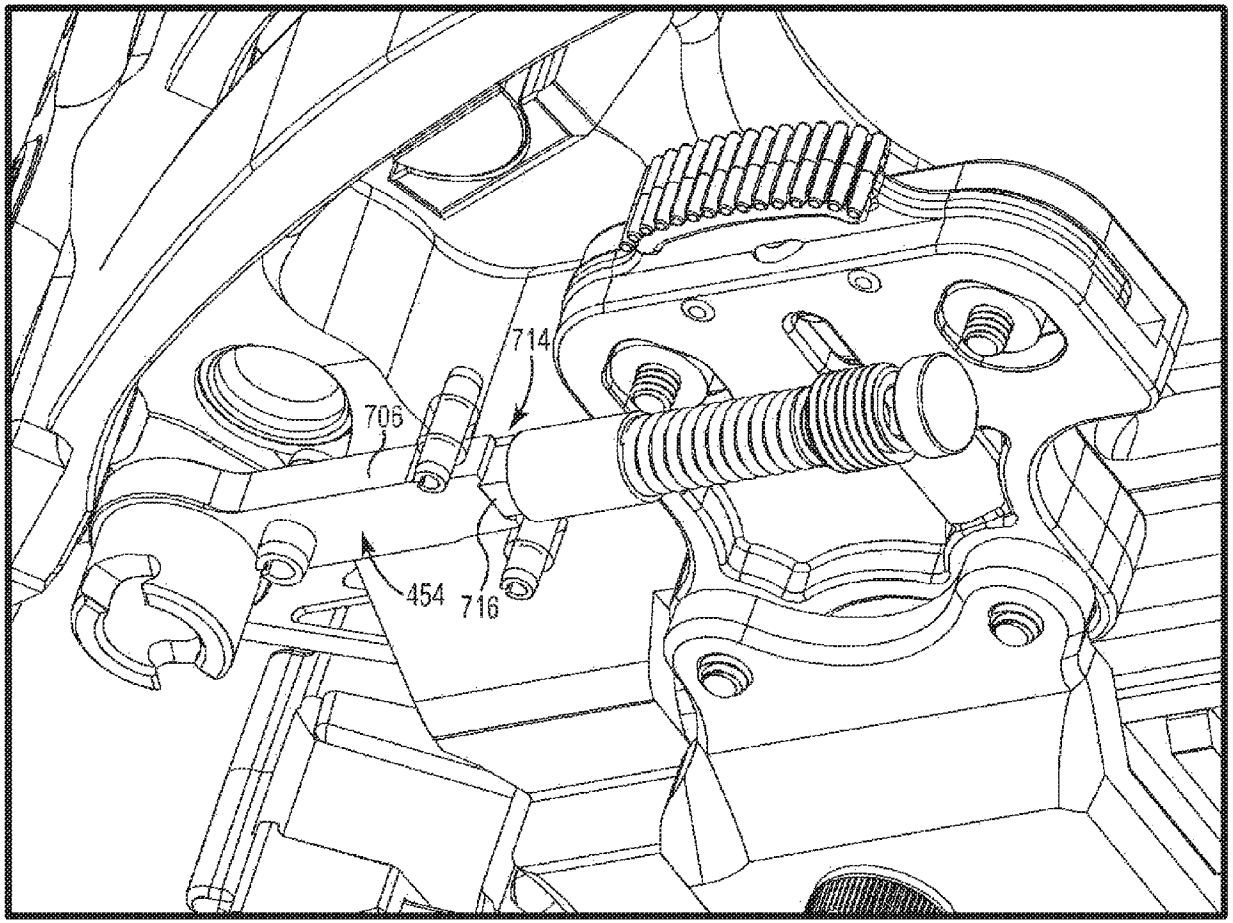

The distal end 700 includes stem 706 that extends into hollow handle 708. Pins 710 permit the stem 706 to rotate a few degrees around pin 712 in either direction within the hollow handle 708. As best illustrated in FIG. 14E, torque assembly 714 is located in hollow handle 708 that resists rotation of the stem 706 until a pre-set torque is reached. Once that torque threshold is exceeded, the stem 706 breaks free of block 716 and rotates within the hollow handle 708, generating an audible noise and snapping sensation that signal to the user that the crossbow 400 is fully cocked.

Figure 14F:
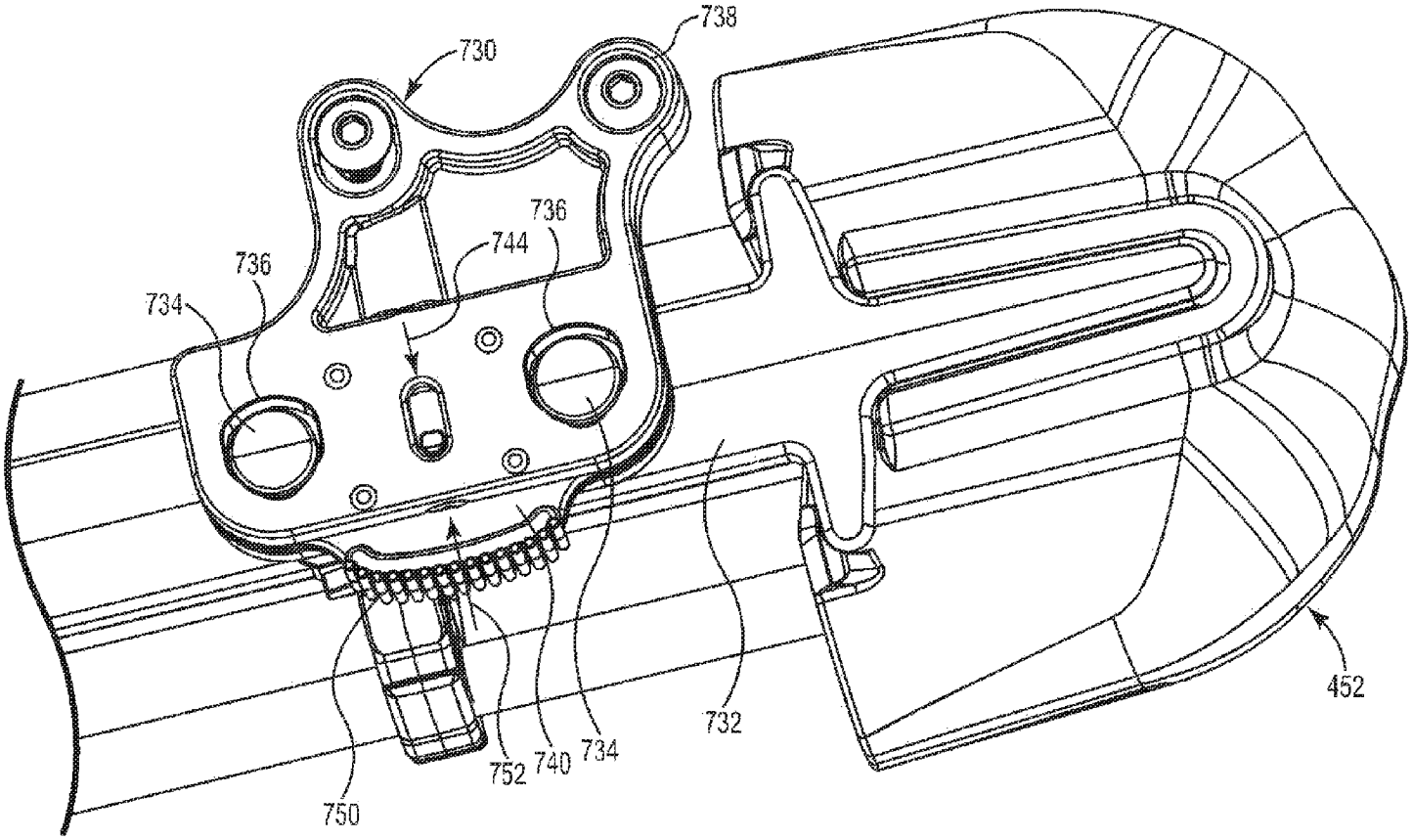
FIGS. 14F and 14G illustrate the quiver for the crossbow of FIG. 13A.
Figure 14G:
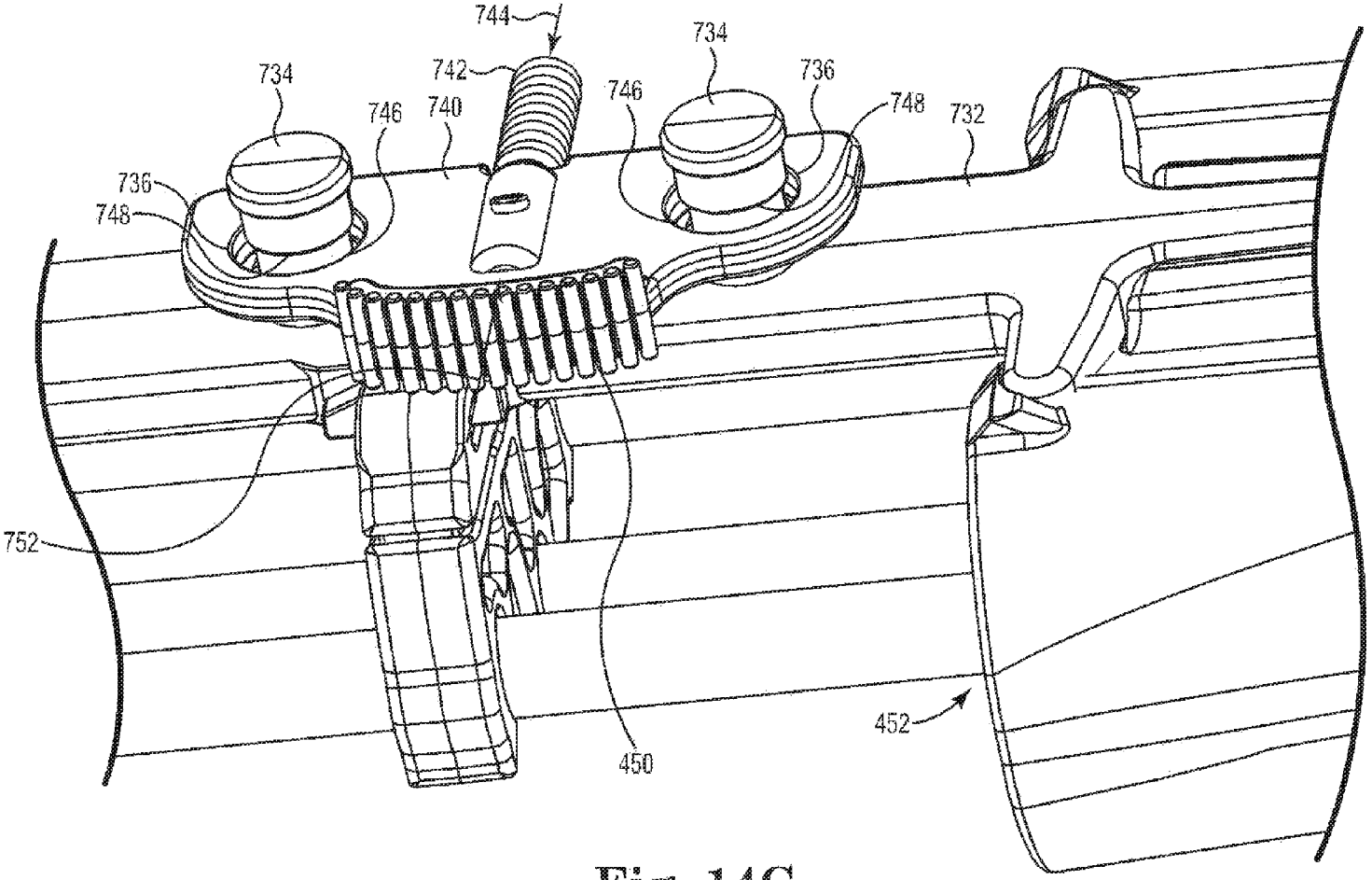

FIGS. 14F and 14G illustrate a mounting system 730 for the quiver 452 and the cocking handle 454. Quiver spine 732 includes a pair of mounting posts 734 spaced to engage with openings 736 in the mounting bracket 738. Magazine catch 740 (see FIG. 14G) slides within mounting bracket 738. Spring 742 biases the magazine catch 740 in direction 744. Openings 746 in the magazine catch 740 engage with undercuts 748 on the mounting posts 734 under pressure from the spring 742. To remove the quiver 452 the user presses the handle 750 in direction 752 until the openings 746 in the magazine catch 740 are aligned with the openings 736 in the mounting bracket 738. Once aligned, the mounting posts 734 can be removed from the mounting bracket 738.

Figure 15:
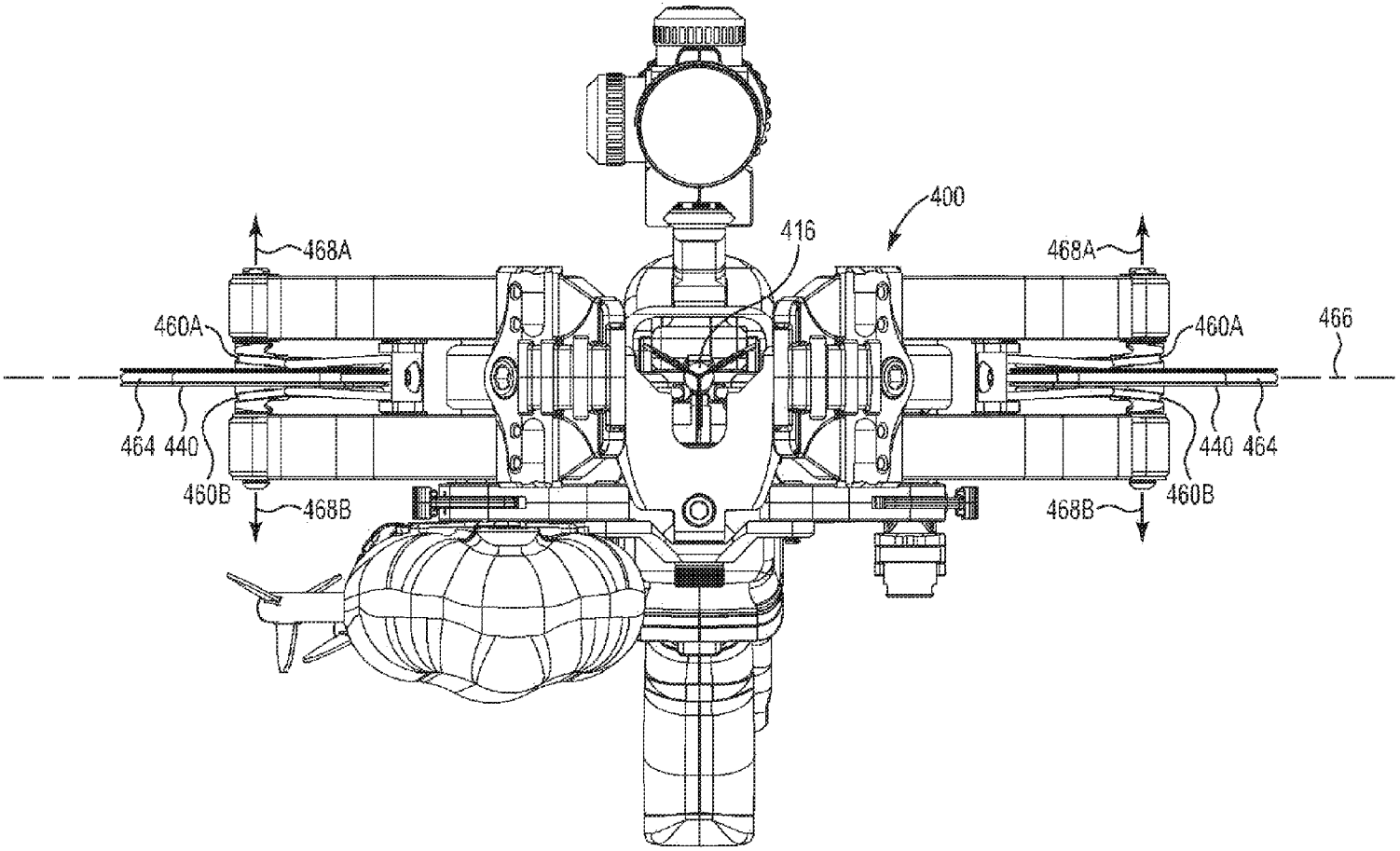
FIG. 15 is a front view of the crossbow of FIG. 13A.
Figure 21A:
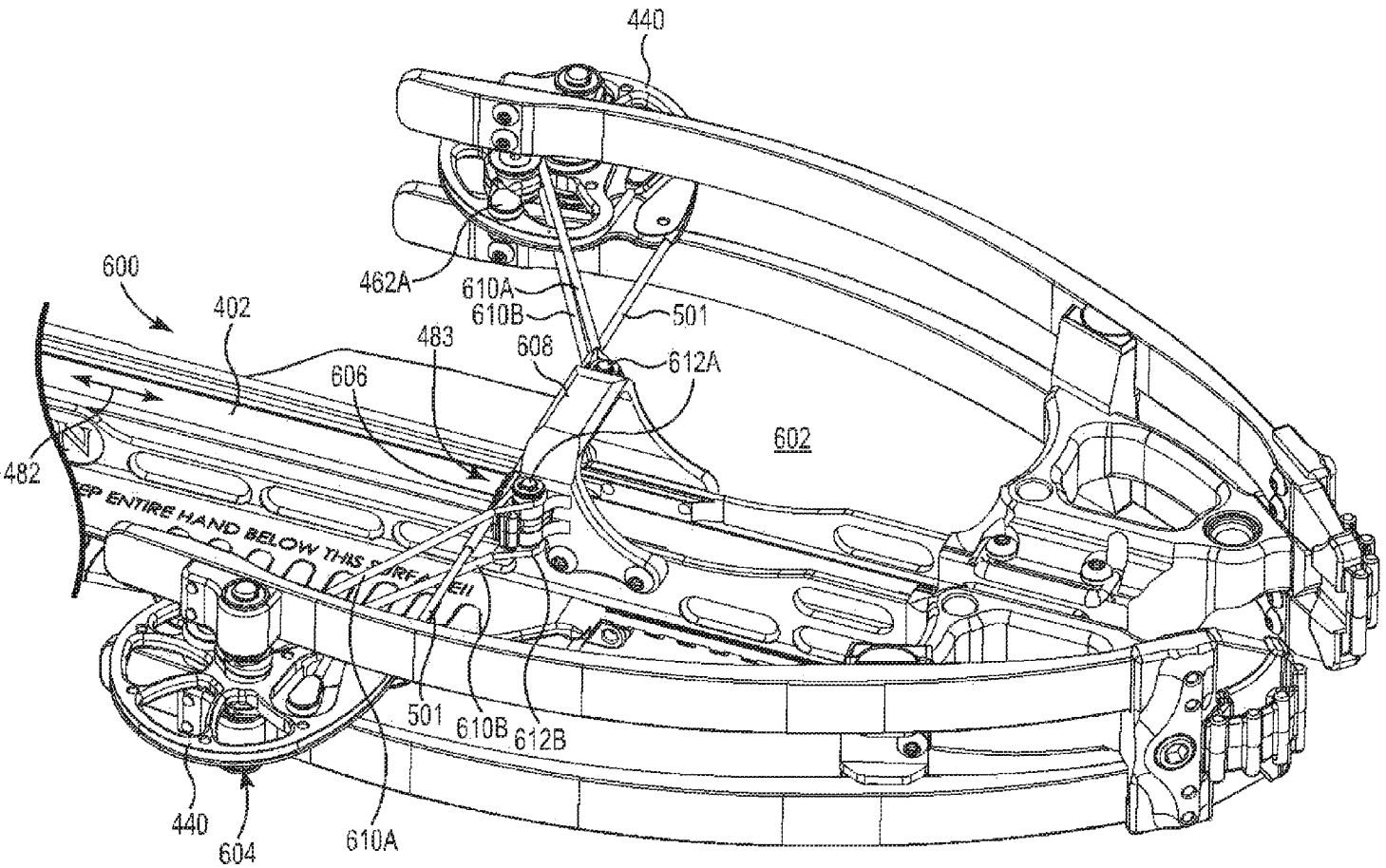
FIGS. 21A and 21B illustrate a crossbow in a release configuration in accordance with an embodiment of the present disclosure.

FIG. 15 is a front view of the crossbow 400 with the draw string or the power cables removed to better illustrate the cams 440 having upper and lower helical journals 460A, 460B above and below draw string journal 464. As illustrated in FIG. 21A, separate power cables 610A, 610B are operatively engaged with each of the helical journals 460A, 460B, and minimizing torque on the cams 440. The draw string journal 464 defines plane 466 that passes through the bolt 416. The helical journals 460A, 460B move the power cables 610A, 610B in directions 468A, 468B, respectively, away from the plane 466 as the bow 400 is drawn.

Figure 16A:
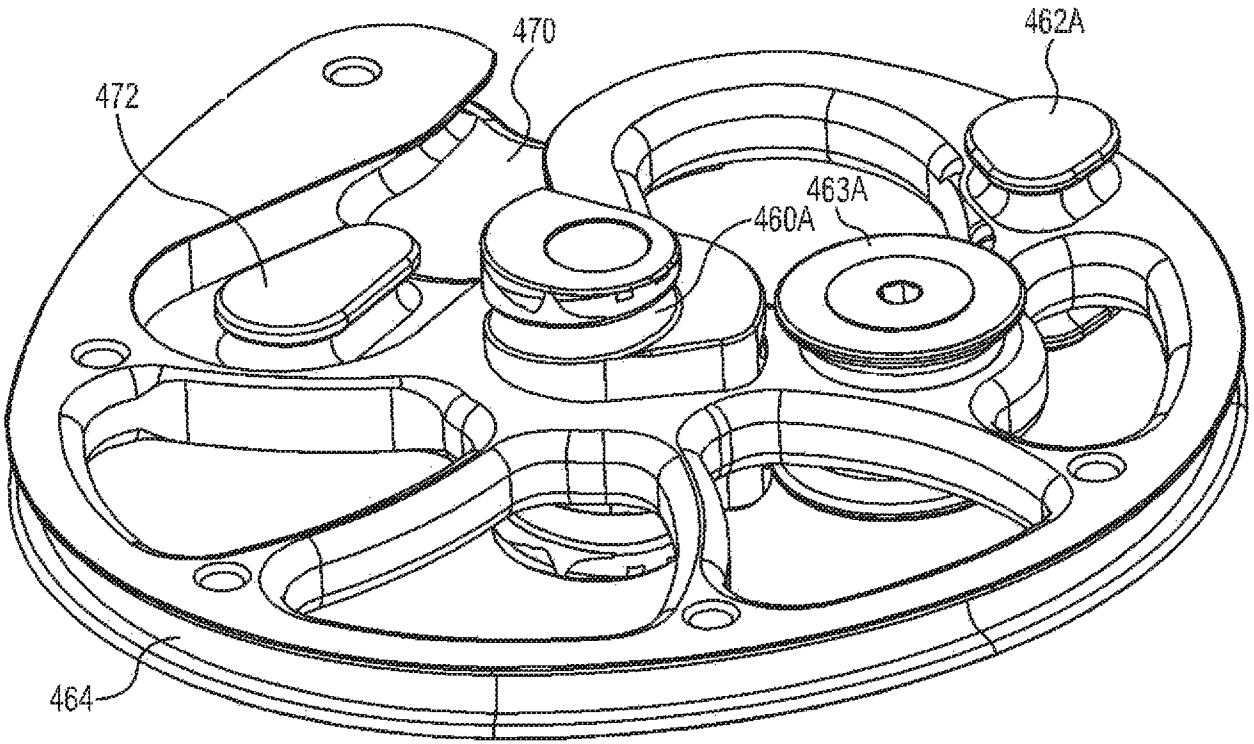
FIGS. 16A and 16B are top and bottom views of cams with helical power cable journals in accordance with an embodiment of the present disclosure.
Figure 16B:
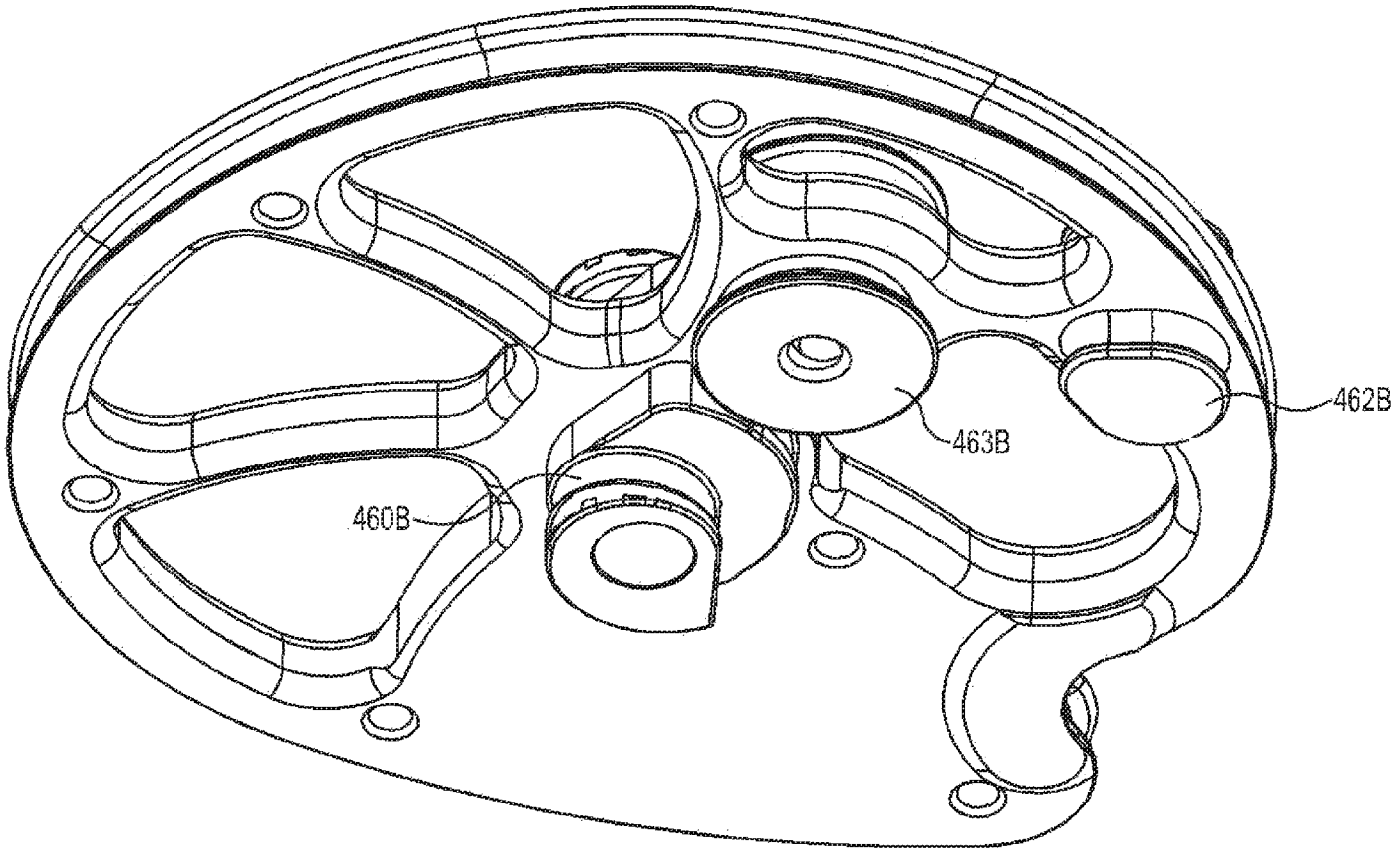

FIGS. 16A and 16B are upper and lower perspective views of the cams 440 with the power cables and draw string removed. Recess 470 contains draw string mount 472 located generally in the plane 466 of the draw string journal 464. Power cable attachment 462A and pivot post 463A correspond to helical journal 460A. As best illustrated in FIG. 16B, power cable attachment 462B and pivot post 463B corresponds to the helical journal 460B. The pivot pots 463 serve to take-up a portion of the power cables 610 and redirect the power cables 610 onto the helical journals 460.

FIGS. 17A through 17D illustrate string carrier 480 for the crossbow 400 in accordance with an embodiment of the present disclosure. As best illustrated in FIG. 21A, the string carrier 480 slides along axis 482 of the center rail 402 to the location 483 (see FIG. 21A) to capture the draw string 501. After the string carrier 480 captures the draw string 501, the cocking mechanism 484 (see FIGS. 18A and 18B) is used to return the string carrier 480 back to the position illustrated in FIGS. 17A and 17B at the proximal end 410 of the crossbow 400 and into engagement with trigger 558.

The string carrier 480 includes fingers 500 on catch 502 that engage the draw string 501. The catch 502 is illustrated in a closed position 504. After firing the crossbow the catch 502 is retained in open position (see FIG. 18B), such as for example, by spring 510. In the illustrated embodiment, the catch biasing force is applied to the catch 502 by spring 510 to rotate in direction 506 around pin 508 and retains the catch 502 in the open position 505. Absent an external force, the catch 502 automatically move to open position 505 (see FIG. 18B) and releases the draw string 501.

Figure 17A:
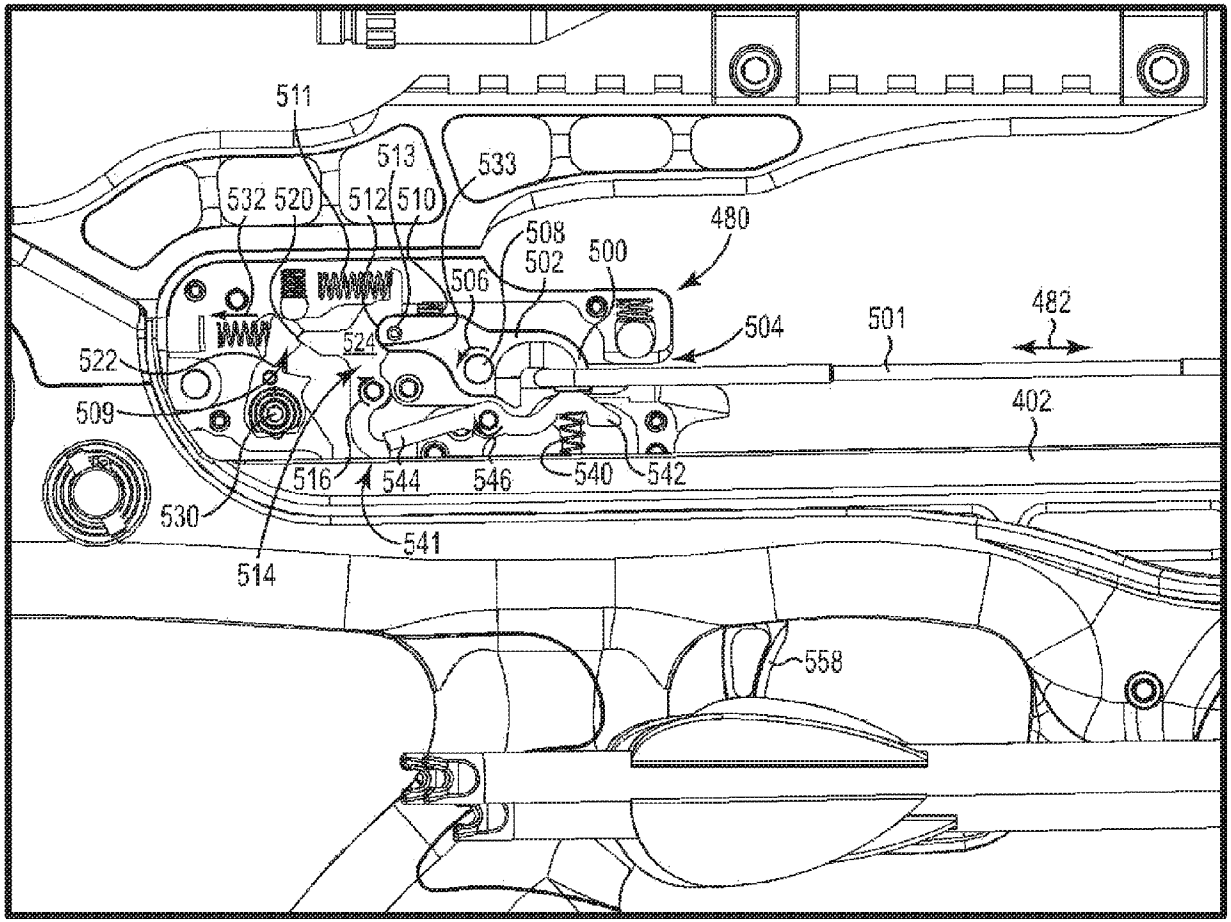
FIGS. 17A and 17B are opposite side view of a trigger assembly in accordance with an embodiment of the present disclosure.
Figure 17B:
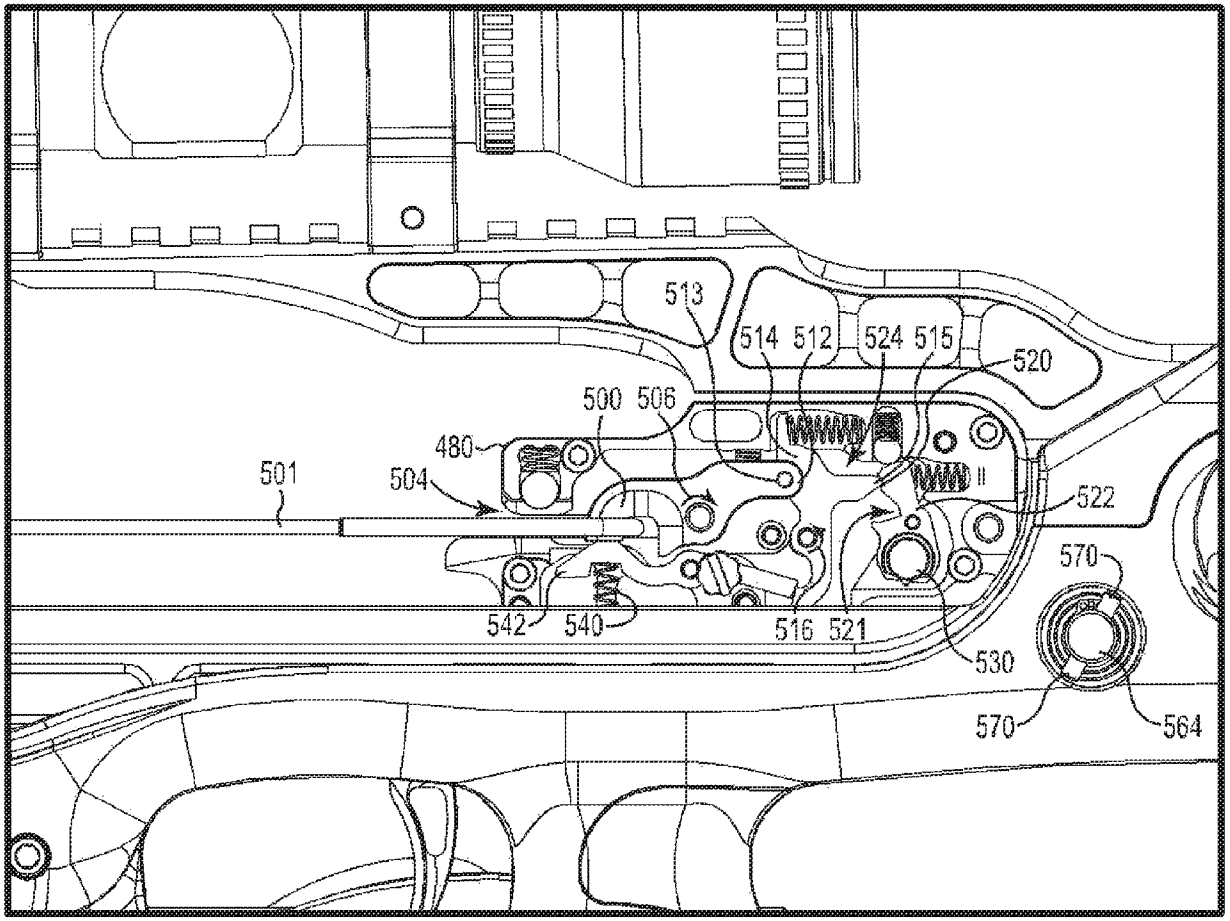
Figure 18A:
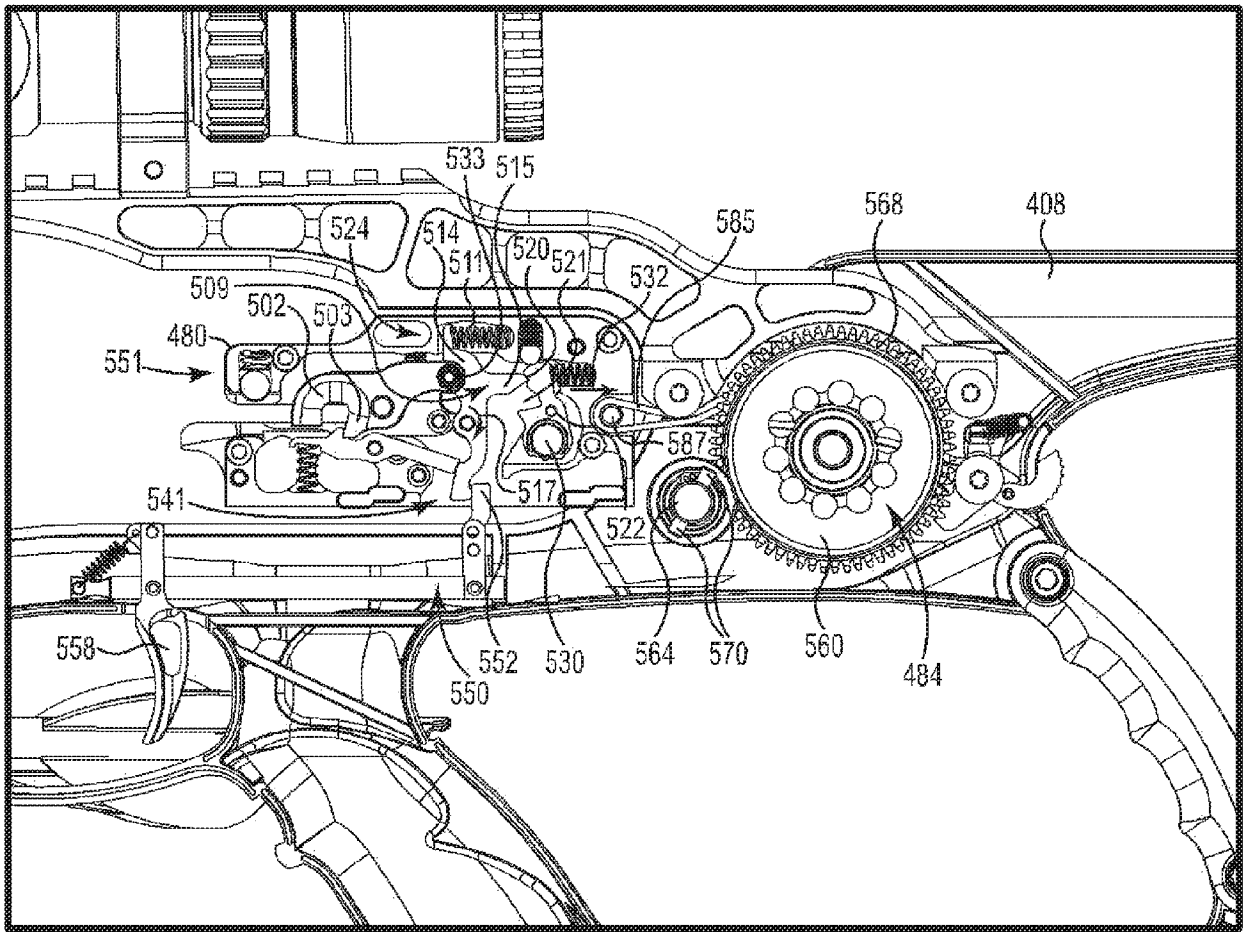
FIGS. 18A and 18B illustrate operation of the trigger mechanism in accordance with an embodiment of the present disclosure.

In the closed position 504 illustrated in FIGS. 17A, 17B, 18A, recess 512 on sear 514 engages low friction device 513 at rear edge of the catch 502 at interface 533 to retain the catch 502 in the closed position 504. The sear 514 is biased in direction 516 by a sear biasing force applied by spring 511 to engage with and retain the catch 502 in the closed position 504.

Figure 17C:
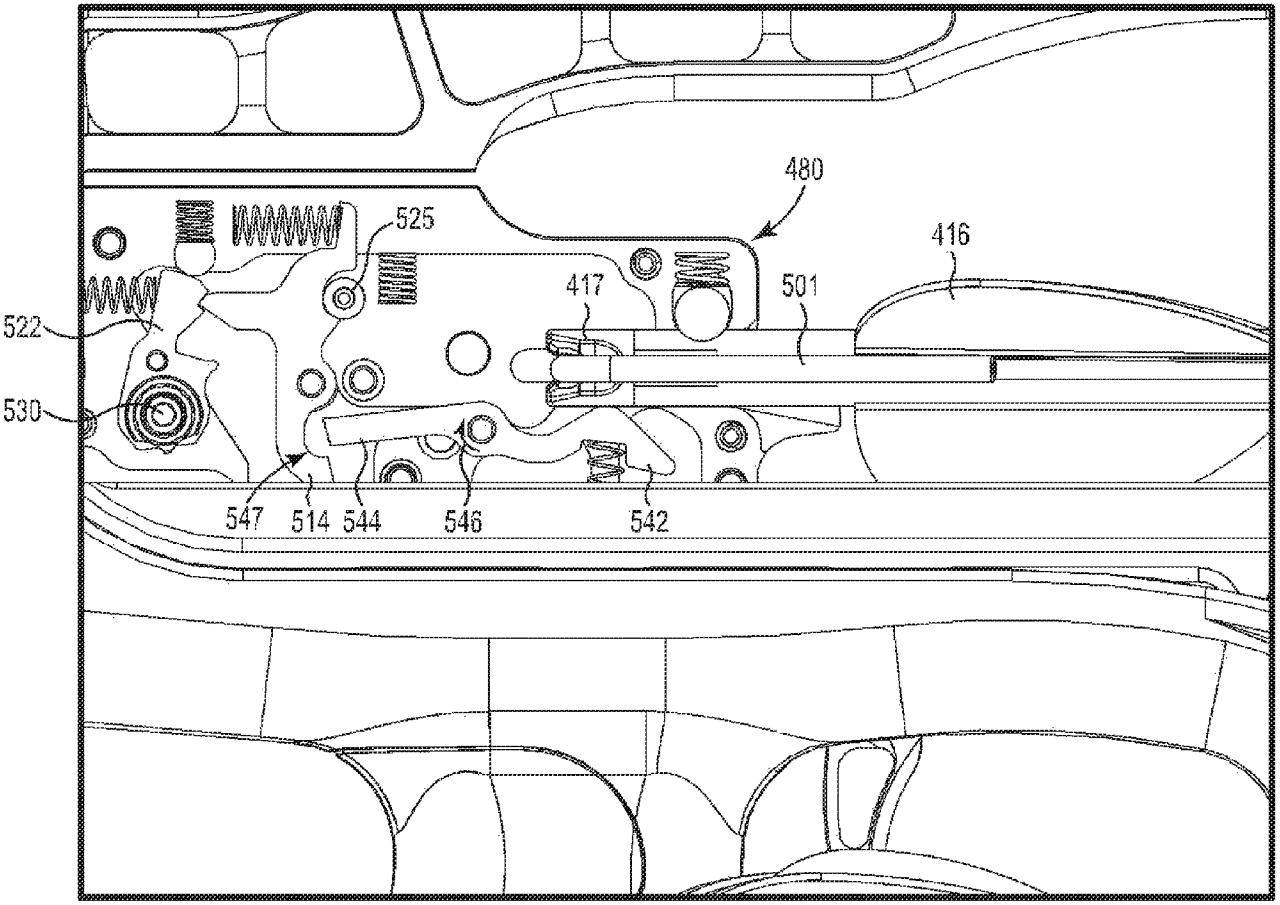
FIG. 17C is a side view of the trigger of FIG. 17A with a bolt engaged with the draw string in accordance with an embodiment of the present disclosure.
Figure 17D:
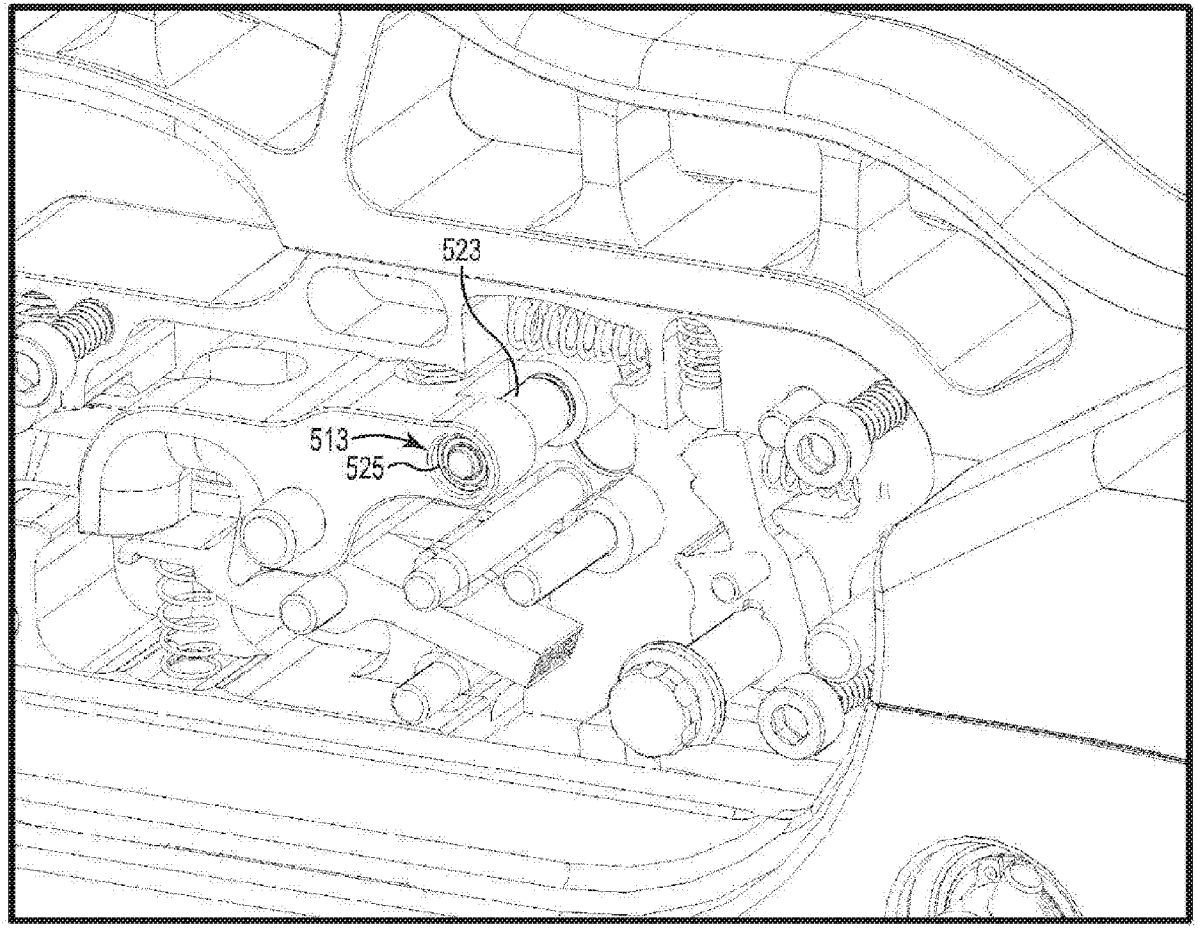
FIG. 17D is a perspective view of a low friction interface at a rear edge of a string catch in accordance with an embodiment of the present disclosure.

FIG. 17D illustrates the string carrier 480 with the sear 514 removed for clarity. In the illustrated embodiment, the low friction device 513 is a roller pin 523 mounted in rear portion of the catch 520. In one embodiment, the roller pin 523 has a diameter corresponding generally to the diameter of the recess 512. The roller pin 523 is preferably supported by ball bearings 525 to reduce friction between the catch 502 and the recess 512 when firing the crossbow 400. A force necessary to overcome the friction at the interface 533 to release the catch 502 is preferably less than about 1 pound, substantially reducing the trigger pull weight. In an alternate embodiment, the positions of the roller pin 523 and the ball bearings 525 can be reversed so that the sear 514 engages directly on the ball bearings 525.

In one embodiment, a force necessary to overcome the friction at the interface 533 to release the catch 502 is preferably less than the biasing force applied to the sear 514 by the spring 511. This feature causes the sear 514 to return fully to the cocked position 524 in the event the trigger 558 is partially depressed, but then released before the catch 502 releases the draw string 501.

In another embodiment, a force necessary to overcome the friction at the interface 533 to release the catch 502 is preferably less than about 3.2%, and more preferably less than about 1.6% of the draw force to retain the draw string 501 to the drawn configuration. The draw force can optionally be measured as the force on the flexible tension member 585 when the string carrier 480 is in the drawn position (See FIG. 18A).

Turning back to FIGS. 17A and 17B, when in safe position 509 shoulder 520 on safety 522 retains the sear 514 in a cocked position 524 and the catch 502 in the closed position 504. Safety button 530 is used to move the safety 522 in direction 532 from the safe position 509 illustrated in FIGS. 17A and 17B to free position 553 (see FIG. 18B) with the shoulder 520 disengaged from the sear 514.

A dry fire lockout biasing force is applied by spring 540 to bias dry fire lockout 542 toward the catch 502. Distal end 544 of the dry fire lockout 542 engages the sear 514 in a lockout position 541 to prevent the sear 514 from releasing the catch 502. Even if the safety 522 is disengaged from the sear 514, the distal end 544 of the dry fire lockout 542 retains the sear 514 in the cocked position 524 to prevent the catch 502 from releasing the draw string 501.

FIG. 17C illustrates the string carrier 480 with the catch 502 removed for clarity. Nock 417 of the bolt 416 is engaged with the dry fire lockout 542 and rotated it in the direction 546. Distal end 544 of the dry fire lockout 542 is now in disengaged position 547 relative to the sear 514. Once the safety 522 is removed from the safe position 509 using the safety button 530, the crossbow 400 can be fired. In the illustrated embodiment, the nock 417 is a clip-on version that flexes to form a snap-fit engagement with the draw string 501. Only when a bolt 416 is fully engaged with the draw string 501 will the dry fire lockout 542 be in the disengaged position 547 that permits the sear 514 to release the catch 502.

Figure 18B:
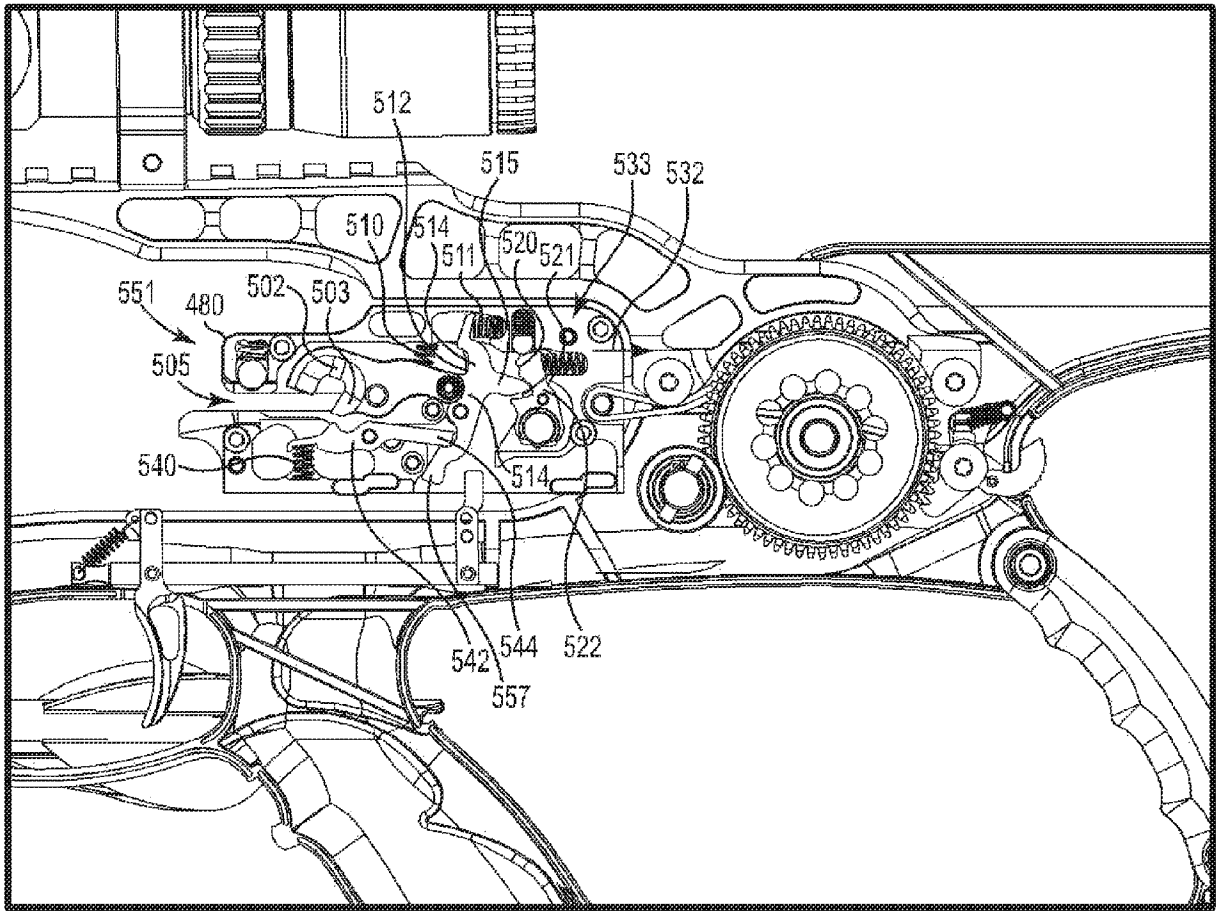

FIGS. 18A and 18B illustrate the relationship between the string carrier 480, the cocking mechanism 484, and the trigger assembly 550 that form string control assembly 551. The trigger assembly 550 is mounted in the stock 408, separate from the string carrier 480. Only when the string carrier 480 is fully retracted into the stock 408 is the trigger pawl 552 positioned adjacent to the sear 514. When the user is ready to fire the crossbow 400, the safety button 530 is moved in direction 532 to a free position 553 where the extension 515 is disengaged from the shoulder 520. When the trigger 558 is depressed the sear 514 rotating in direction 517 to a de-cocked position 557 and the catch 502 moves to the open position 505 to release the draw string 501.

As best illustrate in FIG. 18B, after firing the crossbow the sear 514 is in a de-cocked position 557 and the safety 522 is in the free position 553. The catch 502 retains the sear 514 in the de-cocked position 557 even though the spring 511 biases it toward the cocked position 524. In the de-cocked position 557 the sear 514 retains the dry fire lockout 542 in the disengaged position 547 even though the spring 540 biases it toward the lockout position 541. The extension 515 on the sear 514 is located in recess 521 on the safety 522.

To cock the crossbow 400 again the string carrier 480 is moved forward to location 483 (see FIG. 21A) into engagement with the draw string 501. Lower edge 503 of the catch 502 engages the draw string 501 and overcomes the force of spring 510 to automatically push the catch 502 to the closed position 504 (See FIG. 18A). Spring 511 automatically rotates the sear 514 back into the cocked position 524 so recess 512 formed interface 533 with the catch 502. Rotation of the sear 514 causes the extension 515 to slide along the surface of the recess 521 until it engages with the shoulder 520 on the safety 522 in the safe position 509. With the sear 514 back in the cocked position 524 (See FIG. 18A), the spring 540 biases dry fire lockout 542 to the lockout position 541 so the distal end 544 engages the sear 514 to prevent the catch 502 from releasing the draw string 501 (See FIG. 18A) until an arrow is inserted into the string carrier 480. Consequently, when the string carrier 480 is pushed into engagement with the draw string 501, the draw string 501 pushes the catch 502 from the open position 505 to the closed position 504 to automatically (i) couple the sear 514 with the catch 502 at the interface 533 to retain the catch 502 in the closed position 504, (ii) move the safety 522 to the safe position 509 coupled with the sear 514 to retain the sear 514 in the cocked position 524, and (iii) move the dry fire lockout 542 to the lockout position 541 to block the sear 514 from moving to the de-cocked position 557.

Figure 19:
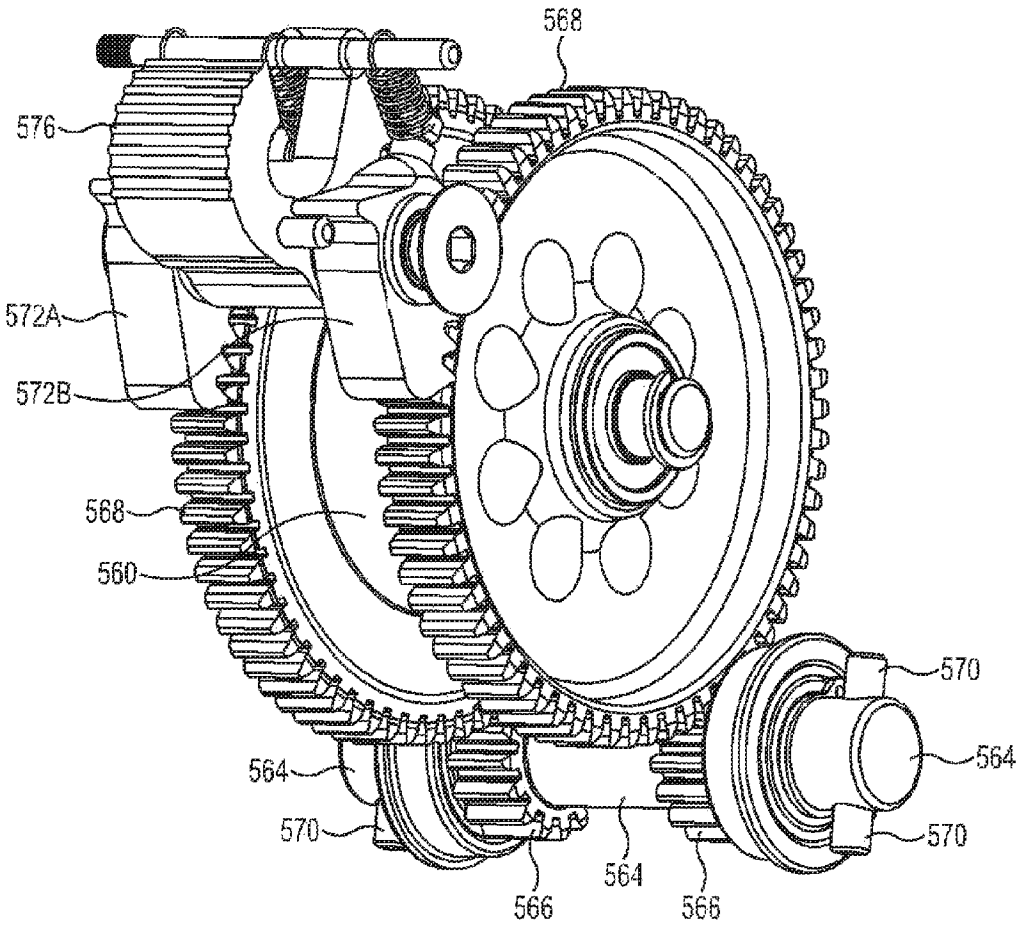
FIGS. 19 and 20 illustrate a cocking mechanism for a crossbow in accordance with an embodiment of the present disclosure.
Figure 20:
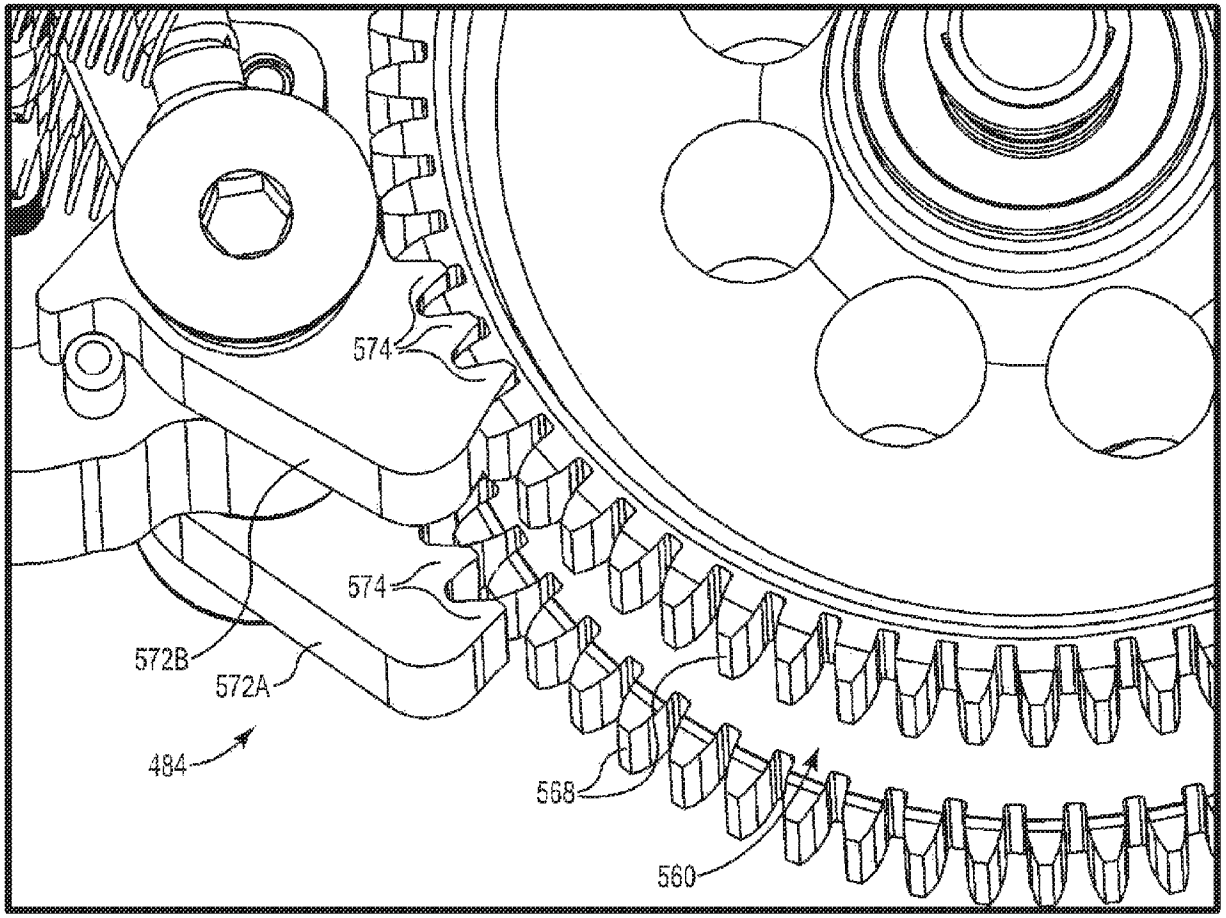

The cocking mechanism 484 includes a spool 560 with a flexible tension member, such as for example, a belt, a tape or webbing material 585, attached to pin 587 on the string carrier 480. As best illustrated in FIGS. 19 and 20, the cocking mechanism 484 includes drive shaft 564 with a pair of drive gears 566 meshed with gear teeth 568 on opposite sides of the spool 560. Consequently, the spool 560 is subject to equalize torque applied to the spool 560 during the cocking operation. Cocking handle 454 releasably attaches to either of exposed ends of pin 570 of the driver shaft 564.

A pair of pawls 572A, 572B ("572") include teeth 574 (see FIG. 20) that are biased into engage with the gear teeth 568. The pawls 572 are preferably offset ½ the gear tooth 568 spacing so that when the teeth 574 of one pawl 572 are disengaged from the gear teeth 568, the teeth 574 on the other pawl 572 are positioned to engage the gear teeth 568. Consequently, during winding of the spool 560, the teeth 574 on one of the pawls 572 are always positioned to engage with the gear teeth 568 on the spool. If the user inadvertently released the cocking handle 454 when the crossbow 400 is under tension, one of the pawls 572 is always in position to arrest rotation of the spool 560.

In operation, the user presses the release 576 to disengage the pawls 572 from the spool 560 and proceeds to rotate the cocking handle 454 to move the string carrier 480 in either direction 482 along the rail 402 to cock or de-cocking the crossbow 400. Alternatively, the crossbow 400 can be cocked without depressing the release 576, but the pawls 572 will make a clicking sound as they advance over the gear teeth 568.

Figure 21B:
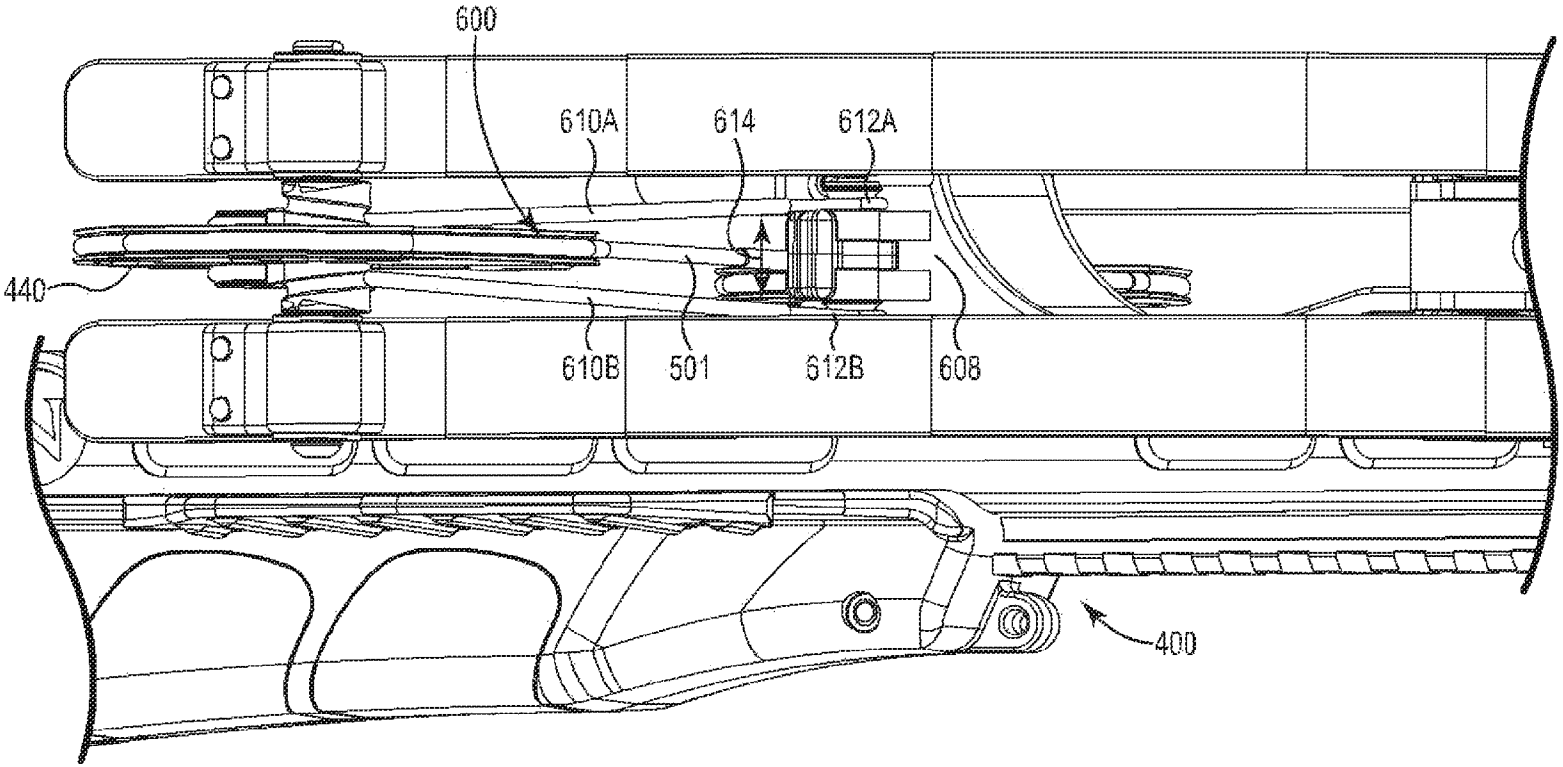

FIGS. 21A and 21B illustrate the crossbow 400 in the released configuration 600. Draw string 501 is located adjacent down-range side 602 of the cams 440 in a reverse draw configuration 604. In the illustrated embodiment of the released configuration 600 the draw string 501 is adjacent stops 606 attached to power cable bracket 608.

Figure 22A:
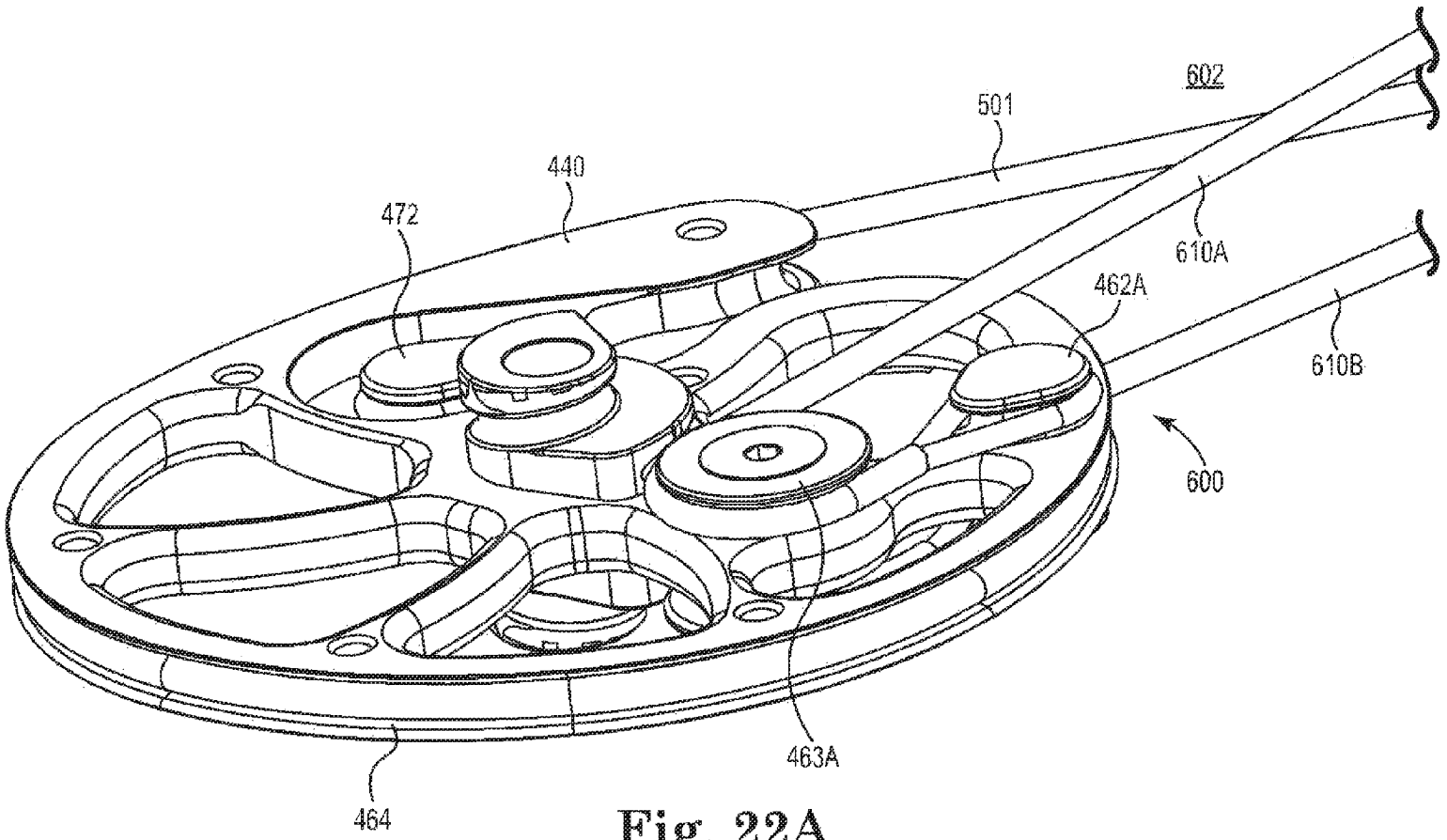
FIGS. 22A and 22B illustrate the cams of the crossbow of FIGS. 21A and 21B in the release configuration.

Upper power cables 610A are attached to the power cable bracket 608 at upper attachment points 612A and to power cable attachments 462A on the cams 440 (see also FIG. 22A). Lower power cables 610B are attached to the power cable bracket 608 at lower attachment points 612B and to the power cable attachments 462B on the cams 440 (see also FIG. 22B).

In the illustrated embodiment, the attachment points 612A, 612B for the respective power cables 610 are located on opposite sides of the center rail 402. Consequently, the power cables 610 do not cross over the center rail 402. As used herein, "without crossover" refers to a cabling system in which power cables do not pass through a vertical plane bisecting the center rail 402.

As best illustrated in FIG. 21B, the upper and lower attachment points 612A, 612B on the power cable bracket 608 maintains gap 614 between the upper and lower power cables 610A, 610B greater than the gap at the axes of the cams 440. Consequently, the power cables 610A, 610B angle toward each other near the cams 440.

Figure 22B:
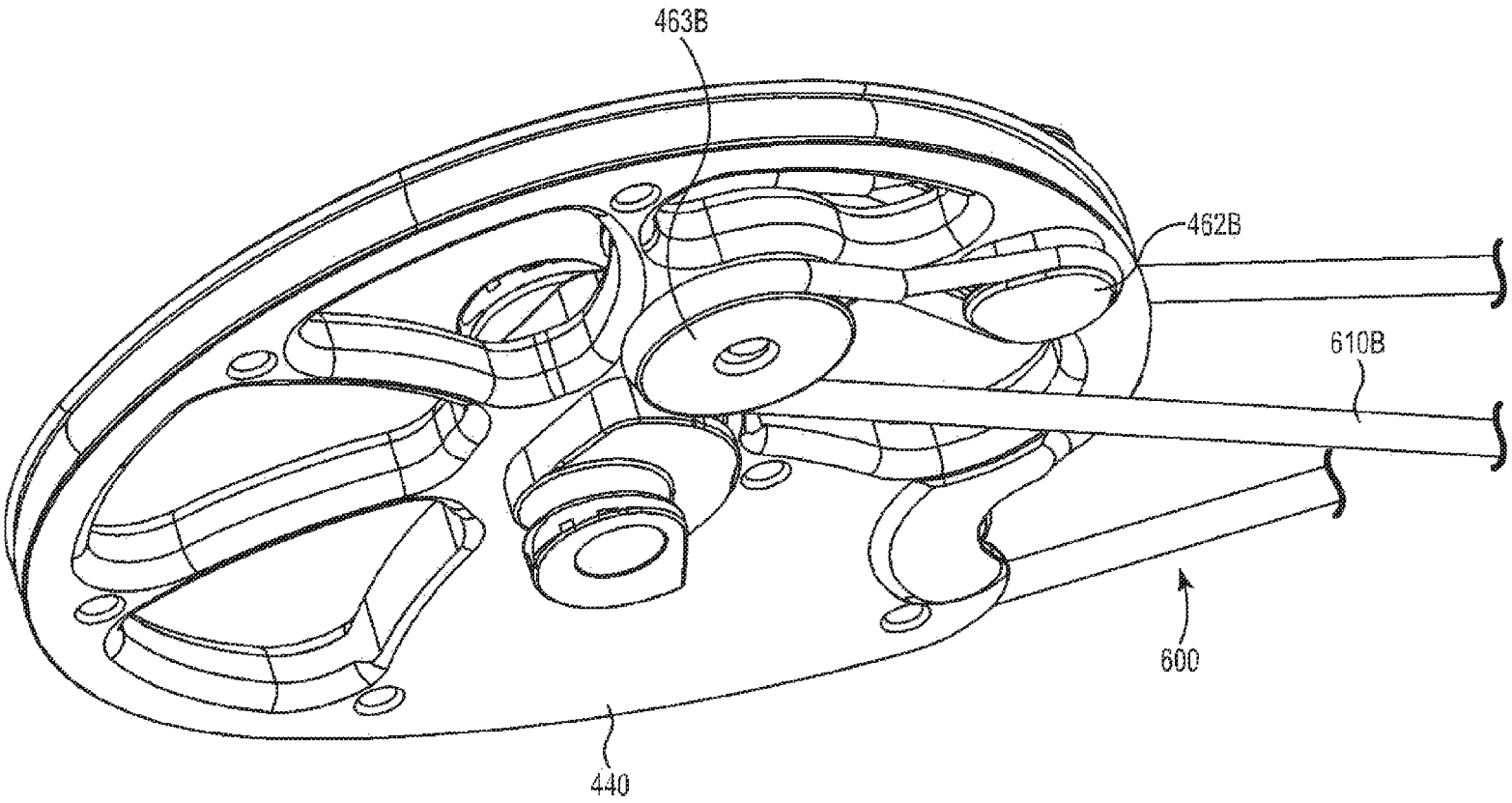

FIGS. 22A and 22B are upper and lower perspective views of the cams 440 with the cables 510, 610A, and 610B in the released configuration 600. The cams 440 are preferably symmetrical so only one of the cams 440 is illustrated. Upper power cables 610A are attached to power cable attachments 462A, wrap around the upper pivots 463A and then return toward the bow 400 to attach to the power cable bracket 608 (see FIG. 21A). The draw cable 501 is attached to the draw string mount 472 and then wraps almost completely around the cam 440 in the draw string journal 464 to the down range side 602.

Figure 23A:
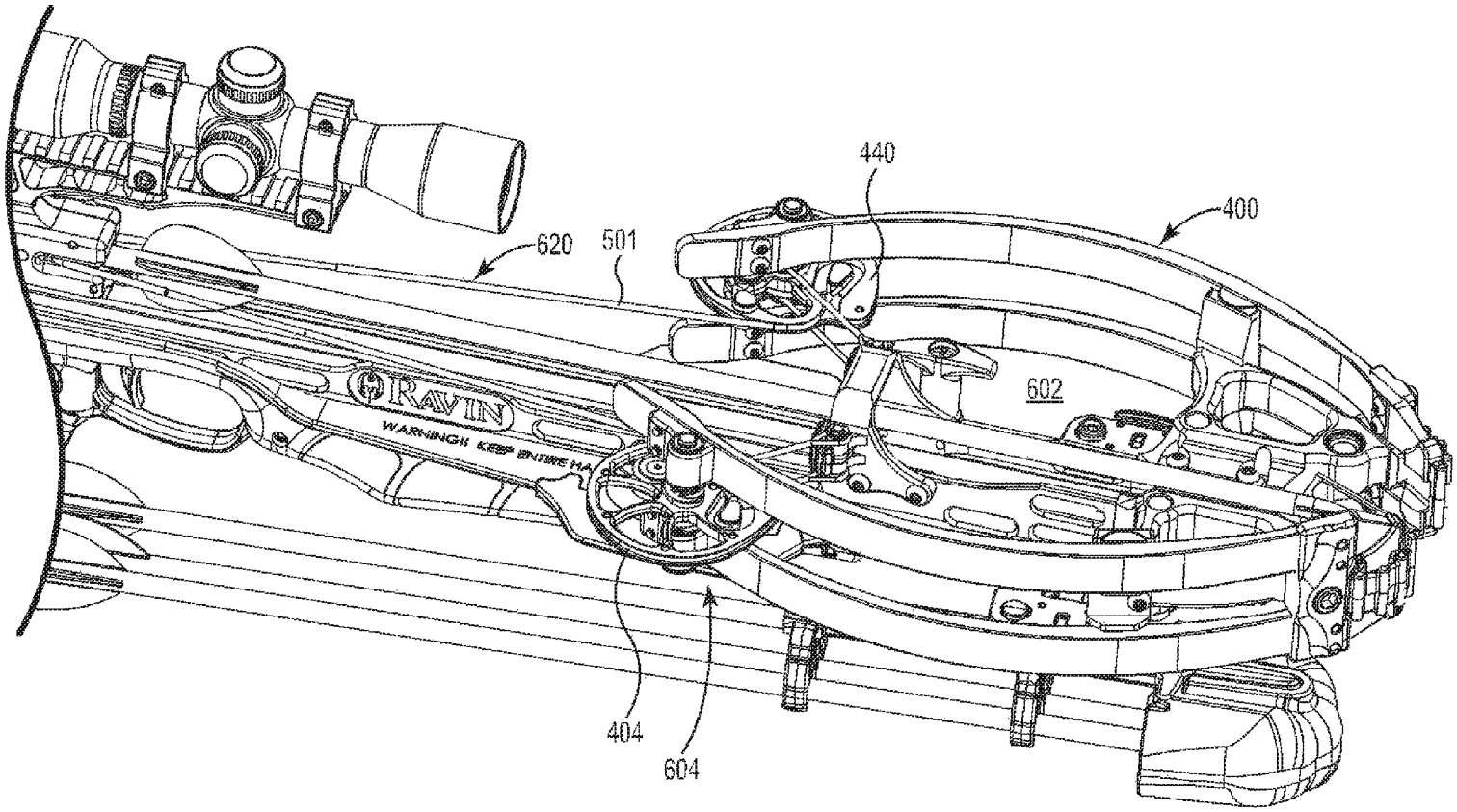
FIGS. 23A and 23B illustrate the crossbow of FIGS. 21A and 21B in a drawn configuration in accordance with an embodiment of the present disclosure.
Figure 23B:
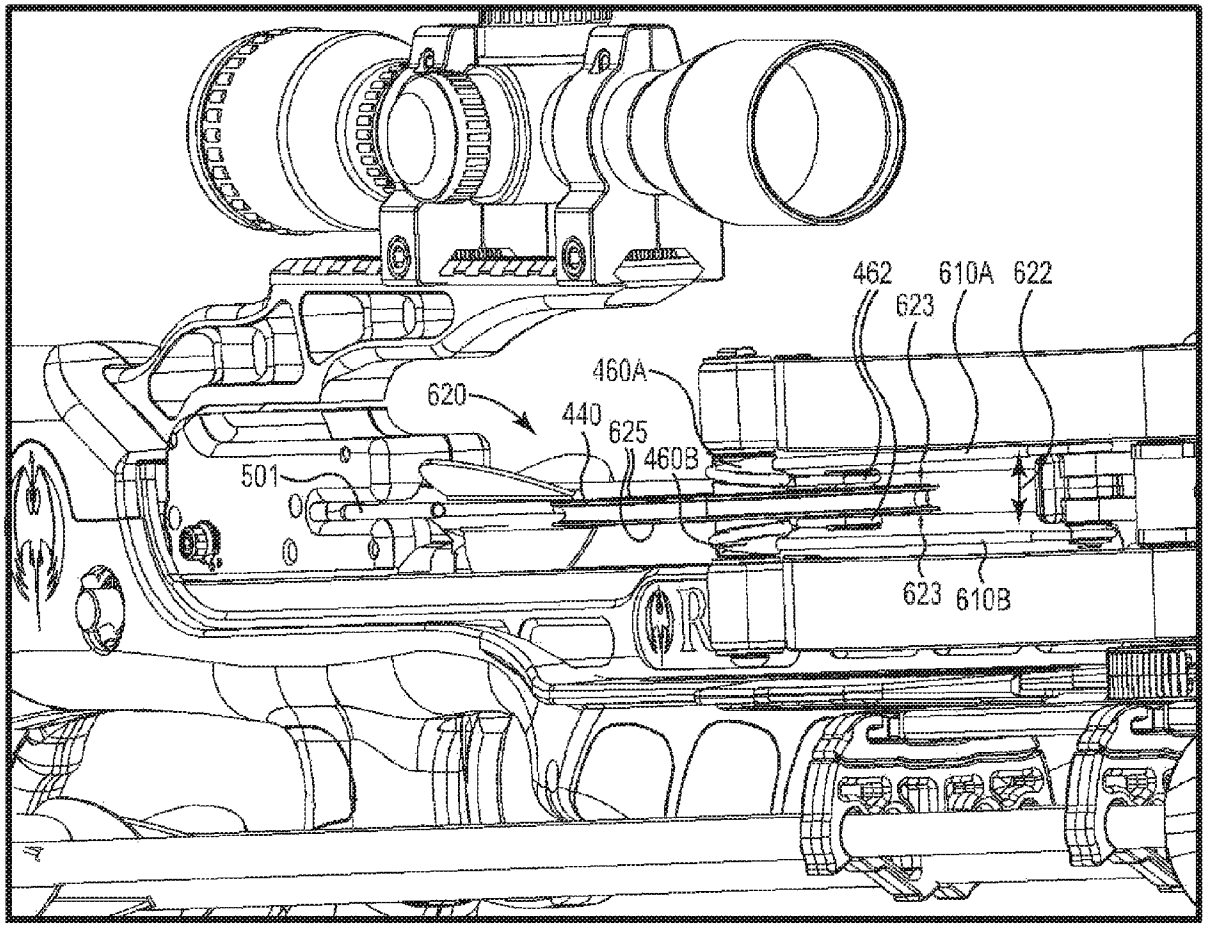

FIGS. 23A and 23B illustrate the crossbow 400 in the drawn configuration 620. Draw string 501 extends from the down-range side 602 of the cams 440 in a reverse draw configuration 604. As best illustrated in FIG. 23B, the power cables 610A, 610B move away from the cams 440 as they wrap onto the upper and lower helical journals 460A, 460B. In the drawn configuration 620 the power cables 610A, 610B are generally parallel (compare the angled relationship in the released configuration 600 illustrated in FIG. 21B). The resulting gap 622 permits the power cable attachments 462 and pivot 463 to pass under the power cables 610 without contacting them (see also, FIGS. 24A and 24B) as the crossbow 400 moves between the released configuration 600 and the drawn configuration 620. As best illustrated in FIG. 24C, gaps 623 between surfaces 625 of the cams 440 and the power cables 610 is greater than height 627 of the power cable attachments 462 and the pivots 463.

Figure 24A:
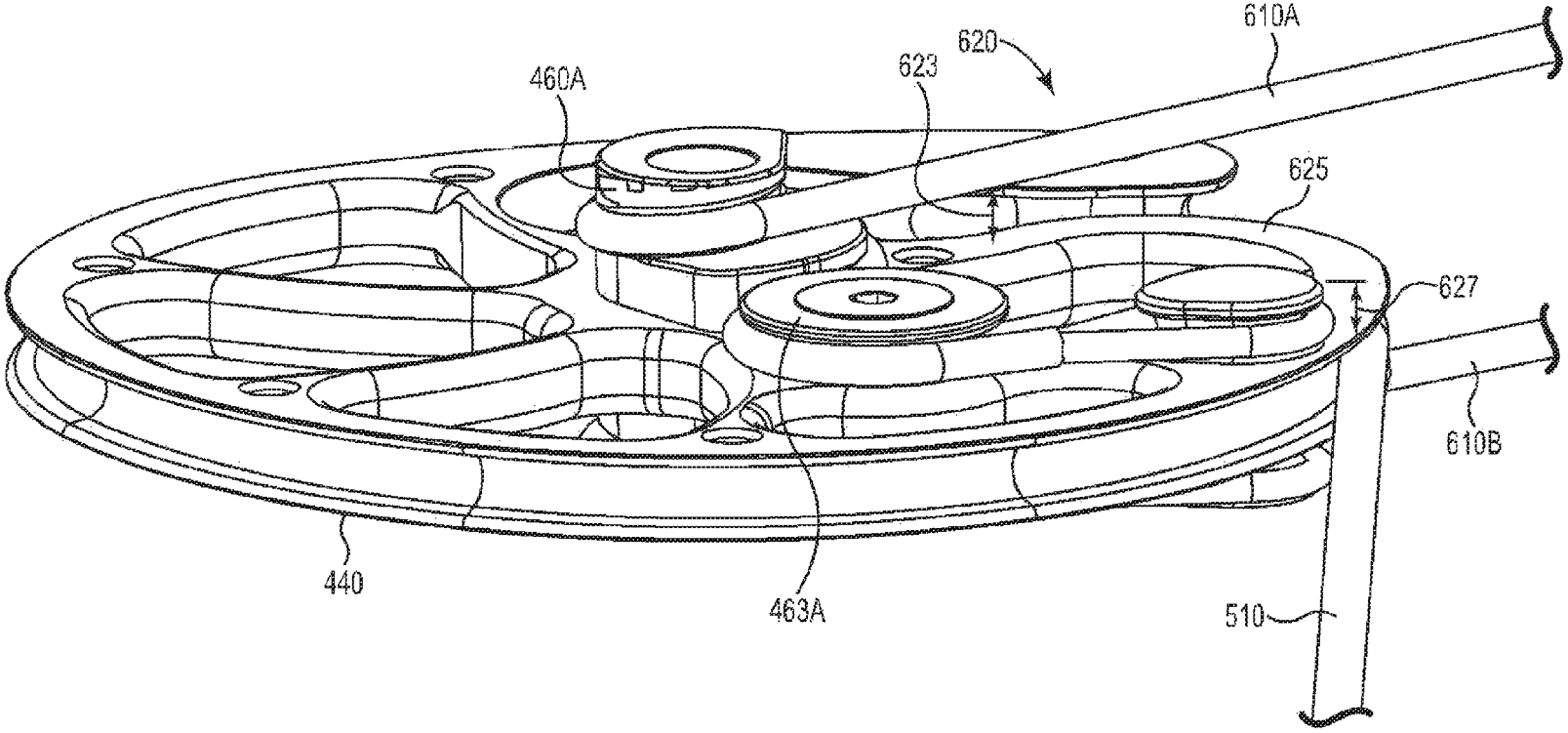
FIGS. 24A, 24B, and 24C illustrate the cams of the crossbow of FIGS. 23A and 23B in the drawn configuration.
Figure 24B:
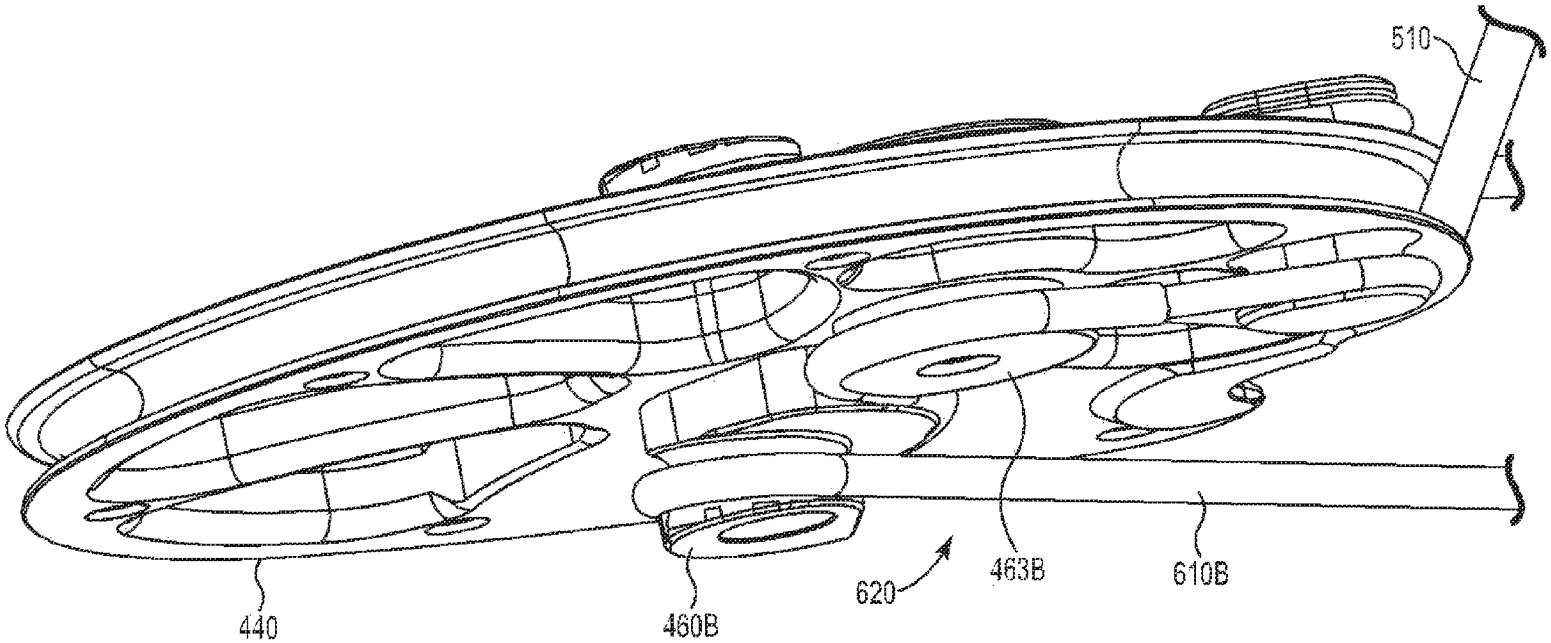
Figure 24C:
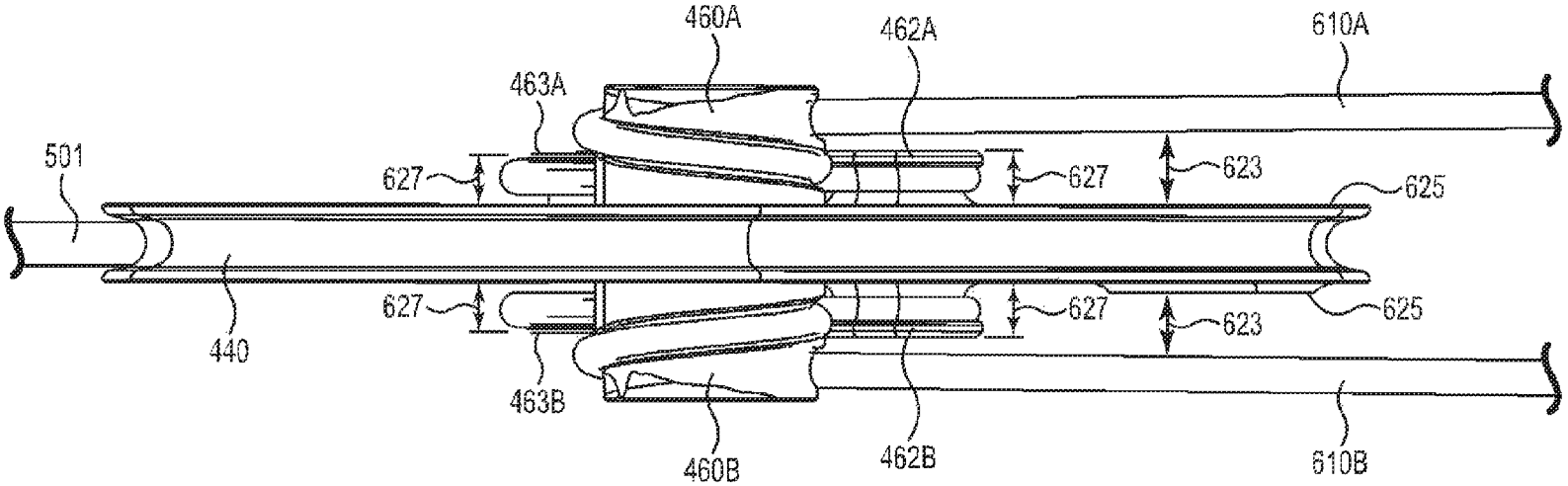

FIGS. 24A and 24B are upper and lower perspective views of the cams 440 with the cables 510, 610A, and 610B in the drawn configuration 620. The upper power cables 610A wraps around the upper pivots 463A and then onto the upper helical journal 460A, before returning to the power cable bracket 608 (see FIG. 23A). Similarly, the lower power cables 610B wraps around the lower pivots 463B and then onto the lower journal 460B, before returning to the power cable bracket 608 (see FIG. 23A). The draw cable 501 is attached to the draw string mount 472 unwraps almost completely from the draw string journal 464 of the cam 440 to the down range side 602.

In the illustrated embodiment, the draw string journal 464 rotates between about 270 degrees and about 330 degrees, and more preferably from about 300 degrees to about 360 degrees, when the crossbow 400 is drawn from the released configuration 600 to the drawn configuration 620. In another embodiment, the draw string journal 464 rotates more than 360 degrees (see FIG. 9A).

Figure 25A:
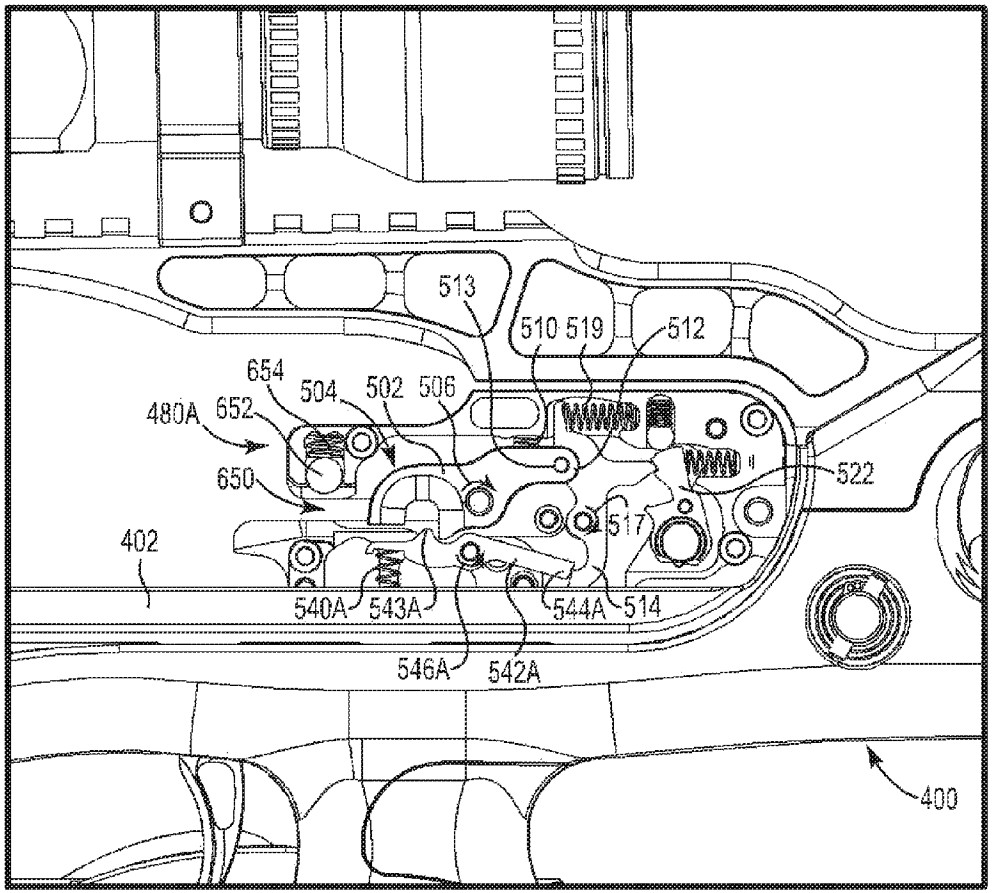
FIGS. 25A and 25B illustrate an alternate trigger assembly in accordance with an embodiment of the present disclosure.
Figure 25B:
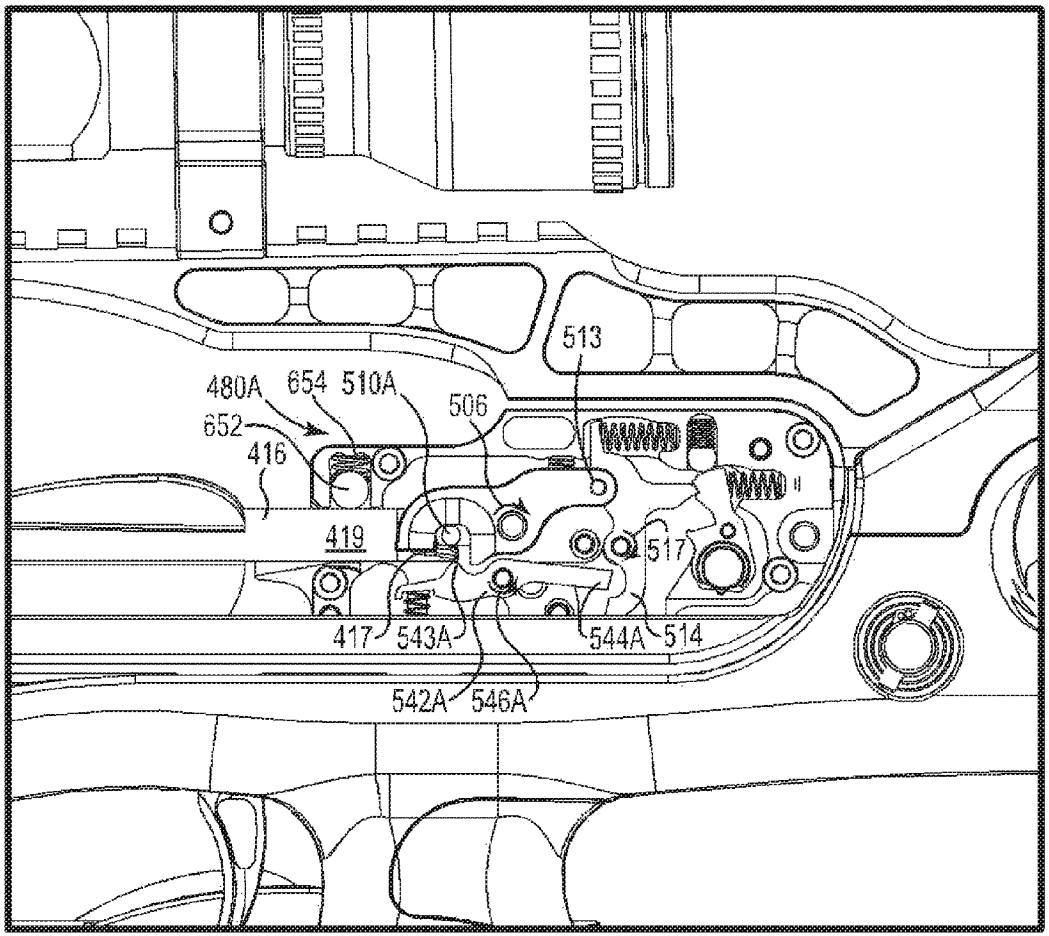

FIGS. 25A and 25B illustrate an alternate string carrier 480A for the crossbow 400 in accordance with an embodiment of the present disclosure. The string carrier 480A is similar to the assembly illustrated in FIGS. 17A-17C, so the same reference numbers are used where applicable.

FIG. 25A illustrates the catch 502 is illustrated in a closed position 504. The catch 502 is biased by spring 510 to rotate in direction 506 and retained in open position 505 (see FIG. 18B). Absent an external force, the catch 502 automatically releases the draw string 501 (See FIG. 17A). In the closed position 504 illustrated in FIG. 25A, recess 512 on sear 514 engages with low friction device 513 on the catch 502 to retain the catch 502 in the closed position 504. The sear 514 is biased by spring 519 to retain the catch 502 in the closed position 504. The safety 522 operates as discussed in connection with FIGS. 17A-17C.

Spring 540A biases dry fire lockout 542A toward the catch 502. Distal end 544A of the dry fire lockout 542A engages the sear 514 in a lockout position 541 to prevent the sear 514 from releasing the catch 502. Even if the safety 522 is disengaged from the sear 514, the distal end 544A of the dry fire lockout 542A locks the sear 514 in the closed position 504 to prevent the catch 502 from releasing the draw string 501.

As illustrated in FIG. 25B, when the bolt 416 is positioned on the string carrier 480A the rear portions or arms on the clip-on nock 417 extends past the draw string 501 (so a portion of the nock 417 is behind the draw sting 501) and engages with the portion 543A on the dry fire lockout 542A, causing the dry fire lockout 542A to rotate in direction 546A so that the distal end 544A is disengaged from the sear 514. In the illustrated embodiment, the portion 543A is a protrusion or finger on the dry fire lockout 542A. Only when a bolt 416 is fully engaged with the draw string 501 will the dry fire lockout 542A permit the sear 514 to release the catch 502.

In the illustrated embodiment, the portion 543A on the dry fire lockout 542A is positioned behind the draw string location 501A. As used herein, the phrase "behind the draw string" refers to a region between a draw string and a proximal end of a crossbow. Conventional flat or half-moon nocks do not extend far enough rearward to reach the portion 543A of the dry fire lockout 542A, reducing the chance that non-approved arrows can be launched by the crossbow 400.

FIGS. 25A and 25B illustrate elongated arrow capture recess 650 that retains rear portion 419 of the arrow 416 and the clip-on nock 417 engaged with the string carrier 480A in accordance with an embodiment of the present disclosure. The elongated arrow capture recess 650 extends along a direction of travel of an arrow launched from the crossbow 400. The arrow capture recess 650 is offset above the rail 402 as is the rest 490 (see FIG. 14C) so the arrow 416 is suspended above the rail 402 (see FIG. 13B).

Figure 25C:
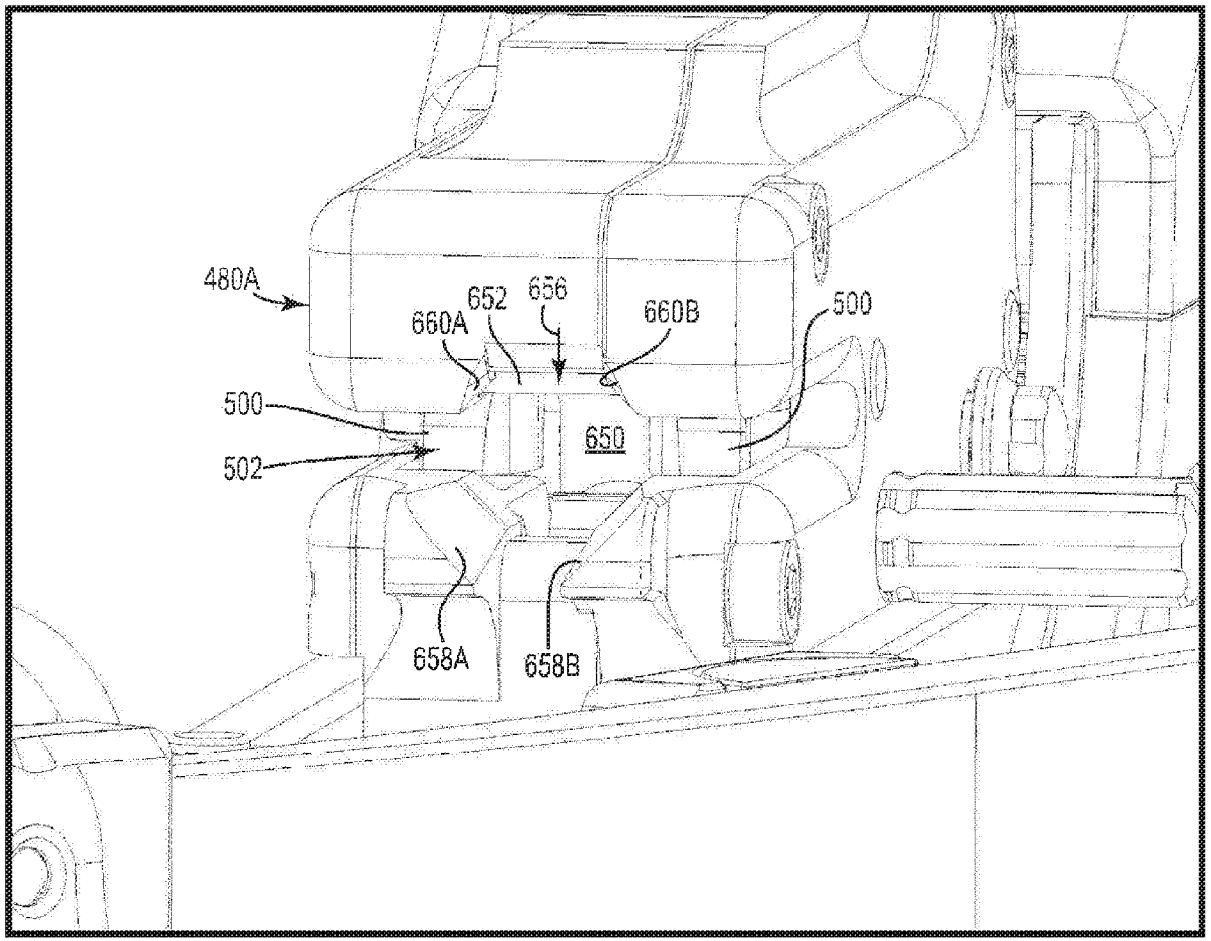
FIG. 25C is a front view of an alternate string carrier for the crossbow in accordance with an embodiment of the present disclosure.

Upper roller 652 is located near the entrance of the arrow capture recess 650. The upper roller 652 is configured to rotate in the direction of travel of the arrow 416 as it is launched. That is, the axis of rotation of the upper roller 652 is perpendicular to a longitudinal axis of the arrow 416. The upper roller 652 is displaced within the slot in a direction generally perpendicular to the arrow 416, while spring 654 biases the upper roller 652 in direction 656 against the arrow 416. As best illustrated in FIG. 25C, the arrow capture recess 650 extends rearward past the fingers 500 on catch 502. The string carrier 480A includes lower angled surfaces 658A, 658B ("658") and upper angled surfaces 660A, 660B ("660") configured to engage the arrow 416 around the perimeter of the rear portion.

In the illustrated embodiment, the clip-on nock 417 must be fully engaged with the draw string 510A near the rear of the arrow capture recess 650 to disengage the dry fire lock out 542A. In this configuration (see FIG. 25B), the rear portion 419 of the arrow 416 is fully engaged with the arrow capture recess 650, surrounded by the rigid structure of the string carrier 480A.

In one embodiment, the lower angled surfaces 658 do not support the arrow 416 in the arrow capture recess 650 unless the clip-on nock 417 is used. In particular, the upper angled surfaces 660 prevent the nock 417 from rising upward when the crossbow 400 is fired, but the arrow 417 tends to slide downward off the lower angled surfaces 658 unless the clip-on nock 417 is fully engaged with the draw string 510A.

By contrast, prior art crossbows typically include a leaf spring or other biasing structure to retain the arrow against the rail. These devices tend to break and are subject to tampering, which can compromise accuracy.

Figure 26A:
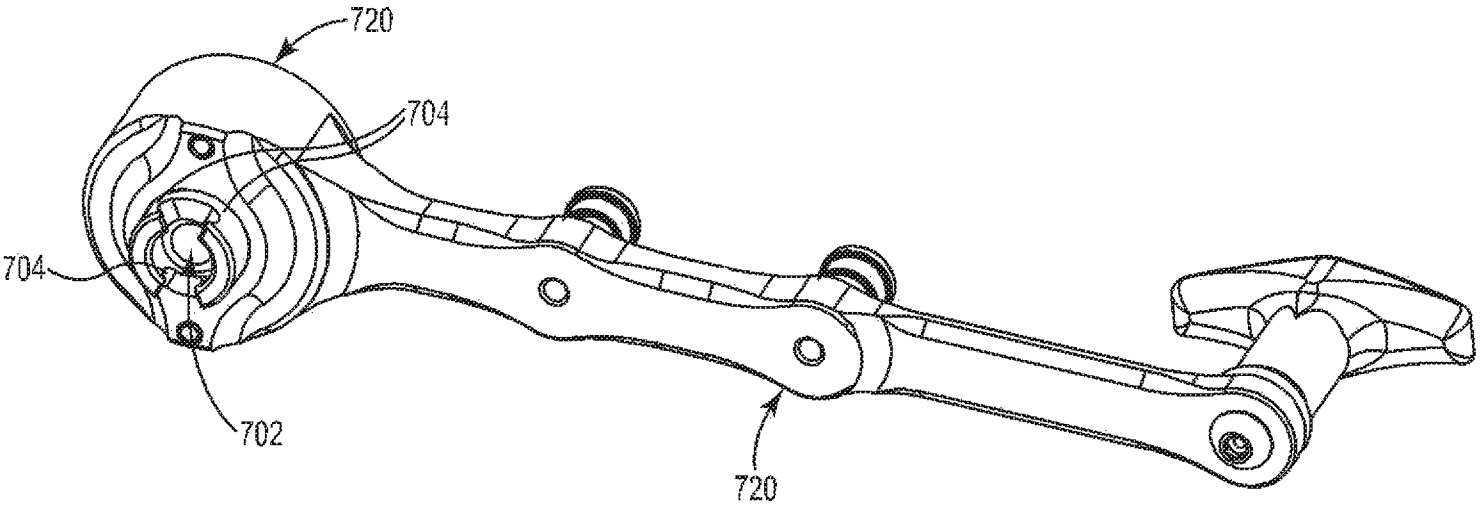
FIGS. 26A and 26B illustrate an alternate cocking handle in accordance with an embodiment of the present disclosure.

FIG. 26A illustrates an alternate the cocking handle 720 with an integral clutch to prevent excessive torque on the cocking mechanism 484 and tension on the flexible tension member 585 in accordance with an embodiment of the present disclosure. As discussed in connection with FIG. 14D, distal end 700 is configured to engage with drive shaft 564 and pins 570. Center recess 702 receives the drive shaft 564 and the undercuts 704 engage with the pins 570 when the system is under tension. Consequently, when cocking or uncocking the crossbow 400 the tension in the system locks the pins 570 into the undercuts 704. When tension in the system is removed, the cocking handle 454 can be rotated a few degrees and disengaged from the drive shaft 564.

Figure 26B:
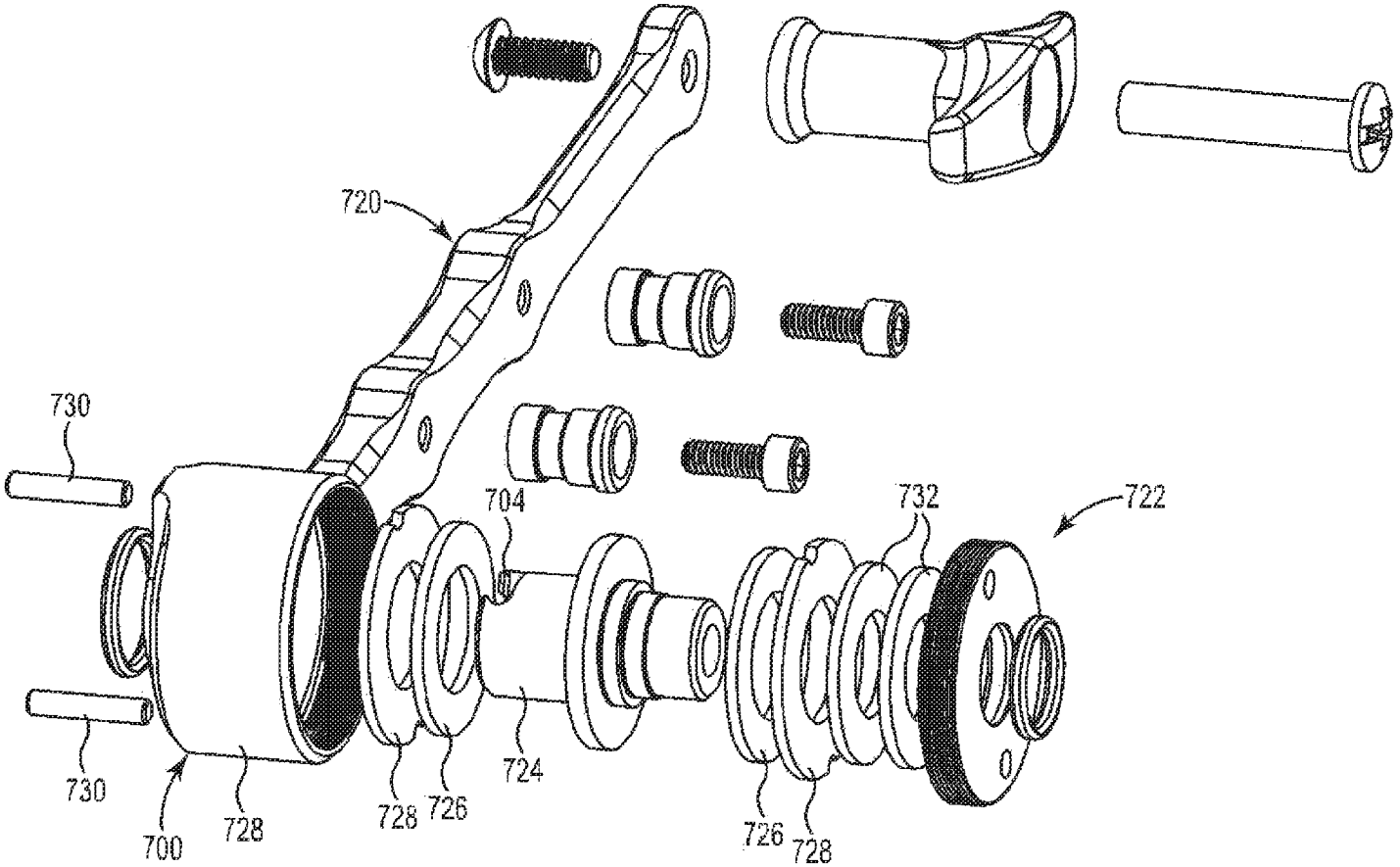

FIG. 26B is an exploded view of the cocking handle 720 of FIG. 26A. Distal end 700 contains a torque control mechanism 722. Head 724 that engages with the drive shaft 564 is contained between a pair of opposing friction washers 726 and a pair of opposing notched washers 728. Pins 730 couple the notched washers 728. One or more spring washers 732, such as for example Belleville washers, conical spring washers, and the like, maintain a compressive load on the head 724 to control the torque applied to the drive shaft 564. In an alternate embodiment, the torque control mechanism 722 is located in the stock 408 between the drive shaft 564 and the spool 560.

Figure 27A:
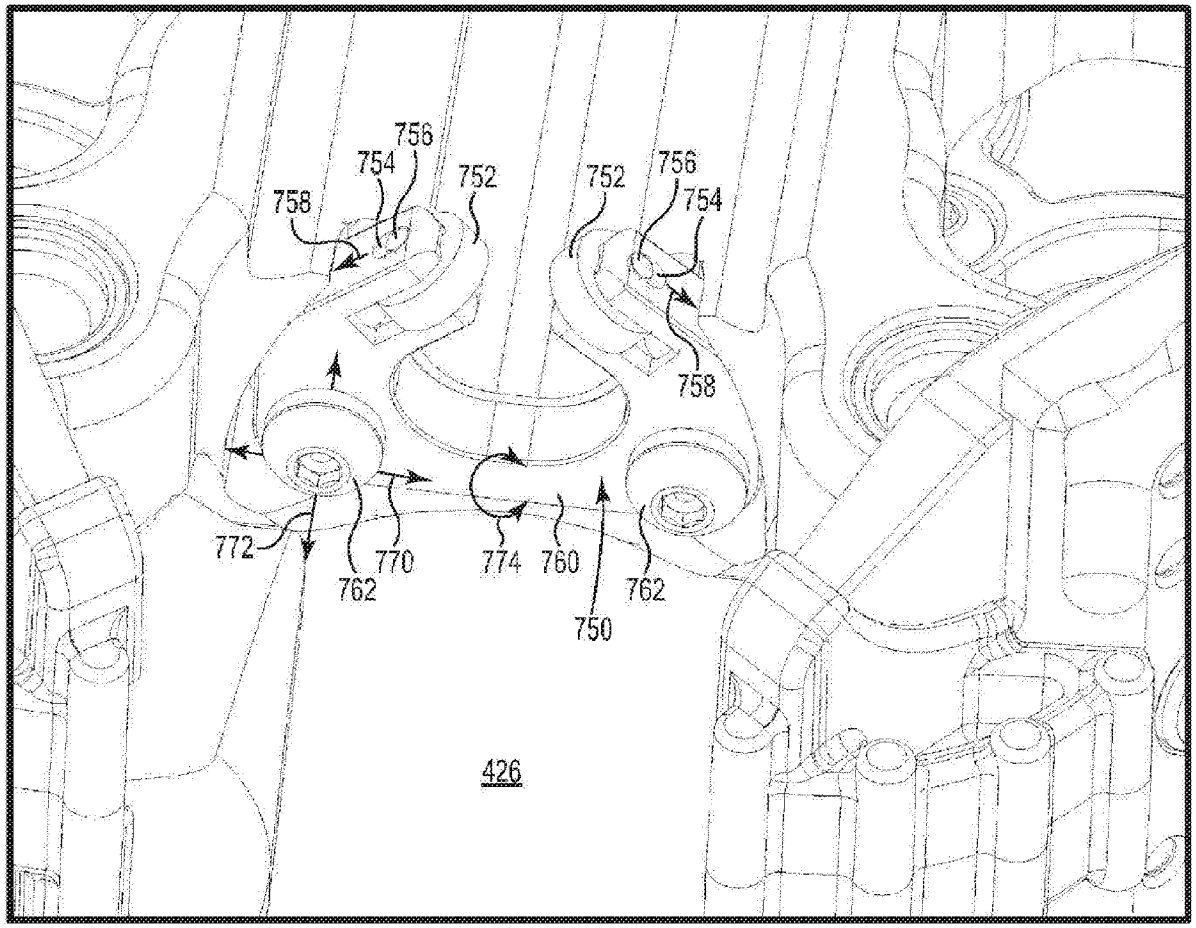
FIGS. 27A-27D illustrate an alternate tunable arrow rest for a crossbow in accordance with an embodiment of the present disclosure.
Figure 27B:
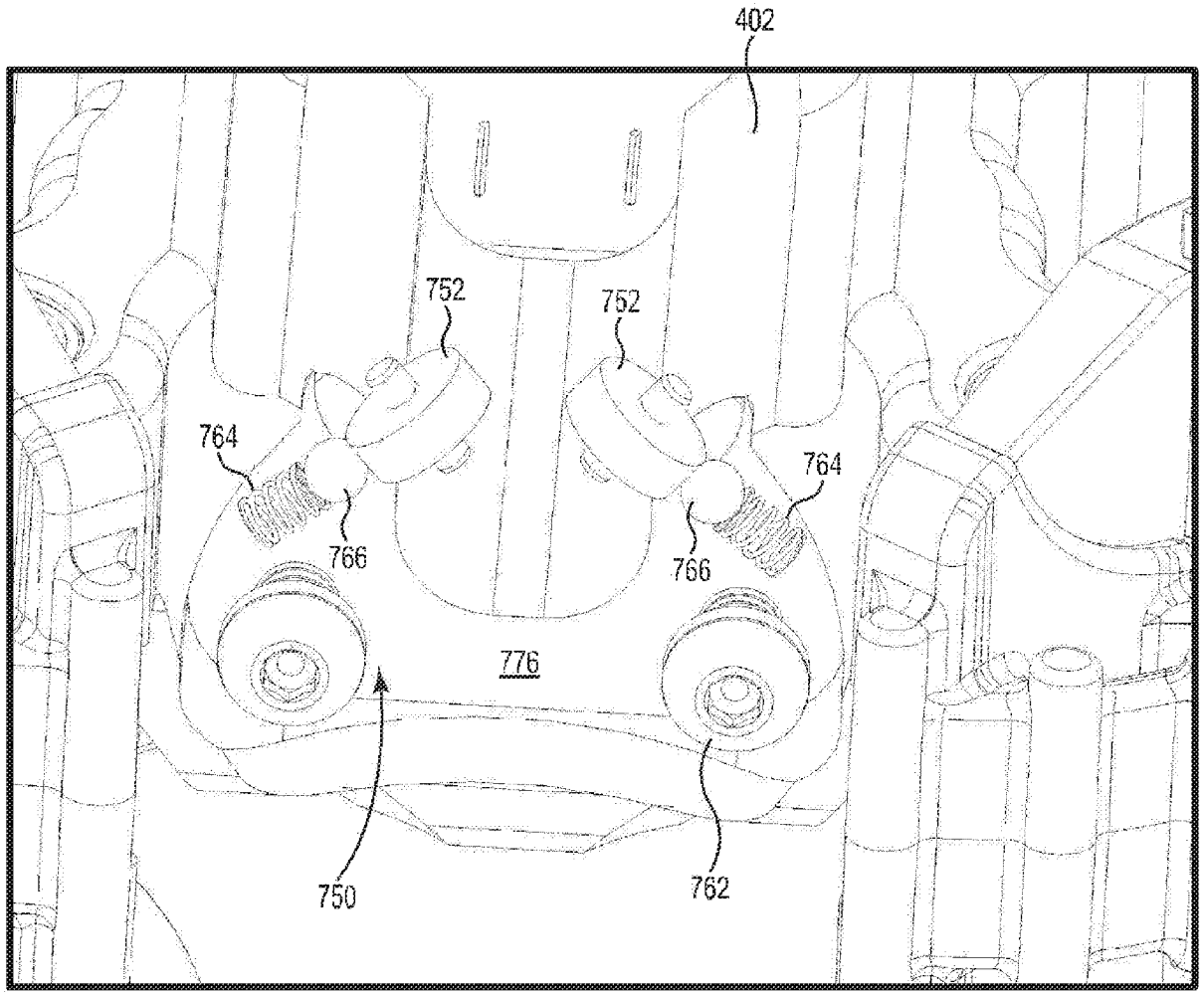
Figure 27C:
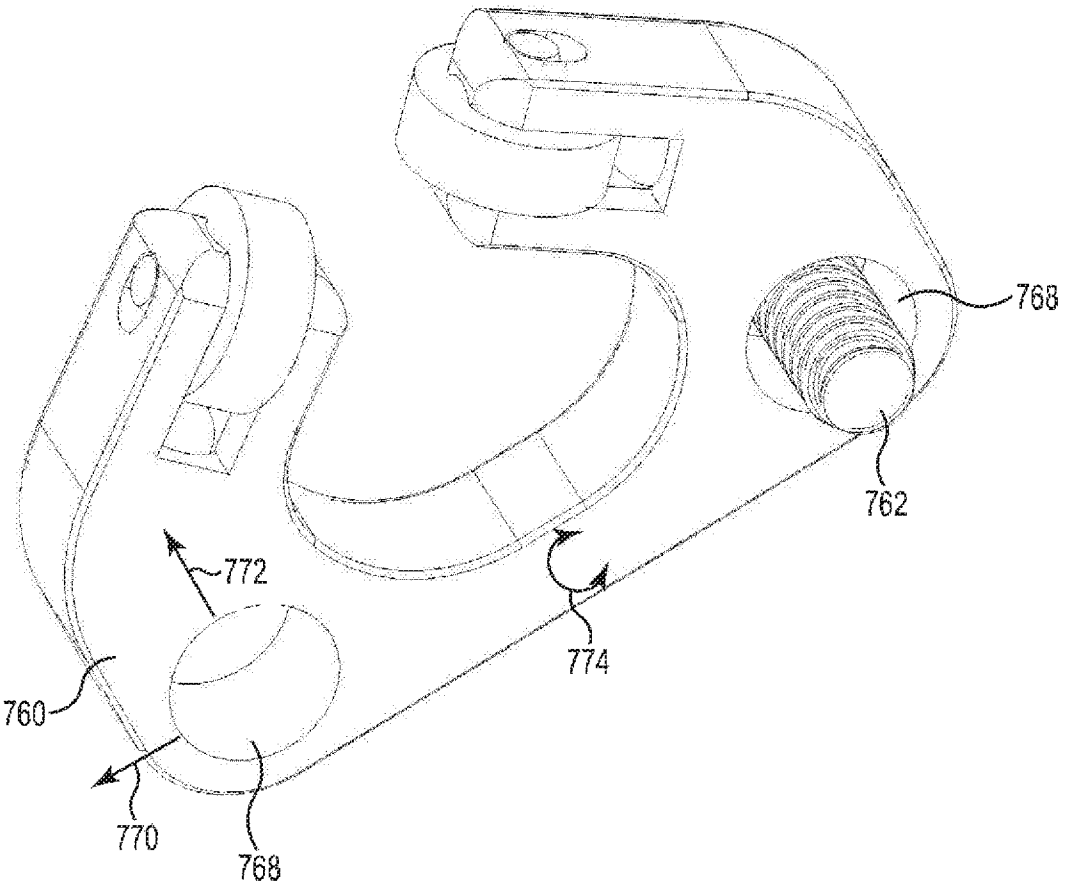

FIGS. 27A-27C illustrates an alternate tunable arrow rest 750 in accordance with an embodiment of the present disclosure. The tunable arrow rest 750 includes housing 760 that is positioned just behind the pocket 426. A pair of spring loaded support rollers 752 are rotatably secured in slots 754 by pins 756. The support rollers 752 rotate freely around the pins 756. When compressed, the support rollers 752 can be independently displaced in directions 758. Springs 764 (see FIG. 27B) bias the pins 756 and the support rollers 752 to the tops of the slots.

As best seen in FIG. 27B with the housing 760 removed, arrow rest 750 is mounted to distal end 776 of the center rail 402 by fasteners 762. Each of the support rollers 752 is biased to the tops of the slots 754 by the springs 764. Rotating member 766 is provided at the interface between the support rollers 752 and the springs 764 to reduce friction and permit the support rollers 752 to turn freely.

Figure 27D:
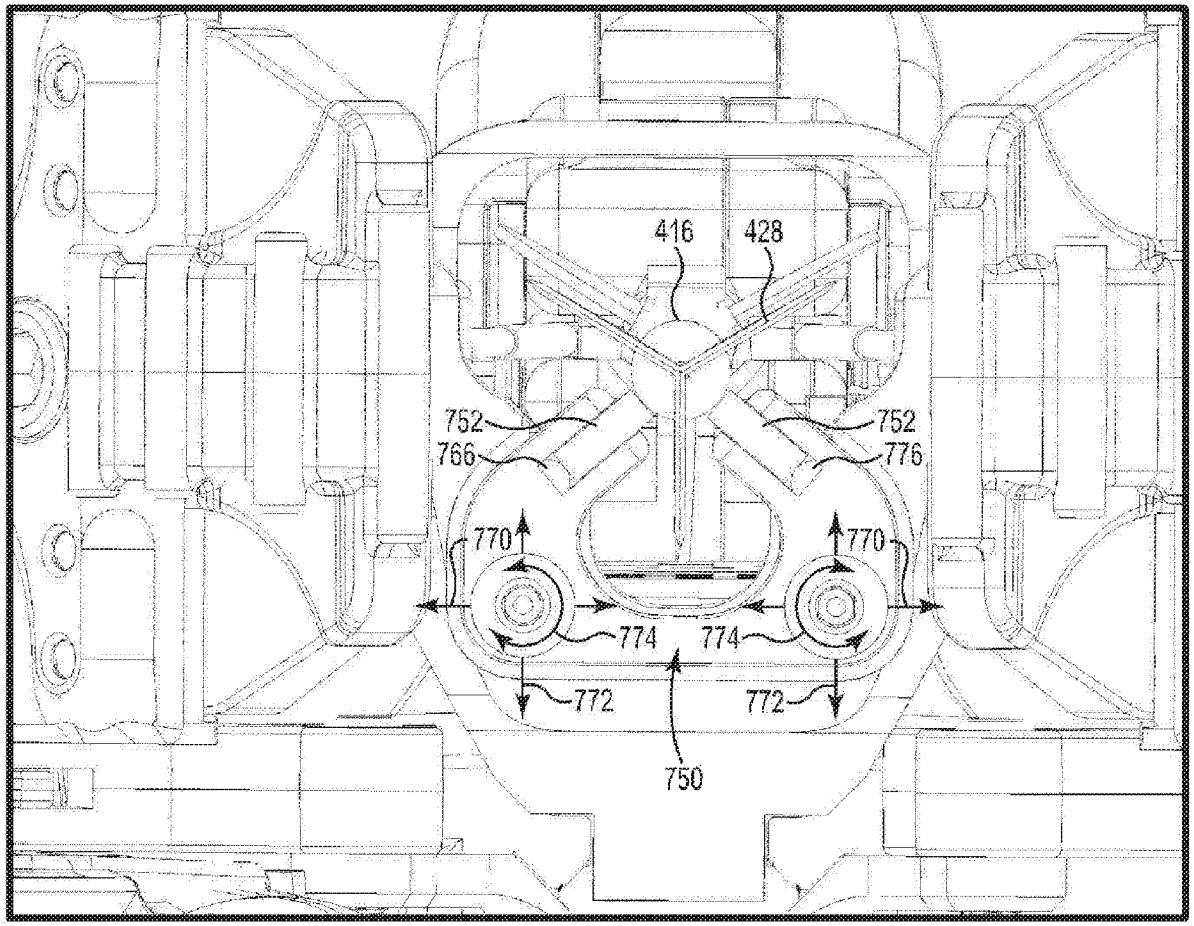

As best seen in FIGS. 27C and 27D the housing 760 includes enlarged openings 768 with diameters larger than the diameters of the fasteners 762. Consequently, the position of the arrow rest 750 can be adjusted (i.e., tuned) in at three degrees of freedom—the Y-direction 770, the Z-direction 772, and roll 774 relative to the center rail 402. FIG. 27D illustrates an arrow 412 with arrowhead 428 positioned on the support rollers 752 and the various degrees of freedom 770, 772, 774 available for tuning the arrow rest 750.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. A string control system for a crossbow having a draw string for launching arrows, the string control system comprising:

a catch moveable between a closed position that retains the draw string in a drawn configuration and an open position that releases the draw string to a released configuration such that after firing the crossbow the catch is biased to the open position;

a sear moveable between a de-cocked position and a cocked position coupled with the catch at an interface to retain the catch in the closed position such that after firing the crossbow the sear is retained in the de-cocked position by the catch, the sear being biased to the cocked position;

a dry fire lockout moveable between a disengaged position and a lockout position that blocks the sear from moving to the de-cocked position, such that after firing the crossbow the dry fire lockout is retained in the disengaged position by the sear while being biased to the lockout position; and a trigger assembly located at a proximal end of the crossbow having a trigger positioned to move the sear from the cocked position to the de-cocked position to fire the crossbow;

wherein engaging the draw string with the catch when in the open position after firing the crossbow generates a force that pushes the catch from the open position to the closed position and automatically (i) couples the sear with the catch at the interface to retain the catch in the closed position, and (ii) moves the dry fire lockout to the lockout position to block the sear from moving to the de-cocked position.

2. The string control system of claim 1 comprising a safety moveable between a free position and a safe position coupled with the sear to retain the sear in the cocked position such that after firing the crossbow the safety is retained in the free position by the sear while being biased to the safe position, whereby engaging the draw string with the catch while in the open position automatically moves the safety to the safe position coupled with the sear to retain the sear in the cocked position.

3. The string control system of claim 2 wherein the catch, sear, safety, and dry fire lockout are contained in a string carrier that slides along a center rail between a distal end to engage with the draw string and a proximal end to engage with the trigger assembly.

4. The string control system of claim 3 comprising:

a spool rotatably mounted near the proximal end of the crossbow, the spool containing a flexible tension member attached to the string carrier, a cocking handle configured to engage with the spool; and a clutch limiting tension that can be applied to the flexible tension member by the cocking handle.

5. The string control system of claim 3 comprising:

a spool containing a flexible tension member attached to the string carrier, a pair of spool gears located on opposite sides of the spool; and a drive shaft with a pair of drive gears meshed with each of the spool gears that equalize torque applied to the spool by the drive gears during cocking.

6. The string control system of claim 5 comprising a pair of pawls engaged with the spool gears that selectively prevent rotation of the spool in a direction to release the flexible tension member, the pawls being offset about ½ gear tooth spacing on the spool gears so that at least one pawl tooth is always engaged with a spool gear at all times.

7. The string control system of claim 1 wherein the catch includes a curved protrusion that engages with a corresponding recess in the sear at the interface when the sear is in the cocked position.

8. The string control system of claim 1 comprising a low friction device at the interface of the catch with the sear when the sear is in the cocked position.

9. The string control system of claim 1 comprising a low friction device at the interface comprising a roller pin supported by ball bearings that engages with a recess in the sear at the interface when the sear is in the cocked position.

10. The string control system of claim 1 comprising an arrow capture located proximate the catch, the arrow capture comprising an elongated arrow capture recess extending along a direction of travel of the arrow launched from the crossbow.

11. The string control system of claim 1 comprising an arrow capture located proximate the catch, the arrow capture comprising a rotating member with an axis of rotation generally perpendicular to a direction of travel of the arrow launched from the crossbow.

12. The string control system of claim 1 comprising an arrow capture located proximate the catch, the arrow capture comprising a rotating member that can be displaced within a slot in a direction generally perpendicular to the arrow, while being biased into engagement with the arrow.

13. The string control system of claim 1 comprising an arrow capture located proximate the catch including upper surfaces that prevent the arrow from rising upward when the crossbow is fired, and angled lower surfaces that permit the arrow to slide downward relative to the catch unless a clip-on nock on the arrow is fully engaged with the draw string.

14. The string control system of claim 1 wherein a portion of the dry fire lockout that engages with the arrow to move the dry fire lockout to the disengaged position is located behind the draw string.

15. The string control system of claim 1 wherein only arrow nocks that extend past the draw string move the dry fire lockout to the disengaged position.

16. A string control system for a crossbow having a draw string for launching arrows, the string control system comprising:

a catch moveable between a closed position that retains the draw string in a drawn configuration and an open position that releases the draw string to a released configuration such that after firing the crossbow the catch is biased to the open position;

a sear moveable between a de-cocked position and a cocked position coupled with the catch at an interface to retain the catch in the closed position such that after firing the crossbow the sear is retained in the de-cocked position by the catch, the sear being biased to the cocked position;

a safety moveable between a free position and a safe position coupled with the sear to retain the sear in the cocked position such that after firing the crossbow the safety is retained in the free position by the sear while being biased to the safe position;

a dry fire lockout moveable between a disengaged position and a lockout position that blocks the sear from moving to the de-cocked position, such that after firing the crossbow the dry fire lockout is retained in the disengaged position by the sear while being biased to the lockout position; and a trigger assembly located at a proximal end of the crossbow having a trigger with a trigger linkage coupled to a trigger pawl positioned to move the sear from the cocked position to the de-cocked position to fire the crossbow, wherein engaging the draw string with the catch after firing the crossbow generates a force that pushes the catch from the open position to the closed position to automatically (i) couple the sear with the catch at the interface to retain the catch in the closed position, (ii) move the safety to the safe position coupled with the sear to retain the sear in the cocked position, and (iii)

move the dry fire lockout to the lockout position to block the sear from moving to the de-cocked position.

* * * * *